US007450101B2

(12) United States Patent
Arimoto et al.

(10) Patent No.: US 7,450,101 B2
(45) Date of Patent: Nov. 11, 2008

(54) LIQUID CRYSTAL DISPLAY UNIT AND DRIVING METHOD THEREFOR

(75) Inventors: Katsuyuki Arimoto, Okayama (JP); Yoshihito Ohta, Okayama (JP); Takahiro Kobayashi, Okayama (JP); Taro Funamoto, Mino (JP); Yoshinori Kobayashi, Takaraduka (JP); Kenji Nakao, Osaka (JP); Seiji Kawaguchi, Hirakata (JP)

(73) Assignee: Panasonic Corporation, Osaka (JP)

( * ) Notice: Subject to any disclaimer, the term of this patent is extended or adjusted under 35 U.S.C. 154(b) by 602 days.

(21) Appl. No.: 11/285,256

(22) Filed: Nov. 23, 2005

(65) Prior Publication Data

US 2006/0077157 A1 Apr. 13, 2006

Related U.S. Application Data

(62) Division of application No. 10/240,911, filed as application No. PCT/JP02/00824 on Feb. 1, 2002, now Pat. No. 6,989,812.

(30) Foreign Application Priority Data

Feb. 5, 2001 (JP) ..... 2001-027881
Apr. 27, 2001 (JP) ..... 2001-131414

(51) Int. Cl.
*G09G 3/36* (2006.01)

(52) U.S. Cl. ..... 345/94; 345/96; 345/98

(58) Field of Classification Search ..... 345/87–100, 345/204, 208–210
See application file for complete search history.

(56) References Cited

U.S. PATENT DOCUMENTS 5,490,000 A 2/1996 Tanaka et al.
6,069,620 A 5/2000 Nakamura et al.
6,084,562 A 7/2000 Onda (Continued)

FOREIGN PATENT DOCUMENTS

EP 0 854 465 7/1998

(Continued)

OTHER PUBLICATIONS

Japanese Liquid Crystal Society Journal, vol. 3, No. 2, p. 99(17)-p. 106(24), Apr. 25, 1999.

*Primary Examiner*—Regina Liang
(74) *Attorney, Agent, or Firm*—Wenderoth, Lind & Ponack, L.L.P.

(57) ABSTRACT

A signal converting section increases a transfer rate of an input image signal to be supplied to a liquid crystal panel and, at the same time, also inserts a non-image signal for applying a predetermined voltage to liquid-crystal cells in a space of the input image signal and supplies it as a picture-element signal to a source driver. To each picture cell, an input image signal and a non-image signal are sequentially written with positive or negative polarity. For all picture elements, after the input image signal is written, the non-image signal equal in polarity to the input image signal is always written. Furthermore, after the non-image signal is written, an image signal opposite in polarity to the non-image signal is always written. Thus, when an image is displayed on the liquid crystal panel in OCB mode, it is possible to prevent the occurrence of back transition and carry out image display evenly.

6 Claims, 42 Drawing Sheets

U.S. PATENT DOCUMENTS

| | | | |
|---|---|---|---|
| 6,396,469 | B1 | 5/2002 | Miwa et al. |
| 2002/0044117 | A1 | 4/2002 | Matsumura et al. |
| 2003/0107538 | A1 | 6/2003 | Asao et al. |
| 2004/0150605 | A1 | 8/2004 | Arimoto et al. |

FOREIGN PATENT DOCUMENTS

| | | |
|---|---|---|
| GB | 2 342 754 | 4/2000 |
| JP | 61-128227 | 6/1986 |
| JP | 62-175714 | 8/1987 |
| JP | 01-296221 | 11/1989 |
| JP | 04-218023 | 8/1992 |
| JP | 07-064055 | 3/1995 |
| JP | 07-064056 | 3/1995 |
| JP | 9-138421 | 5/1997 |
| JP | 11-109921 | 4/1999 |
| JP | 11-237606 | 8/1999 |
| JP | 2000-105575 | 4/2000 |
| JP | 2000-122596 | 4/2000 |
| JP | 2000-298259 | 10/2000 |
| JP | 2000-347634 | 12/2000 |
| JP | 2001-042282 | 2/2001 |

FIG. 1 - PRIOR ART

FIG. 2 - PRIOR ART

FIG. 3 - PRIOR ART (a) FIRST FRAME (b) SECOND FRAME

LIQUID CRYSTAL DISPLAY UNIT AND DRIVING METHOD THEREFOR

This application is a divisional application of Ser. No. 10/240,911 filed on Oct. 7, 2002, now U.S. Pat. No. 6,989,812, which is a National Stage Application of International Application PCT/JP02/00824, filed Feb. 1, 2002.

TECHNICAL FIELD

The present invention relates to liquid crystal devices, more specifically, relates to a liquid crystal device using an active-matrix-type liquid crystal panel, and can be expediently applied to a liquid crystal device in OCB (Optically self-Compensated Birefringence) mode.

BACKGROUND ART

A large number of liquid crystal devices have been used as a screen display device for a computer device, and are expected to also be used more in the future for TVs. However, currently widely-available liquid crystal display devices are those in TN (Twisted Nematic) mode, having a narrow viewing angle and an insufficient response rate. This causes problems, such as reduction in contrast due to parallax and blurs in moving pictures, posing a large problem about the display capability in TN mode for TVs.

In recent years, studies have been directed to the OCB mode instead of the TN mode. The OCB mode is a scheme with a wide viewing angle and a high-speed response compared with the TN mode. Therefore, the OCB mode is a display mode more suitable for nature motion picture display.

Hereinafter described are a liquid crystal display device and a method of driving the same that adopt the OCB mode.

FIG. 1 illustrates the construction of a conventional liquid crystal display device. In FIG. 1, the liquid crystal display device includes gate lines GL1 through GLn, source lines SL1 through SLm, a plurality of thin-film transistors (hereinafter referred to as TFTs) 103 as switching devices, etc. FIG. 2 illustrates a picture element section thereof. As illustrated in FIG. 2, a drain electrode of the TFT 103 is connected to a picture-element electrode in a picture element 104. The picture element 104 is structured by the picture-element electrode, a common electrode 201, a liquid crystal 202 held between both of these electrodes, and a storage capacitor 203 formed between the picture-element electrode and the common electrode 201. The common electrode 201 is driven by a voltage supplied by a common driving section 105 illustrated in FIG. 1.

In FIG. 1, the gate driver 101 applies a voltage to the gate lines GL1 through GLn for turning the TFTs 103 ON or OFF. In synchronization with data supply to the source lines SL1 through SLm, the gate driver 101 sequentially applies an ON potential to the gate lines GL1 through GLn.

The source driver 102 applies a voltage to the source lines SL1 through SLm to supply the voltage to the respective picture elements 104. A difference between the voltage supplied to the common electrode 201 and the voltage supplied to each of the source lines SL1 through SLm to be applied to the picture element 104 is a voltage between both ends of the liquid crystal 202 in the picture element 104. This voltage determines the transmittance of the picture element 104.

The above driving scheme is applied not only to OCB cells, but also to a case where TN-type cells are used. When the OCB cells are used, however, an activation step of starting video display requires unique driving, which is not required when the TN-type cells are used.

An OCB cell has a bend configuration enabling image display or a spray configuration disabling imaged display. To cause transition from the spray configuration to the bend configuration (hereinafter referred to as transition), the unique driving is required, such as applying a high voltage for a predetermined time. Note that the driving associated with transition is not directly related to the present invention, and therefore is not further described herein.

This OCB cell has a problem that, even once transition is made to the bend configuration by the above unique driving, if a voltage over a predetermined level has not been applied for over a predetermined time, the bend configuration cannot be maintained and is back to the spray configuration. This phenomenon is hereinafter called "back transition".

To suppress the occurrence of back transition, as disclosed in Japanese Patent Laid-Open Publication No. 11-109921 and Japanese Liquid Crystal Society Journal, Apr. 25, 1999 (Vol. 3, No. 2) P. 99 (17) through P. 106 (24), it is known that a high voltage is regularly applied to the OCB cells. Hereinafter, driving for periodically applying a high potential in order to suppress back transition is called "anti-back transition driving".

FIG. 3 illustrates potential-transmittance curves observed in general OCB.

A curve 301 is a potential-transmittance curve at normal driving, not at anti-back transition driving, and a curve 302 is a potential-transmittance curve at anti-back transition driving. A potential 303 indicates a critical potential Vth at which back transition occurs at normal driving. A potential 304 is a potential when the transmittance is at the highest (white potential), and a potential 305 is a potential when the transmittance is at the lowest (black potential).

At normal driving (that is, when no prevention of back transmission is carried out), the configuration of the OCB cell is back to the spray configuration when the potential becomes Vth or lower, and therefore an appropriate transmittance cannot be obtained. Thus, driving is always made with a potential not lower than Vth. In such case, however, as illustrated in FIG. 3, sufficient luminance cannot be obtained. For this reason, the OCB requires anti-back transition driving to be carried out.

As is well known, liquid crystals typified by OCB and TN require so-called alternating driving to be carried out. However, the above-described Japanese Patent Laid-Open Publication No. 11-109921 and Japanese Liquid Crystal Society Journal do not disclose any specific construction of a liquid crystal display device in OCB mode. Therefore, both of the documents do not help specify which type of alternate inversion should be carried out. Therefore, hereinafter described is a virtual example of anti-back transition driving when the most general alternating driving (that is, a combination of line-by-line inversion and frame-by-frame inversion) is carried out.

FIG. 4 is an illustration showing the construction of a liquid crystal display device as the virtual example. In FIG. 4, the liquid crystal display device includes a signal converting section 401, a driving pulse generating section 402, a source driver 403, a gate driver 404, and a liquid crystal panel 405. The signal converting section 401 doubles the speed of an input image signal line by line, converting it into a double-speed signal composed of a double-speed image signal and a double-speed non-image signal. The driving pulse generating section 402 generates pulses for driving the respective drivers 403 and 404. To facilitate understanding of the description, assume for convenience sake that the number of source lines of the liquid crystal panel 405 is ten (SL1 through SL10), the number of gate lines is ten (GL1 through GL10), and one frame period is composed of ten horizontal periods.

Described next is an operation of anti-back transition driving to be carried out by this liquid crystal display device. An input image signal is doubled in speed line by line in the signal converting section 401, and is then supplied to the source driver 403.

FIG. 5 illustrates a specific construction of the signal converting section 401. Also, FIG. 6 illustrates timing of a converting operation. The control signal generating section 501 generates various control signals, such as a clock, from a synchronizing signal synchronized with the input image signal. The input image signal is written in a line memory 502 in synchronization with a write clock from a control signal generating section 501. The image signal written in the line memory 502 is read from the line memory 502 in synchronization with a read clock (having a frequency twice as much as that of the write clock) from the control signal generating section 501, and this reading is carried out during a period half of that of writing. While the image signal is being read from the line memory 502, the output signal selecting section 504 selects this image signal as an output and, during the remaining period, selects a non-image signal outputted from the non-image signal generating section 503 as an output. Consequently, as illustrated in FIG. 6, in one horizontal period of the input signal, the double-speed non-image signal and image signal are outputted in time sequence. The non-image signal is a signal for applying a predetermined high potential to the OCB cells with predetermined periodicity.

In FIG. 4, the source driver 403 alternately inverts the output signal (double-speed signal) from the signal converting section 401 for supply to the source lines (SL1 through SL10) of the liquid crystal panel 405. FIG. 7 is an illustration showing timing of a polarity control signal and driver driving pulses when line-by-line inversion and frame-by-frame inversion are combined as described above. The polarity control signal, which is to switch alternating polarity, is a signal obtained by XORing a frame inverting signal (A) and a line inverting signal (B), and is generated by the driving pulse generating section 402 illustrated in FIG. 4.

An input-output characteristic of the source driver 403 is illustrated in FIG. 8. In FIG. 8, signal outputs higher with respect to a reference potential are illustrated as having a positive polarity, and those lower with respect thereto as having a negative polarity. Also, in FIG. 7, this polarity is represented as "+" or "−" in each gate-selected period. For example, "+" is indicated on a gate pulse P1 at a location corresponding to a period T0_1 during which the gate pulse P1 is selected. This indicates that a voltage supplied by the source driver 403 during the period T0_1 has a positive polarity. As illustrated in FIG. 8, the source driver 403 supplies a positive voltage when the polarity control signal is HI, and supplies a negative voltage when LOW.

In FIG. 7, gate pulses P1 through P10 are pulses for selecting ten gate lines (GL1 through GL10), respectively, on the liquid crystal panel 405 during their HI periods. The gate pulses P1 through P10 are driven in the following manner in accordance with timing of the double-speed signal inputted to the source driver 403.

During the period T0_1 illustrated in FIG. 7, the gate pulse P1 becomes HI, and a positive image signal S1 is written in picture elements on the gate line GL1. During the following period T0_2, the gate pulse P7 becomes HI, and a negative non-image signal is written in picture elements on the gate line GL7. During a period T0_3, the gate pulse P2 becomes HI, and a negative image signal S2 is written in picture elements on the gate line GL2. During the following period T0_4, the gate pulse P8 becomes HI, and a positive non-image signal is written in picture elements on the gate line GL8. Thereafter, signals are sequentially written in accordance with the polarity of the polarity control signal.

In this way, each of the gate lines (GL1 through GL10) on the liquid crystal panel 405 is selected twice during one frame period. In the picture elements on each gate line, an image signal and a non-image signal are written once.

During a period T1_1 of a second frame coming next, the gate pulse P1 becomes HI, and a negative image signal S'1, which is opposite in polarity of the signal in the first frame, is written in the picture elements on the gate line GL1. During the following period T1_2, the gate pulse P7 becomes HI, and a positive non-image signal, which is opposite in polarity of the signal in the first frame, is written on the gate line GL7. Thereafter, similarly, signals opposite in polarity to those in the first frame are sequentially written.

As such, the image signal is made opposite in polarity to that in the previous frame so as to avoid sticking caused on the liquid crystal panel when signals of the same polarity are retained for a long time.

With the above-described operation, it is possible to write image signals as well as to periodically write non-image signals. By giving voltages of the non-image signals as appropriate, back transition can be prevented.

In FIG. 7, however, when changes in polarity of the signals (image signal and non-image signal) written in each line are noted, as to the first line through the fifth line, after an image signal is written, a non-image signal (B) opposite in polarity to this image signal is always written. Furthermore, after the non-image signal is written, an image signal equal in polarity to the non-image signal is always written. On the other hand, as to the sixth line through the tenth line, after an image signal is written, a non-image signal equal in polarity to the image signal is always written. Furthermore, after the non-image signal is written, an image signal opposite in polarity to the non-image signal is always written. That is, the phase relation is changed between the first line through fifth line and the sixth line through the tenth line.

Such change in the polarity inversion relation at a certain line will affect charging to the liquid crystal and, consequently, become a cause of impairing evenness in image quality. Especially in recent years, liquid crystal panels have become upsized and capable of displaying with higher definition. Accordingly, wiring resistance in a glass substrate becomes increased, and also a time allocated for recharging each picture element tends to be shorter. Therefore, influences caused by the change in the phase relation on recharging the picture elements are not negligible, despite technologies for improving the capability of a picture element transistor, etc. Therefore, in the above virtual example, a difference in luminance is disadvantageously recognized between the fifth line and the sixth line.

Furthermore, compared with normal driving where non-image signals are not inserted, the driving frequency in the above virtual example becomes double. Therefore, the time allocated for writing the image signal to each picture element is shortened by half compared with normal driving. Consequently, writing of data to the picture elements may not sufficiently be carried out.

Therefore, an object of the present invention is to provide a liquid crystal display device and a method of driving the same that can suppress the occurrence of back transition without causing the above problems when OCB cells are used and, as a result, can display a good image.

SUMMARY OF THE INVENTION

To achieve the above objects, the present invention has the following aspects.

A first aspect of the present invention is directed to a liquid crystal display device that displays an image by driving, based on an input image signal, a liquid crystal panel having a plurality of source lines supplied with a picture-element signal, a plurality of gate lines supplied with a scanning signal, and a plurality of picture-element cells arranged in matrix on intersections of the source lines and the gate lines, including: a source driver for supplying the picture-element signal to the source lines; a gate driver for supplying the scanning signal to the gate lines; driving control means for generating a polarity control signal for controlling a polarity of a voltage applied to each of the picture-element cells, and controlling the source driver by the polarity control signal; and a signal converting section for speeding up a transfer rate of the input image signal, and inserting a non-image signal in space of the input image signal, the non-image signal for applying a predetermined voltage to the liquid-crystal cells, to supply the picture-element signal to the source driver, wherein the input image signal and the non-image signal of a positive or negative polarity are sequentially written in each of the picture-element cells, and for all of the picture elements, after an input image signal is written, a non-image signal equal in polarity to the input image signal is always written, and further, after the non-image signal is written, an input image signal opposite in polarity to the non-image signal is always written.

A second aspect of the present invention is directed to a liquid crystal display device that displays an image by driving, based on an input image signal, a liquid crystal panel having a plurality of source lines supplied with a picture-element signal, a plurality of gate lines supplied with a scanning signal, and a plurality of picture-element cells arranged in matrix on intersections of the source lines and the gate lines, including: a source driver for supplying the picture-element signal to the source lines; a gate driver for supplying the scanning signal to the gate lines; driving control means for generating a polarity control signal for controlling a polarity of a voltage applied to each of the picture-element cells, and controlling the source driver by the polarity control signal; and a signal converting section for speeding up a transfer rate of the input image signal, and inserting a non-image signal in space of the input image signal, the image signal for applying a predetermined voltage to the liquid-crystal cells, to supply the picture-element signal to the source driver, wherein the input image signal and the non-image signal of a positive or negative polarity are sequentially written in each of the picture-element cells, and for all of the picture element cells, after an input image signal is written, a non-image signal opposite in polarity to the input image signal is always written, and further, after the non-image signal is written, an input image signal equal in polarity to the non-image signal is always written.

According to the above first and second aspects, an input image signal and a non-image signal are sequentially written in the picture-element cells, thereby improving image quality of the moving pictures. Also, the polarity inversion can be balanced, thereby enabling image display evenly.

According to a third aspect of the present invention, in the first or second aspect, the picture-element cells are OCB cells, the predetermined voltage to be applied to the liquid crystal is a voltage that can prevent a back transition phenomenon of the OCB cells.

According to the above third aspect, it is possible to prevent back transition in OCB as well as to display an image with sufficient luminance.

According to a fourth aspect of the present invention, in the first or second aspect, before the input image signal is written, a non-image signal equal in polarity to the input image signal is preliminarily written in the picture-element cell.

According to the above fourth aspect, writing of the input image signal becomes easy.

According to a fifth aspect of the present invention, in the first or second aspect, after the non-image signal is written, a non-image signal equal in polarity to the non-image signal is further auxiliarily written in the picture-element cell.

According to a sixth aspect of the present invention, in the first or second aspect, before the non-image signal is written, an input image signal equal in polarity to the non-image signal is further preliminarily written.

According to the above fifth and sixth aspects, writing of the non-image signal becomes easy.

A seventh aspect of the present invention is directed to a liquid crystal display device that displays an image by driving, based on an input image signal, a liquid crystal panel having a plurality of source lines supplied with a picture-element signal, a plurality of gate lines supplied with a scanning signal, and a plurality of picture-element cells arranged in matrix on intersections of the source lines and the gate lines, including: a source driver for supplying the picture-element signal to the source lines; a gate driver for supplying the scanning signal to the gate lines; and a signal converting section for speeding up a transfer rate of the input image signal, and inserting a non-image signal in space of the input image signal, the non-image signal for applying a predetermined voltage to the liquid-crystal cells, to supply the picture-element signal to the source driver, wherein the non-image signal is written simultaneously to two or more scanning lines corresponding to two or more of the gate lines.

According to the seventh aspect, an input image signal and a non-image signal are sequentially written in the picture-element cells, thereby improving image quality of the moving pictures. Also, it is not required to convert the signal transfer rate to up to a doubled one. Therefore, writing of signals in the picture-element cells become easy.

According to an eighth aspect of the present invention, in the seventh aspect, the predetermined voltage to be applied to the liquid crystal is a voltage that can prevent a back transfer phenomenon of the OCB cells.

According to a ninth aspect of the present invention, in the seventh aspect, the liquid crystal display device further includes adjusting means for adjusting the input image signal so that the number of scanning lines to be scanned for one frame period becomes $N\times(2M+1)$, where the number of the two or more scanning lines in which the non-image signal is simultaneously written is N.

In the above ninth aspect, the number of scanning lines of the input image signal can be adjusted, even when not satisfying a predetermined condition. Therefore, irrespectively of the number of scanning lines of the input image signal, image display can be made more evenly.

According to a tenth aspect of the present invention, in the seventh aspect, the liquid crystal display device further includes luminance correcting means for correcting luminance of the input image signal at a predetermined degree so that luminance variations due to difference in time periods of retaining the non-image signal for each of the picture-element cells are eliminated.

According to the above tenth aspect, luminance variations can be prevented by correcting the luminance.

According to an eleventh aspect of the present invention, in the seventh aspect, the liquid crystal display device further includes rearranging means for rearranging a transfer order of the input image signal so that time periods of retaining the non-image signal for each of the picture-element cells are equal at least for two frame periods, wherein the gate driver supplies a scanning signal corresponding to the rearrangement result by the rearranging means to the gate lines.

According to the above eleventh aspect, the average insertion time of the non-imagine signal in each scanning line is made evenly, thereby preventing luminance variations from being perceived.

According to a twelfth aspect of the present invention, in the seventh aspect, the liquid crystal display device further includes rearranging means for rearranging a transfer order of the input image signal so that a difference in time period of retaining the non-image signal becomes small between the picture-element cells adjacent to each other, wherein the gate driver supplies a scanning signal corresponding to the rearrangement result by the rearranging means to the gate lines.

According to the above twelfth aspect, discontinuity in retaining time of the non-image signal among the scanning lines can be resolved. Therefore, it is possible to prevent luminance variations from being perceived.

According to a thirteenth aspect of the present invention, in the seventh aspect, the time period of retaining the non-image signal for one frame is arbitrarily adjustable by a user.

According to the above thirteenth aspect, the retaining time of the non-image signal can be arbitrarily adjusted by the user. Therefore, image display according to user's preferences can be made.

A fourteenth aspect of the present invention is directed to a liquid crystal display device that displays an image by driving, based on an input image signal, a liquid crystal panel having a plurality of source lines supplied with a picture-element signal, a plurality of gate lines supplied with a scanning signal, and a plurality of picture-element cells arranged in matrix on intersections of the source lines and the gate lines, including: each of the picture-element cells including: a transistor connected to the source line and the gate line; a liquid crystal and a storage capacitor respectively connected to the transistor; a common electrode for applying a potential to the liquid crystal; and an other-end electrode for applying a potential to the storage capacitor from a side opposite to a side connected to the transistor, wherein the other-end electrode is given a potential for applying a predetermined voltage to the liquid crystal for a predetermined time period for one frame.

According to the above fourteenth aspect, the predetermined voltage can be applied to the liquid crystal without affecting writing of the input image signal. Therefore, image quality of the moving pictures can be improved without causing problems such as image deterioration due to insufficient recharging of the image signal or processing load on the circuits due to speed-up of the driving frequency.

According to a fifteenth aspect of the present invention, in the fourteenth aspect, the picture-element cells are OCB cells, and the predetermined voltage to be applied to the liquid crystal is a voltage that can prevent a back transition phenomenon of the OCB cells.

According to a sixteenth aspect of the present invention, in the fourteenth aspect, the liquid crystal display device further includes a driver for controlling the potential to be given to the other-end electrode.

According to the above sixteenth aspect, a desired potential can be freely applied to the other-end electrode.

According to a seventeenth aspect of the present invention, in the fourteenth aspect, the other-end electrode is connected to the gate line of another picture-element cell adjacent to the picture-element cell including the other-end electrode, and the other-end electrode is given the potential through the gate line.

According to the above seventeenth aspect, with manipulation of the potential given to the other gate line, it is possible to manipulate the potential given to the other-end electrode without providing a new wiring to the liquid crystal panel, thereby preventing reduction in aperture ratio.

According to an eighteenth aspect of the present invention, in the fourteenth aspect, a range of change in a potential from the source line to the picture-element cell is not less than one-fold and less than two-fold of a range of change required for changing a transmittance of the picture-element cell at maximum, and the other-end electrode is further given with a potential for changing a polarity of the voltage to be applied to the picture-element cell.

According to the above eighteenth aspect, it is possible to reduce cost of a circuit for driving the source line or cost of a driver IC.

A nineteenth aspect of the present invention is directed to a method of driving a liquid crystal display device that displays an image by driving, based on an input image signal, a liquid crystal panel having a plurality of source lines supplied with a picture-element signal, a plurality of gate lines supplied with a scanning signal, and a plurality of picture-element cells arranged in matrix on intersections of the source lines and the gate lines, the method including: a driver controlling step of generating a polarity control signal for controlling a polarity of a voltage to be applied to each of the picture-element cells, and controlling the source driver by the polarity control signal; a step of speeding up a transfer rate of the input image signal; a step of inserting a non-image signal for applying a predetermined voltage to the liquid-crystal cells in space of the input image signal speeded up in the transfer rate; a step of supplying the input image signal speeded up in the transfer rate and having the non-image signal inserted therein to the source line as a picture-element signal; and a step of supplying the scanning signal to the gate line, wherein the input image signal and the non-image signal of a positive or negative polarity are sequentially written in each of the picture-element cells, and for all of the picture elements, after an input image signal is written, anon-image signal equal in polarity to the input image signal is always written, and further, after the non-image signal is written, an input image signal opposite in polarity to the non-image signal is always written.

A twentieth aspect of the present invention is directed to a method of driving a liquid crystal display device that displays an image by driving, based on an input image signal, a liquid crystal panel having a plurality of source lines supplied with a picture-element signal, a plurality of gate lines supplied with a scanning signal, and a plurality of picture-element cells arranged in matrix on intersections of the source lines and the gate lines, the method including: a driver controlling step of generating a polarity control signal for controlling a polarity of a voltage to be applied to each of the picture-element cells, and controlling the source driver by the polarity control signal; a step of speeding up a transfer rate of the input image signal; a step of inserting a non-image signal for applying a predetermined voltage to the liquid-crystal cells in space of the input image signal speeded up in the transfer rate; a step of supplying the input image signal speeded up in the transfer rate and having the non-image signal inserted therein to the source line as a picture-element signal; and a step of supplying the scanning signal to the gate line, wherein the input image signal and the non-image signal of a positive or negative polarity are sequentially written in each of the picture-element cells, and for all of the picture element cells, after an input image signal is written, a non-image signal opposite in polarity to the input image signal is always written, and further, after the non-image signal is written, an input image signal equal in polarity to the non-image signal is always written.

According to the above nineteenth and twentieth aspects, an input image signal and a non-image signal are sequentially written in picture-element cells, thereby improving image quality of the moving pictures. Also, the polarity inversion can be balanced, thereby enabling image display evenly.

A twenty-first aspect of the present invention is directed to a method of driving a liquid crystal display device that displays an image by driving, based on an input image signal, a liquid crystal panel having a plurality of source lines supplied with a picture-element signal, a plurality of gate lines supplied with a scanning signal, and a plurality of picture-element cells arranged in matrix on intersections of the source lines and the gate lines, the method including: a source driver for supplying the picture-element signal to the source line; a gate driver for supplying the scanning signal to the gate line; a step of speeding up a transfer rate of the input image signal; a step of inserting a non-image signal for applying a predetermined voltage to the liquid-crystal cells in space of the input image signal; and a step of supplying the input image signal speeded up in transfer rate and having the non-image signal inserted therein to the source line as the picture-element signal, wherein the non-image signal is simultaneously written in two or more scanning lines that correspond to two or more of the gate lines.

According to the above twenty-first aspect, an input image signal and a non-image signal are sequentially written in the picture-element cells, thereby improving image quality of the moving pictures. Also, it is not required to convert the signal transfer rate to up to a doubled one. Therefore, writing of signals in the picture-element cells become easy.

A twenty-second aspect of the present invention is directed to a method of driving a liquid crystal display device that displays an image by driving, based on an input image signal, a liquid crystal panel having a plurality of source lines supplied with a picture-element signal, a plurality of gate lines supplied with a scanning signal, and a plurality of picture-element cells arranged in matrix on intersections of the source lines and the gate lines, each of the picture-element cells including: a transistor connected to the source line and the gate line; a liquid crystal and a storage capacitor respectively connected to the transistor; a common electrode for applying a potential to the liquid crystal; and an other-end electrode for applying a potential to the storage capacitor from a side opposite to a side connected to the transistor, wherein the method includes a step of giving the other-end electrode a potential for applying a predetermined voltage to the liquid crystal for a predetermined period for one frame.

According to the above twenty-second aspect, the predetermined voltage can be applied to the liquid crystal without affecting writing of the input image signal. Therefore, image quality of the moving pictures can be improved without causing problems such as image deterioration due to insufficient recharging of the image signal or processing load on the circuits due to speed-up of the driving frequency.

DETAILED DESCRIPTION OF THE INVENTION

With reference to the drawings, various embodiments of the present invention are described below.

First Embodiment

Figure 4:
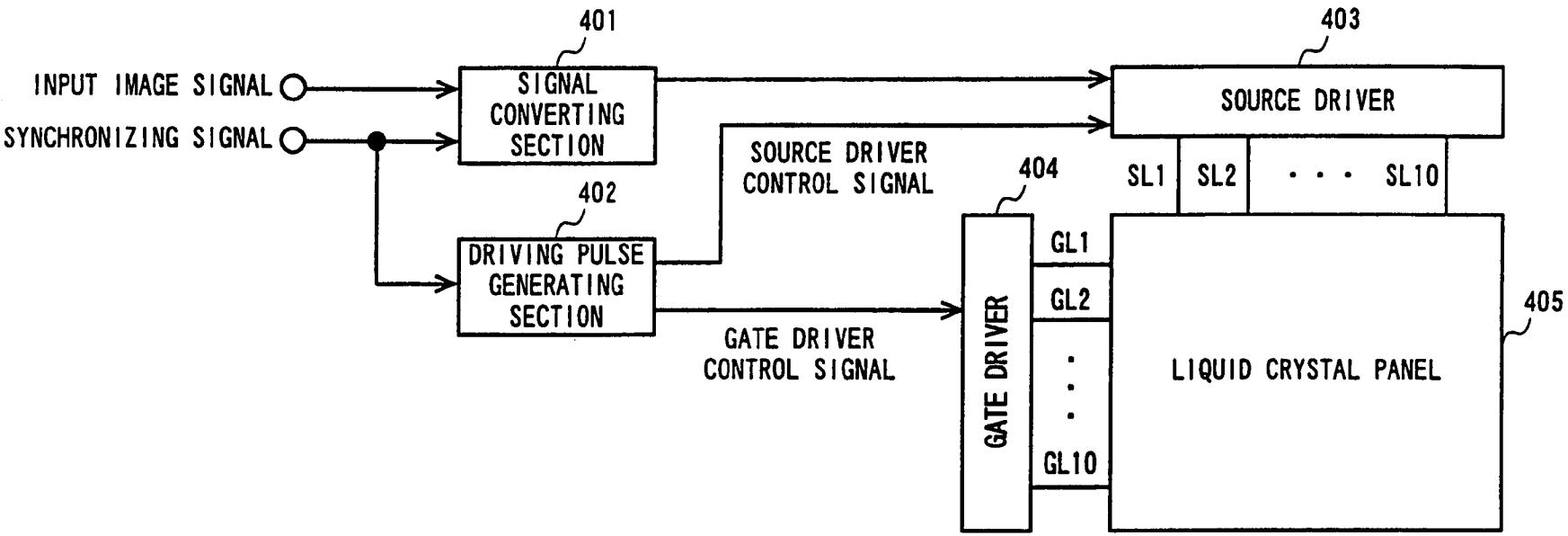
FIG. 4 is an illustration showing the construction of a liquid crystal device as a virtual example.
Figure 9:
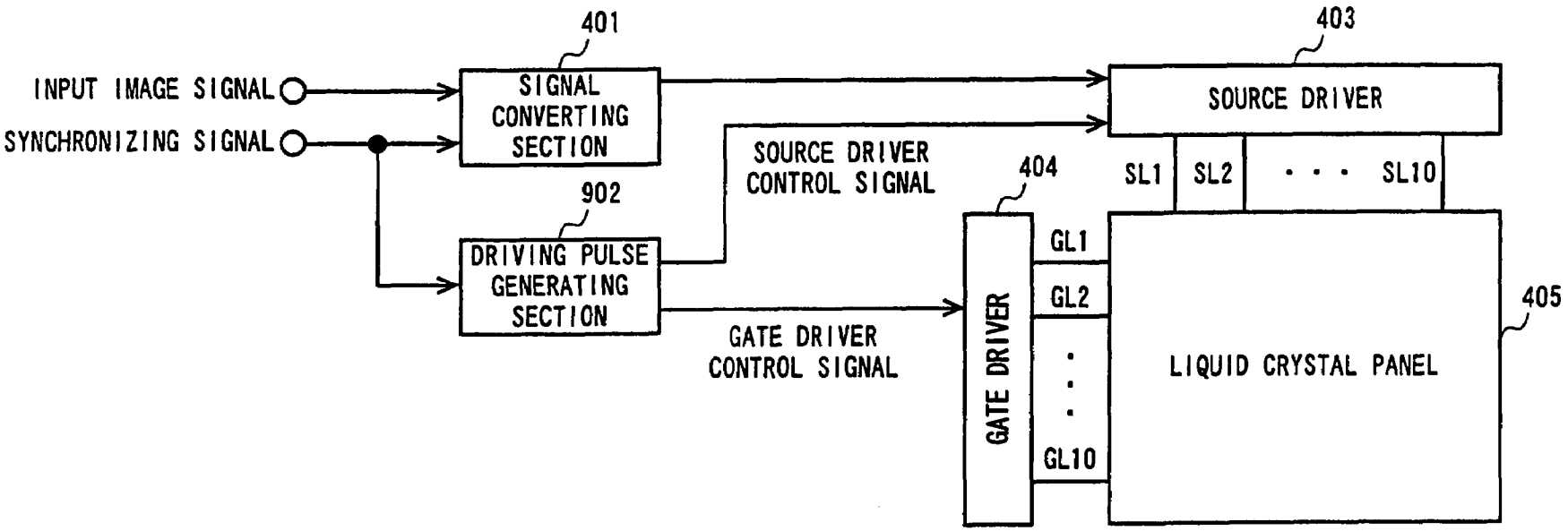
FIG. 9 is a block diagram illustrating the construction of a liquid crystal device according to a first embodiment of the present invention.

FIG. 9 is a block diagram showing the construction of a liquid crystal device according to a first embodiment of the present invention. In FIG. 9, the liquid crystal display device includes a signal converting unit 401, a driving pulse generating section 902, a source driver 403, a gate driver 404, and a liquid crystal panel 405. Note that the first embodiment is different from the virtual example illustrated in FIG. 4 only in the driving pulse generating section. In FIG. 9, the components equivalent to those illustrated in FIG. 4 are provided with the same reference numerals, and are not described herein. The driving pulse generating section 902 generates pulses for driving the respective drivers 403 and 404. To facilitate understanding of the description, assume for convenience sake that the number of source lines of the liquid crystal panel 405 is ten (SL1 to SL10), the number of gate lines is ten (GL1 to GL10), and one frame period is composed of ten horizontal periods.

Described next is an operation of anti-back transition to be carried out by the liquid crystal device according to the first embodiment. An input image signal is doubled in speed line by line in the signal converting section 401, and is then supplied to the source driver 403.

Figure 5:
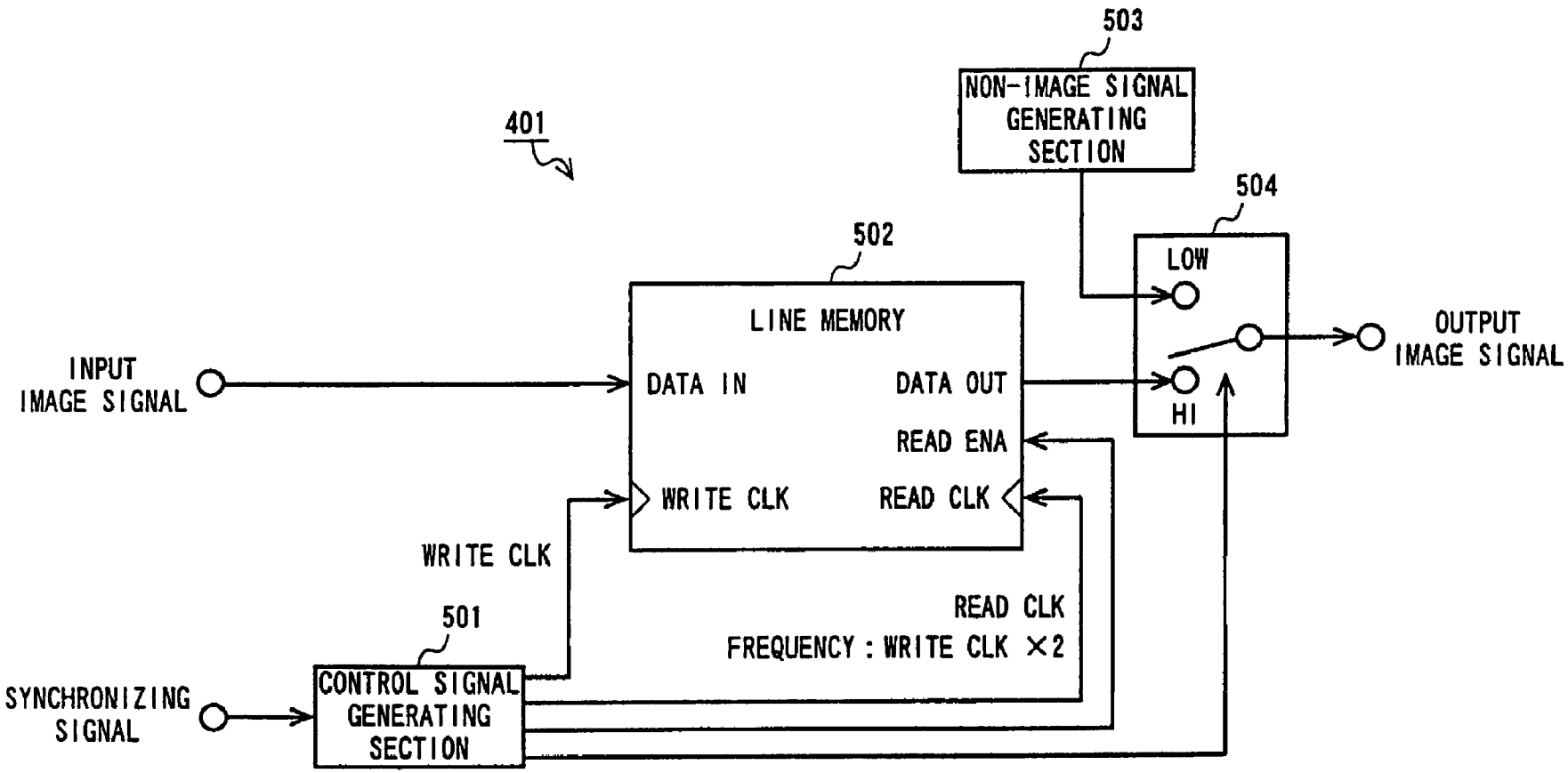
FIG. 5 is an illustration showing a specific construction of a signal converting section 401.
Figure 6:
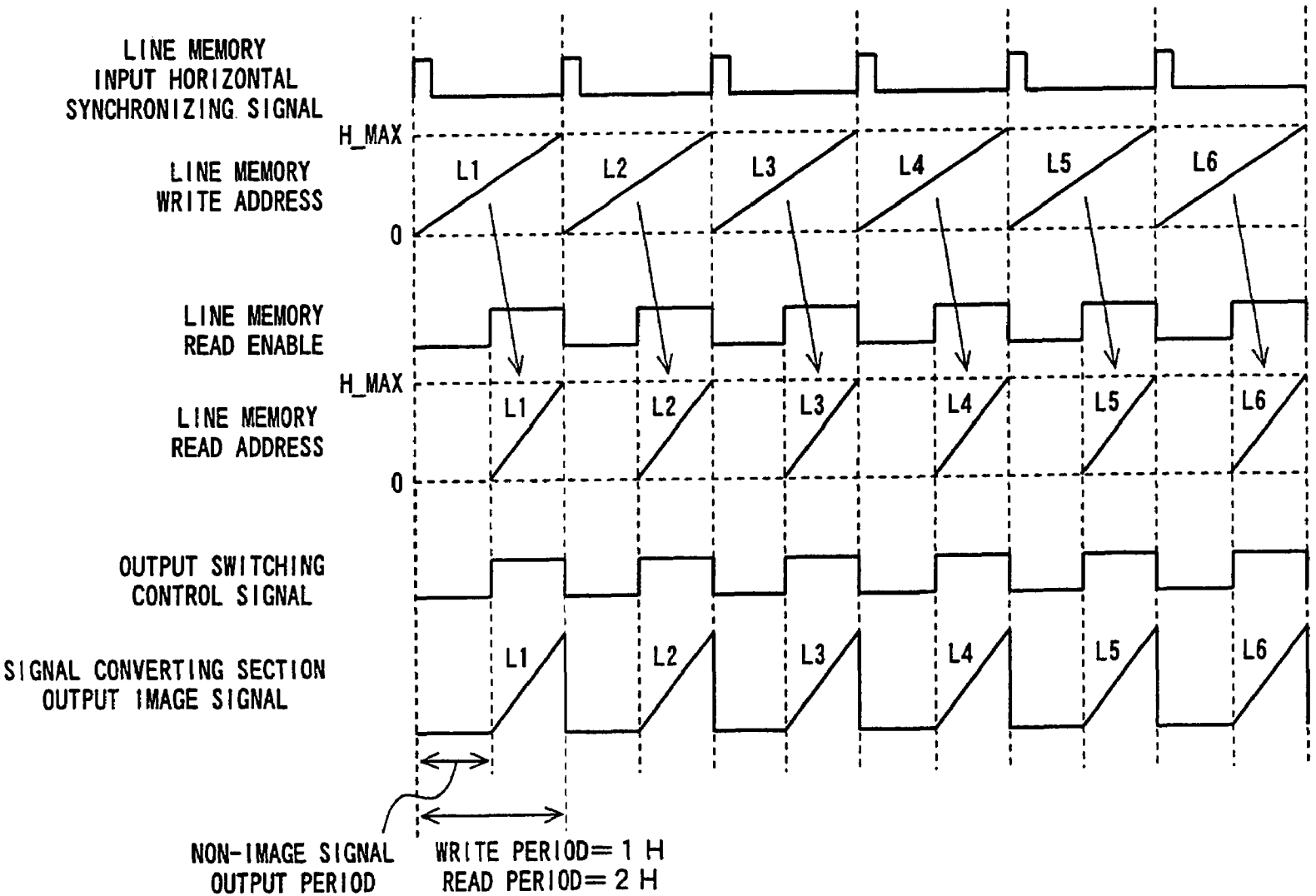
FIG. 6 is an illustration showing timing of a converting operation of the signal converting section 401.
Figure 7:
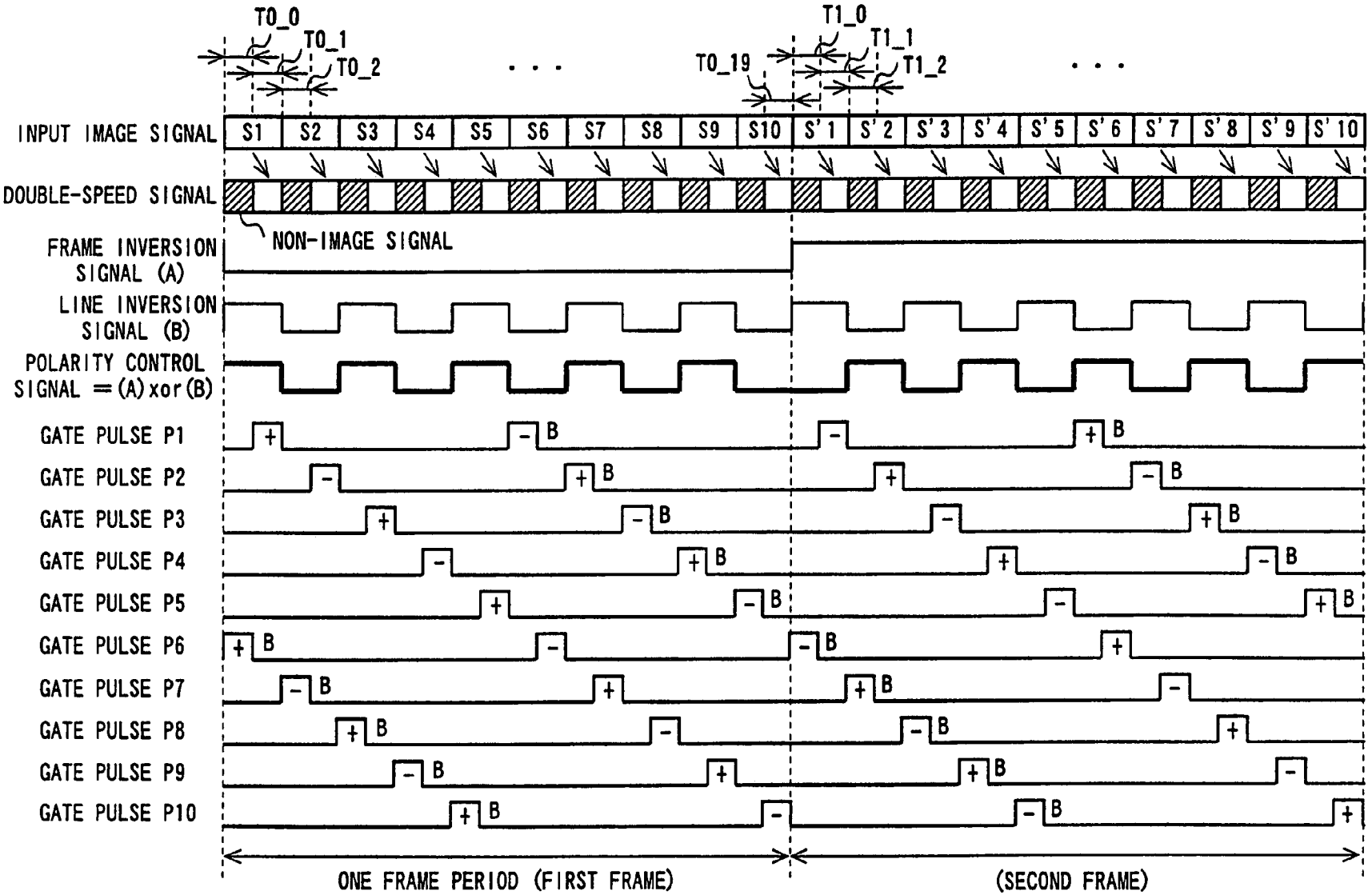
FIG. 7 is an illustration showing timing of an image signal and driver driving pulses when line-by-line inversion and frame-by-frame inversion are combined.

The specific construction of the signal converting section 401 and the timing of the converting operation have been described in the description of the virtual example with reference to FIG. 5 and FIG. 6, and are therefore not described herein. From the signal converting section 401, a non-image signal and an image signal that have been doubled in speed line by line are outputted in time sequence during one horizontal period of the input signal.

The source driver 403 alternately inverts the signal (double-speed signal) outputted from the signal converting section 401 for supply to the source lines (SL1 to SL10) of the liquid crystal panel 405.

Figure 10:
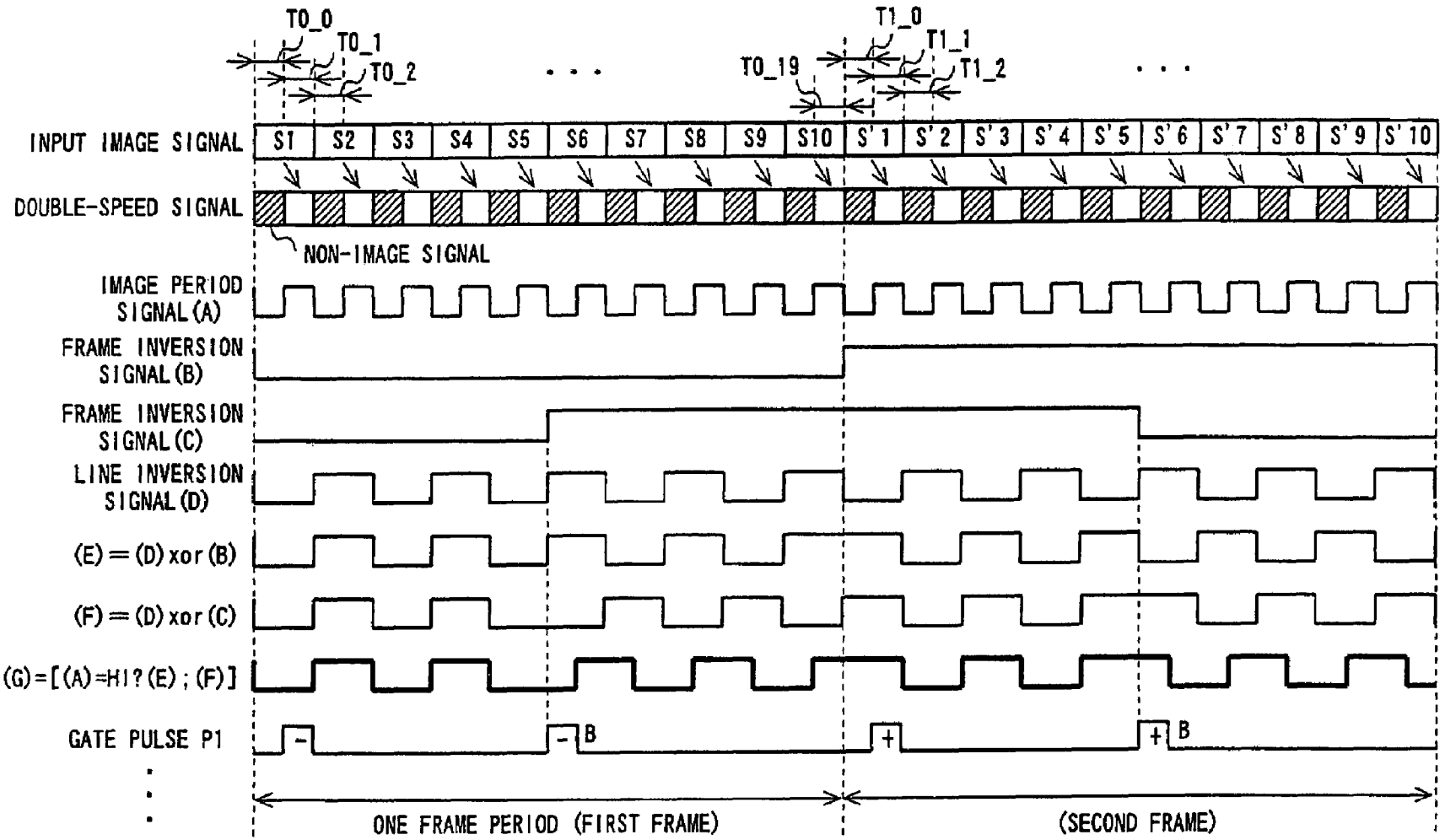
FIG. 10 is an illustration showing timing of an input image signal, a double-speed signal, and a polarity control signal.
Figure 11:
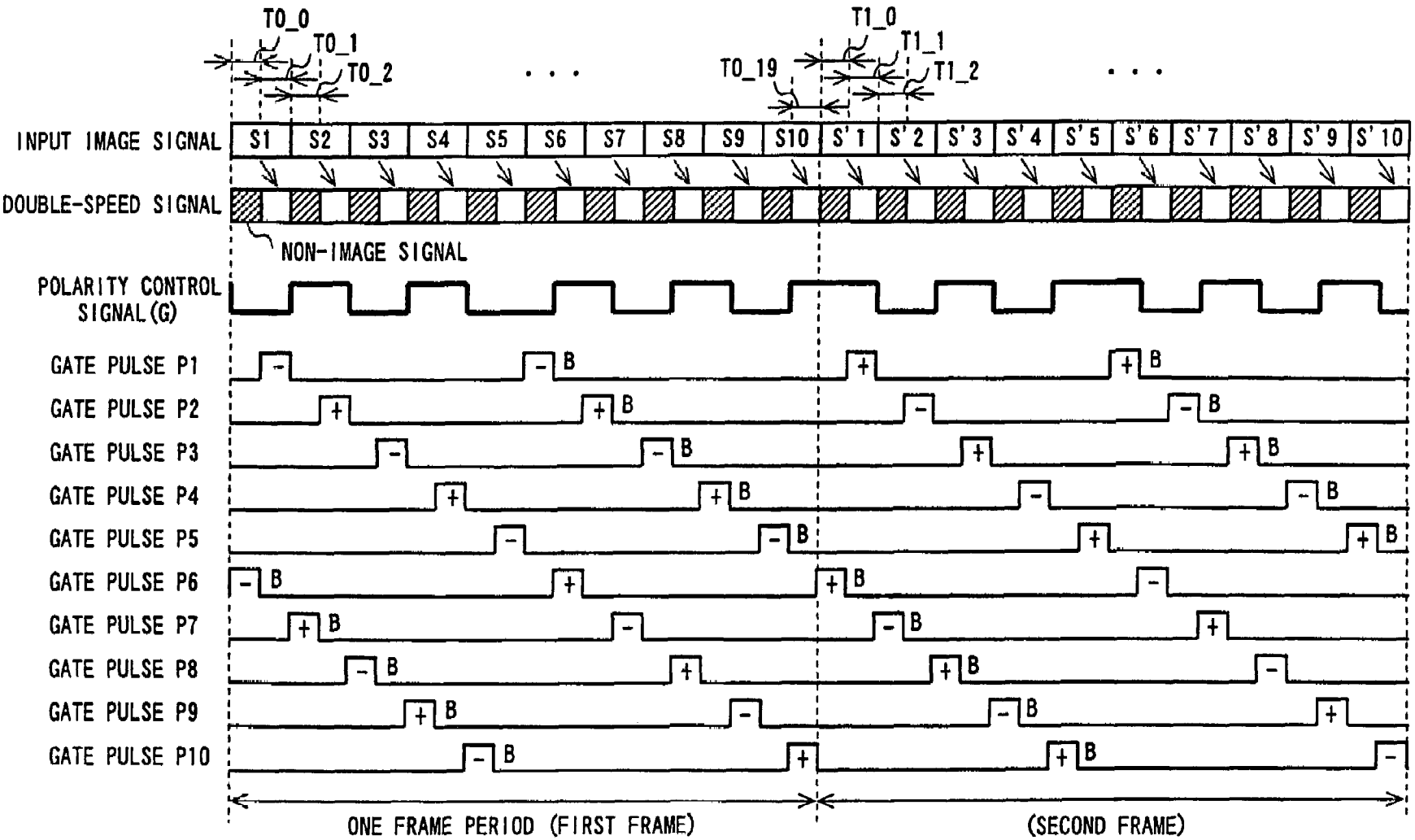
FIG. 11 is an illustration showing timing of gate driver driving pulses.

FIG. 10 and FIG. 11 are illustrations showing, as an example of alternate inversion, timing of a polarity control signal and timing of each driver driving pulse, respectively, when line-by-line inversion and frame-by-frame inversion are combined. The polarity control signal for switching alternate polarity is generated by the driving pulse generating section 902 in the following manner.

As illustrated in FIG. 10, the polarity control signal is generated based on, an image period signal (A) indicating HI during image signal periods (T0_1, T0_3, T0_5, . . . , T1_1, T1_3, . . . ), a frame inversion signal (B) synchronized with writing of an image signal, a frame inversion signal (C) synchronized with writing of a non-image signal, and a line-by-line inversion signal (D). First, a signal (E) obtained by XORing the signal (D) and the signal (B) and a signal (F) obtained by XORing the signal (D) and the signal (C) are generated. Further, such a signal (G) is generated as to become the signal (E) when the signal (A) is HI and become the signal (F) when the signal (A) is LOW. This signal (G) is a polarity control signal of a source signal.

Note that, in the present embodiment, the frame inversion signal (B) and the frame inversion signal (C) have such a phase relation as that the signal (C) trails earlier than the signal (B), as illustrated in FIG. 10.

Based on the polarity control signal (G) generated in the above manner, the source driver 403 supplies a positive voltage when the polarity control signal (G) is HI, and supplies a negative voltage when LOW. The input-output characteristic of the source driver 403 has been described with reference to FIG. 8. In FIG. 11, the polarity of the voltage supplied by the source driver 403 is represented as "+" or "−" in each gate-selected period.

In FIG. 11, gate pulses P1 through P10 are pulses for selecting ten gate lines (GL1 through GL10), respectively, on the liquid crystal panel 405 during their HI periods. The gate pulses P1 through P10 are driven in the following manner in accordance with timing of the double-speed signal inputted to the source driver 403.

During the period T0_1 illustrated in FIG. 11, the gate pulse P1 becomes HI, and a negative image signal S1 is written in picture elements on the gate line GL1. During the following period T0_2, the gate pulse P7 becomes HI, and a positive non-image signal is written in picture elements on the gate line GL7. During the period T0_3, the gate pulse P2 becomes HI, and a positive image signal S2 is written in picture elements on the gate line GL2. During the following period T0_4, the gate pulse P8 becomes HI, a negative non-image signal is written in picture elements on the gate line GL8. Thereafter, depending on the polarity of the polarity control signal (G), signals are sequentially written. Furthermore, during the period T0_10, the gate pulse P1 becomes HI again, and a negative non-image signal is written in the picture elements on the gate line GL1.

In this way, each of the gate lines (GL1 through GL10) on the liquid crystal panel 405 is selected twice during one frame period. In the picture elements on each gate line, an image signal and a non-image signal are written once.

During the period T1_1 of a second frame coming next, the gate pulse P1 becomes HI, and a positive image signal S'1, which is opposite in polarity of the signal in the first frame, is written in the picture elements on the game line GL1. During the following period T1_2, the gate pulse P7 becomes HI, and a negative non-image signal, which is opposite in polarity to the signal in the first signal, is written in the picture elements on the gate line GL7. Thereafter, similarly, signals opposite in polarity to those in the first frame are sequentially written.

With the above-described operation, it is possible to write image signals as well as to periodically write non-image signals. By giving voltages of the non-image signals as appropriate, back transition can be prevented.

Moreover, for all picture elements, after an image signal is written, a non-image signal (B) equal in polarity to the image signal is always written. Furthermore, after the non-image signal (B) is written, the image signal opposite in polarity to the non-image signal is always written. Therefore, the degree of writing of image signals in the respective picture elements is made even, thereby enabling image display more evenly.

Note that, in the present embodiment, the basic driving scheme is so-called line inversion driving, in which the polarity of the signal is inverted line by line, but the present invention is not restricted thereto. For example, similar effects can be obtained even with so-called column inversion driving, in which signals written in picture elements adjacent to each other on a line are opposite.

Second Embodiment

Figure 12:
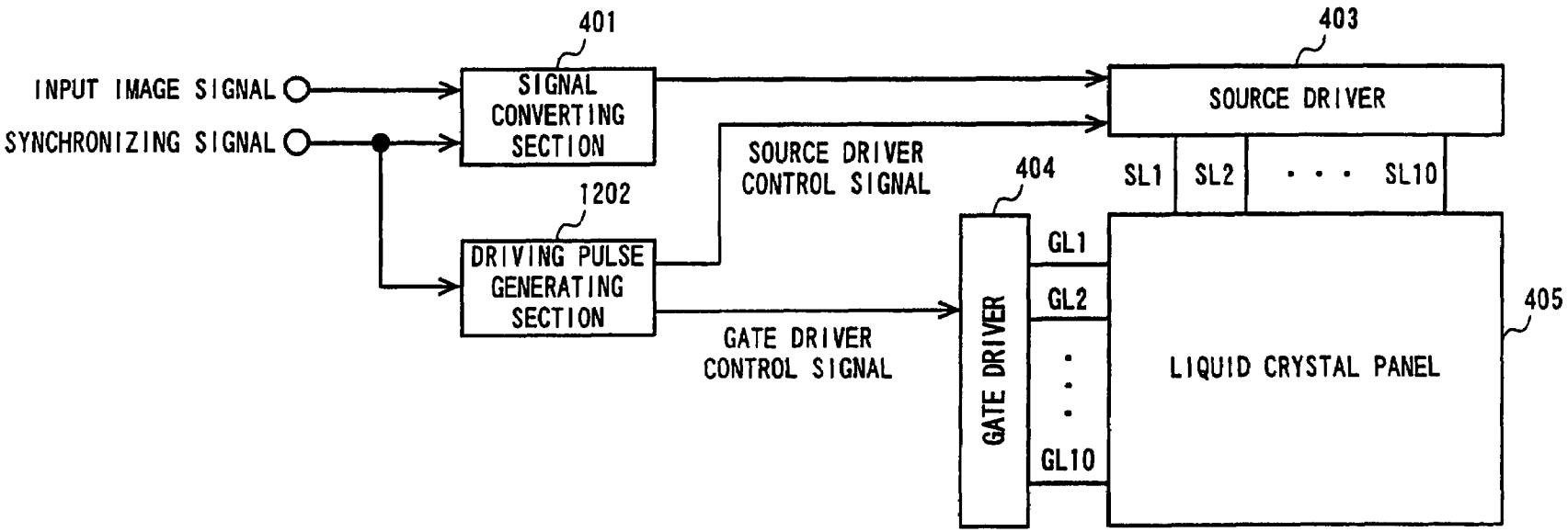
FIG. 12 is a block diagram illustrating the construction of a liquid crystal display device according to a second embodiment of the present invention.

FIG. 12 is a block diagram illustrating the construction of a liquid crystal display device according to a second embodiment of the present invention. In FIG. 12, the liquid crystal device includes a signal converting section 401, a driving pulse generating section 1202, a source driver 403, a gate driver 404, and a liquid crystal panel 405. Note that the second embodiment is different from the first embodiment illustrated in FIG. 9 only in the driving pulse generating section. In FIG. 12, the components equivalent to those illustrated in FIG. 9 are provided with the same reference numerals, and are not described herein. The driving pulse generating section 1202 generates pulses for driving the respective drivers 403 and 404. To facilitate understanding of the description, assume for convenient sake that the number of source lines of the liquid crystal panel 405 is ten (SL1 through SL10), the number of gate lines is ten (GL1 through GL10), and one frame period is composed of ten horizontal periods.

Described next is an operation of anti-back transition to be carried out by the liquid crystal display device according to the second embodiment. An input image signal is doubled in speed line by line in the signal converting section 401, and is then supplied to the source driver 403.

The specific construction of the signal converting section 401 and the timing of the converting operation have been described in the description of the virtual example with reference to FIG. 5 and FIG. 6, and are therefore not described herein. From the signal converting section 401, a non-image signal and an image signal that have been doubled in speed line by line are outputted in time sequence during one horizontal period of the input signal.

The source driver 403 alternately inverts the signal (double-speed signal) outputted from the signal converting section 401 for supply to the source lines (SL1 through SL10) of the liquid crystal panel 405.

Figure 13:
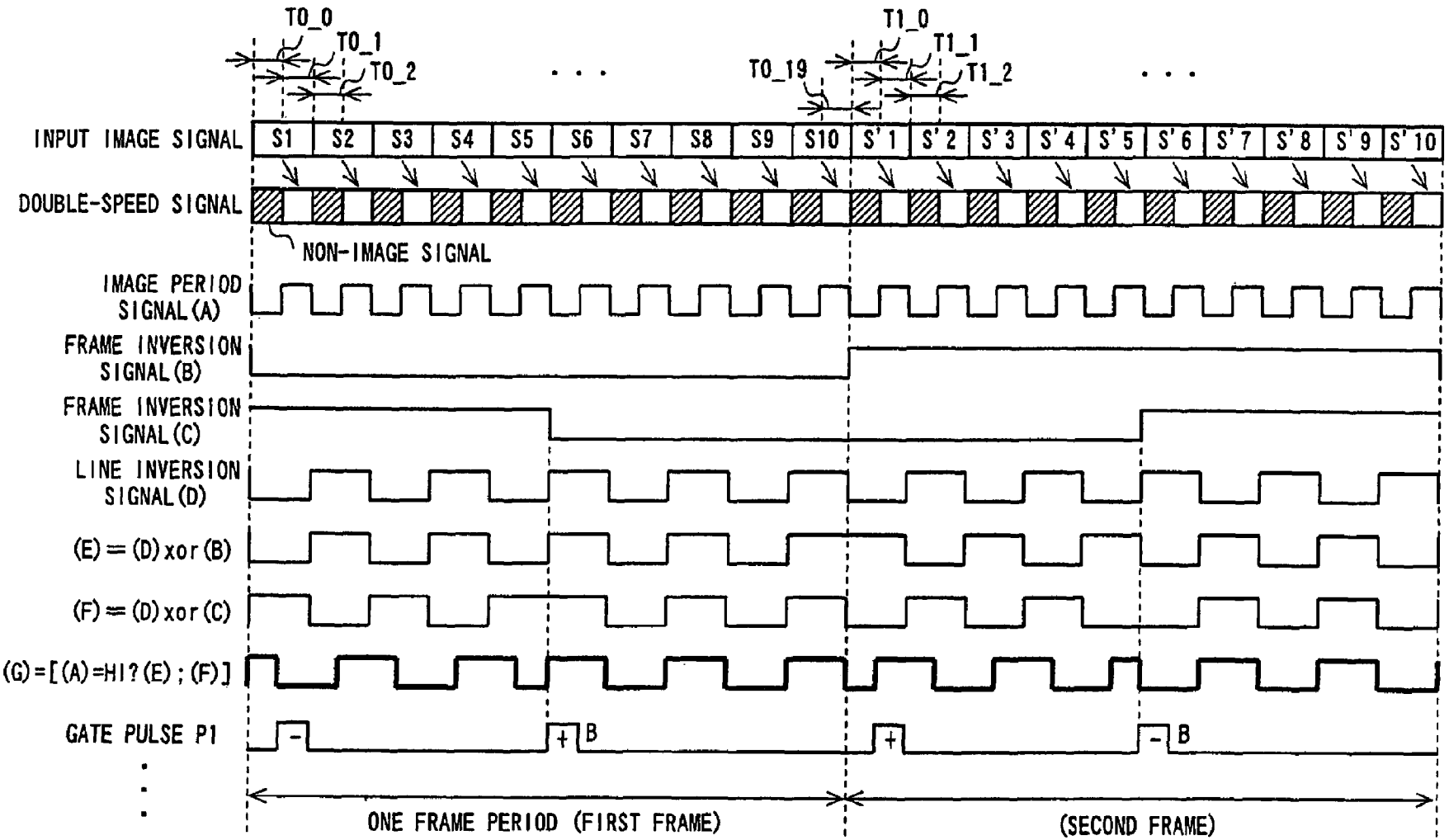
FIG. 13 is an illustration showing timing of an input image signal, a double-speed signal, and a polarity control signal.
Figure 14:
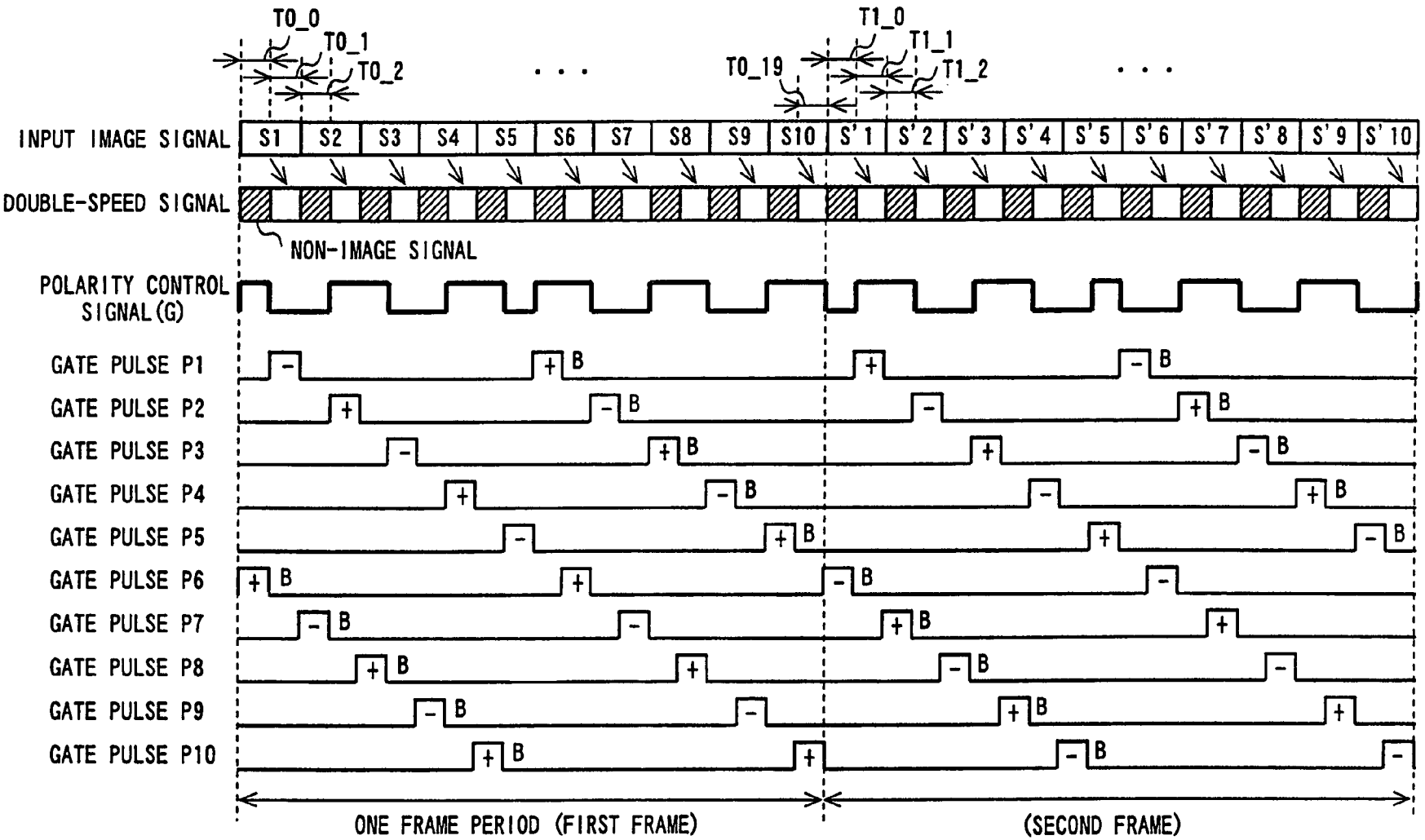
FIG. 14 is an illustration showing timing of gate driver driving pulses.

FIG. 13 and FIG. 14 are illustrations showing, as one example of alternate inversion, timing of a polarity control signal and timing of each driver driving pulse, respectively, when line-by-line inversion and frame-by-frame inversion are combined. The polarity control signal for switching the alternate polarity is generated by the driving pulse generating section 1202 in the following manner.

As illustrated in FIG. 13, the polarity control signal is generated based on an image period signal (A) indicating HI during image signal periods (T0_1, T0_3, T0_5, . . . , T1_1, T1_3, . . . ), a frame inversion signal (B) synchronized with writing of an image signal, a frame inversion signal (C) synchronized with writing of a non-image signal, and a line-by-line inversion signal (D). First, a signal (E) obtained by XORing the signal (D) and the signal (B) and a signal (F) obtained by XORing the signal (D) and the signal (C) are generated. Further, such a signal (G) is generated as to become the signal (E) when the signal (A) is HI and become the signal (F) when the signal (A) is LOW. This signal (G) is a polarity control signal of a source signal.

Note that, in the present embodiment, the frame inversion signal (B) and the frame inversion signal (C) have such a phase relation as that the signal (C) trails earlier than the signal (B), as illustrated in FIG. 13.

Based on the polarity control signal (G) generated in the above manner, the source driver 403 supplies a positive voltage when the polarity control signal (G) is HI, and supplies a negative voltage when LOW. The input-output characteristic of the source driver 403 has been described with reference to FIG. 8. In FIG. 14, the polarity of the voltage supplied by the source driver 403 is represented as "+" or "−" in each gate-selected period.

In FIG. 14, gate pulses P1 through P10 are pulses for selecting ten gate lines (GL1 through GL10), respectively, on the liquid crystal panel 405 during their HI periods. The gate pulses P1 through P10 are driven in the following manner in accordance with timing of the double-speed signal inputted to the source driver 403.

During the period T0_1 illustrated in FIG. 14, the gate pulse P1 becomes HI, and a negative image signal S1 is written in picture elements on the gate line GL1. During the following period T0_2, the gate pulse P7 becomes HI, and a negative non-image signal is written in picture elements on the gate line GL7. During the period T0_3, the gate pulse P2 becomes HI, and a positive image signal S2 is written in picture elements on the gate line GL2. During the following period T0_4, the gate pulse P8 becomes HI, a negative non-image signal is written in picture elements on the gate line GL8. Thereafter, depending on the polarity of the polarity control signal (G), signals are sequentially written. Furthermore, during the period T0_10, the gate pulse P1 becomes HI again, and a positive non-image signal is written in the picture elements on the gate line GL1.

In this way, each of the gate lines (GL1 through GL10) on the liquid crystal panel 405 is selected twice during the one frame period. In the picture elements on each gate line, an image signal and a non-image signal are written once.

During the period T1_1 of a second frame coming next, the gate pulse P1 becomes HI, and a positive image signal S'1, which is opposite in polarity of the signal in the first frame, is written in the picture elements on the game line GL1. During the following period T1_2, the gate pulse P7 becomes HI, and a positive non-image signal, which is opposite in polarity to the signal in the first signal, is written in the picture elements on the gate line GL7, Thereafter, similarly, signals opposite in polarity to those in the first frame are sequentially written.

With the above-described operation, it is possible to write image signals as well as to periodically write non-image signals. By giving voltages of the non-image signals as appropriate, back transition can be prevented.

Moreover, for all picture elements, after an image signal is written, a non-image signal (B) opposite in polarity to the image signal is always written. Furthermore, after the non-image signal (B) is written, the image signal equal in polarity to the non-image signal is always written. Therefore, the degree of writing of image signals in the respective picture elements is made even, thereby enabling image display more evenly.

Also, prior to writing of an image signal, a signal (non-image signal) equal in polarity to the image signal is always written. This makes writing of the image signal easy.

Note that, in the present embodiment, the basic driving scheme is so-called line inversion driving, in which the polarity of the signal is inverted line by line, but the present invention is not restricted thereto. For example, similar effects can be obtained even with so-called column inversion driving, in which signals written in picture elements adjacent to each other on a line are opposite.

Third Embodiment

In the above-described first embodiment, the driving frequency is double that of normal driving and, as a result, the time allocated for writing an image signal in each picture element is reduced by ½. Therefore, with upsizing and high-resolution of the liquid crystal panel, writing an image signal in each picture element may not be sufficiently carried out, in some cases.

In a third embodiment of the present invention, to solve the above problem, so-called pre-charge driving is introduced to the driving scheme of the first embodiment, where, immediately prior to writing an original image signal in a picture element, a non-image signal equal in polarity thereto is written.

Figure 15:
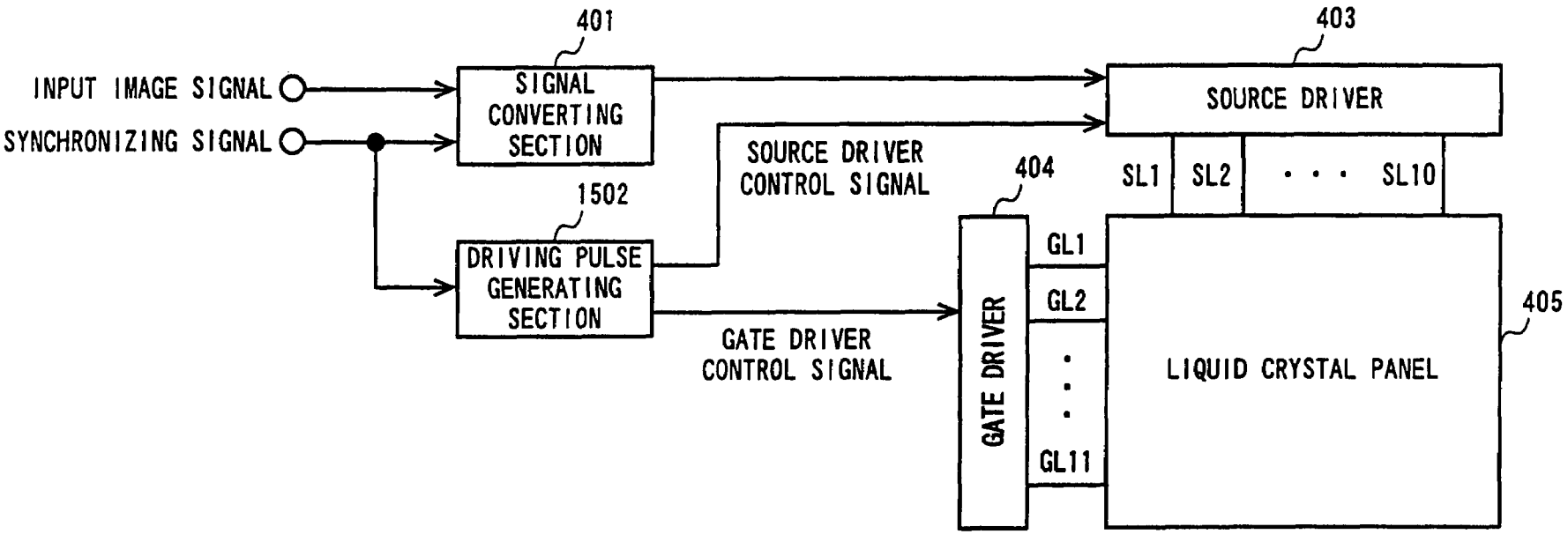
FIG. 15 is a block diagram illustrating the construction of a liquid crystal display device according to a third embodiment of the present invention.

FIG. 15 is a block diagram illustrating the construction of a liquid crystal device according to the third embodiment of the present invention. In FIG. 15, the liquid crystal device includes a signal converting section 401, a driving pulse generating section 1502, a source driver 403, a gate driver 404, a liquid crystal panel 405. Note that the third embodiment is different from the first embodiment illustrated in FIG. 9 only in the driving pulse generating section. In FIG. 15, the components equivalent to those illustrated in FIG. 9 are provided with the same reference numerals, and are not described herein. The driving pulse generating section 1502 generates pulses for driving the respective drivers 403 and 404. To facilitate understanding of the description, assume for convenience sake that the number of source lines of the liquid crystal panel 405 is ten (SL1 to SL10), the number of gate lines is eleven (GL1 to GL11), and one frame period is composed of eleven horizontal periods.

Described next is an operation of anti-back transition to be carried out by the liquid crystal device according to the third embodiment. An input image signal is doubled in speed line by line in the signal converting section 401, and is then supplied to the source driver 403.

The specific construction of the signal converting section 401 and the timing of the converting operation have been described in the description of the virtual example with reference to FIG. 5 and FIG. 6, and are therefore not described herein. From the signal converting section 401, a non-image signal and an image signal that have been doubled in speed by line are outputted in time sequence during one horizontal period of the input signal.

The source driver 403 alternately inverts the signal (double-speed signal) outputted from the signal converting section 401 for supply to the source lines (SL1 to SL10) of the liquid crystal panel 405.

Figure 16:
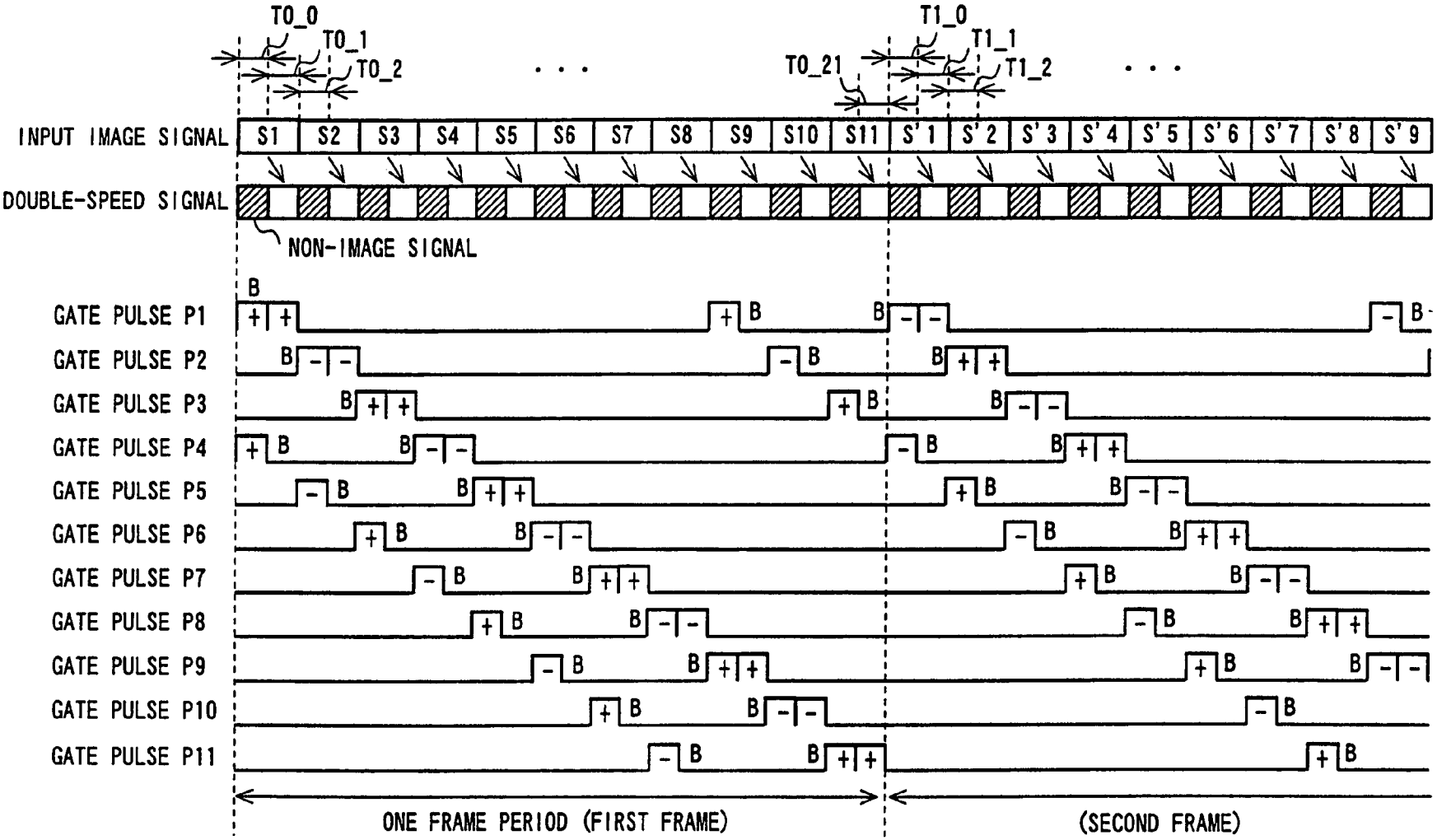
FIG. 16 is an illustration showing timing of an input image signal, a double-speed signal, and gate driver driving pulses.

FIG. 16 is an illustration showing, as an example of alternate inversion, timing of a polarity control signal and driver driving pulses when line-by-line inversion and frame-by-frame inversion are combined. The polarity control signal for switching the alternate polarity is generated by the driving pulse generating section 1502 in a manner equivalent to that in the first embodiment.

Based on the polarity control signal, the source driver 403 supplies a positive voltage when the polarity control signal is HI, and supplies a negative voltage when LOW. The input-output characteristic of the source driver 403 has been described with reference to FIG. 8. In FIG. 16, the polarity of the voltage supplied by the source driver 403 is represented as "+" or "−" in each gate-selected period.

In FIG. 16, gate pulses P1 through P11 are pulses for selecting eleven gate lines (GL1 through GL11), respectively, on the liquid crystal panel 405 during their HI periods. The gate pulses P1 through P11 are driven in the following manner in accordance with timing of the double-speed signal inputted to the source driver 403.

During the period T0_1 illustrated in FIG. 16, the gate pulse P1 becomes HI, and a positive image signal S1 is written in picture elements on the gate line GL1. During the following period T0_2, the gate pulses P2 and P5 become HI, and negative non-image signals are written in picture elements on the gate lines GL2 and GL5, respectively. During the period T0_3, the gate pulse P2 becomes HI, and a negative image signal S2 is written in the picture elements on the gate line GL2. During the following period T0_4, the gate pulses P3 and P6 become HI, and positive non-image signals are written in picture elements on the gate lines GL3 and GL6. Thereafter, signals are sequentially written as illustrated in FIG. 16.

In this way, each of the gate lines (GL1 through GL11) on the liquid crystal panel 405 is selected three times during one frame period. In the picture elements on each gate line, one image signal and two non-image signals are written.

During the period T1_1 of a second frame coming next, the gate pulse P1 becomes HI, and a negative image signal S'1, which is opposite in polarity of the signal in the first frame, is written in picture elements on the game line GL1. During the following period T1_2, the gate pulses P2 and P5 become HI, and negative non-image signals, which are opposite in polarity to those in the first signal, are written in the picture elements on the gate lines GL2 and GL5, respectively. Thereafter, similarly, signals opposite in polarity to those in the first frame are sequentially written.

As described above, according to the third embodiment, prior to writing of an image signal, a non-image signal equal in polarity to the image signal is preliminarily written, thereby making it possible to sufficiently charge the picture elements. Therefore, the problem of insufficient charge caused by a short writing time can be resolved, and more desirable display image quality can be obtained.

Figure 17:
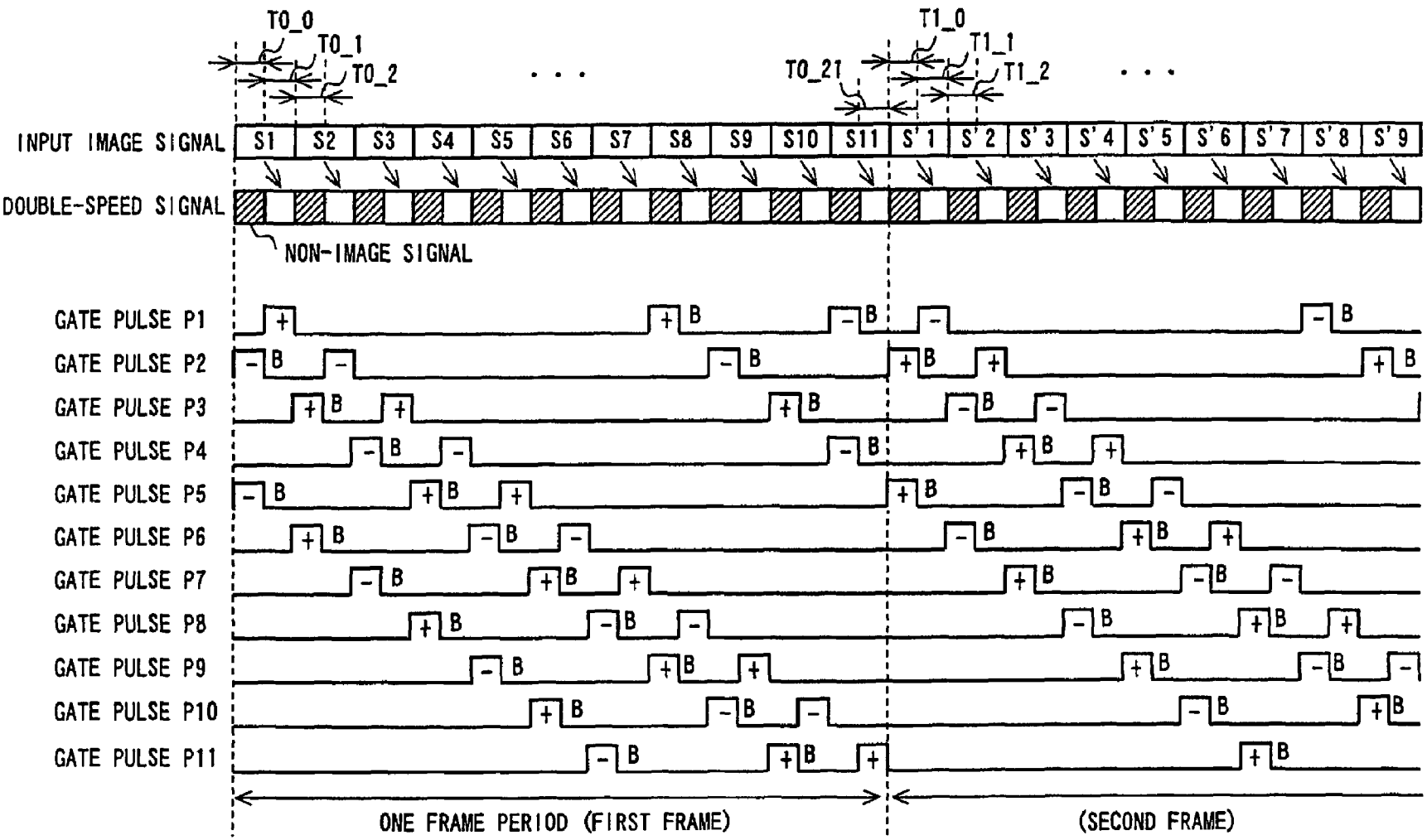
FIG. 17 is another illustration showing timing of the input image signal, the double-speed signal, and the gate driver driving pulses.

Note that, in the present embodiment, as illustrated in FIG. 16, the device is so constructed as that the non-image signal is written 7.5 horizontal periods after the time when the image signal is written. Therefore, a non-image signal to be written for pre-charge prior to writing of the image signal (hereinafter referred to as pre-charge signal) is written 0.5 horizontal period before the time when the image signal is written. However, as illustrated in FIG. 17, if the device is so constructed as that the non-image signal is written 6.5 horizontal periods after the time when the image signal is written, the pre-charge signal can be written 1.5 horizontal periods before the image signal. As such, the phase of the pre-charge signal is determined based on the relation in phase between the image signal and the non-image signal.

Note that, as illustrated in FIG. 16, when a period during which the pre-charge signal is selected and a period during which the image signal is selected are adjacent to each other, it is not required to insert a non-selected period between these selection periods. Therefore, influences of sluggish transmission of the gate pulses can be eliminated, which is more desirable.

Also, in the present embodiment, as illustrated in FIG. 16, it is desirable that one frame period be an odd multiple of one horizontal period. Therefore, it is more desirable that a rate changing section using a memory or the like be provided for changing a signal rate as appropriate so that one frame period is always an odd multiple of one horizontal period.

Note that, in the present embodiment, the basic driving scheme is so-called line inversion driving, in which the polarity of the signal is inverted line by line, but the present invention is not restricted thereto. For example, similar effects can be obtained even with so-called column inversion driving, in which signals written in picture elements adjacent to each other on a line are opposite.

Fourth Embodiment

In the above-described second embodiment, the driving frequency is double that of normal driving and, as a result, the time allocated for writing a non-image signal in each picture element is reduced to ½. Therefore, with upsizing and high-resolution of the liquid crystal panel, writing a non-image signal in each picture element may not be sufficiently carried out, in some cases.

In a fourth embodiment of the present invention, to solve the above problem, so-called dual-charge driving is introduced to the driving scheme of the second embodiment, where, immediately after writing a non-image signal in a picture element, a non-image signal equal in polarity thereto is written.

Figure 18:
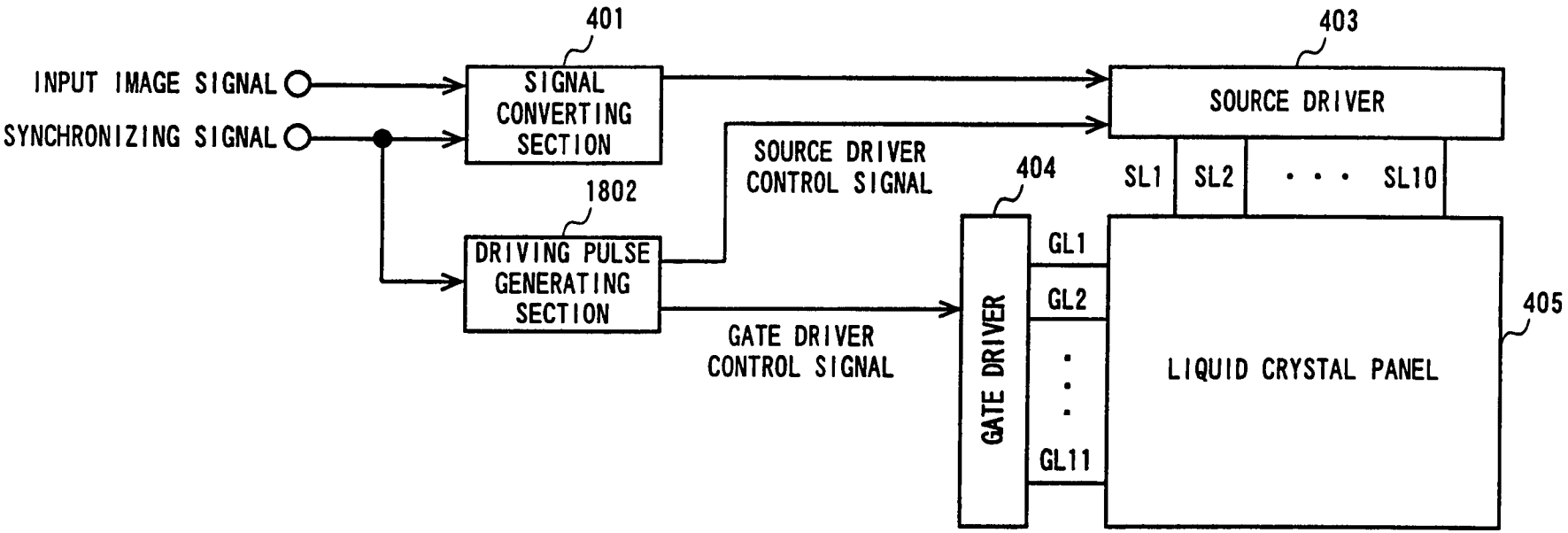
FIG. 18 is a block diagram showing the construction of a liquid crystal device according to a fourth embodiment of the present invention.

FIG. 18 is a block diagram illustrating the construction of a liquid crystal device according to the fourth embodiment of the present invention. In FIG. 18, the liquid crystal device includes a signal converting section 401, a driving pulse generating section 1802, a source driver 403, a gate driver 404, a liquid crystal panel 405. Note that the fourth embodiment is different from the second embodiment illustrated in FIG. 12 only in the driving pulse generating section. In FIG. 18, the components equivalent to those illustrated in FIG. 12 are provided with the same reference numerals, and are not described herein. The driving pulse generating section 1802 generates pulses for driving the respective drivers 403 and 404. To facilitate understanding of the description, assume for convenience sake that the number of source lines of the liquid crystal panel 405 is ten (SL1 to SL10), the number of gate lines is eleven (GL1 to GL11), and one frame period is composed of eleven horizontal periods.

Described next is an operation of anti-back transition to be carried out by the liquid crystal device according to the fourth embodiment. An input image signal is doubled in speed line by line in the signal converting section 401, and is then supplied to the source driver 403.

The specific construction of the signal converting section 401 and the timing of the converting operation have been described in the description of the virtual example with reference to FIG. 5 and FIG. 6, and are therefore not described herein. From the signal converting section 401, non-image signals and image signals that have been doubled in speed by each line are outputted in time sequence during one horizontal period of the input signal.

The source driver 403 alternately inverts the signal (double-speed signal) outputted from the signal converting section 401 for supply to the source lines (SL1 to SL10) of the liquid crystal panel 405.

Figure 19:
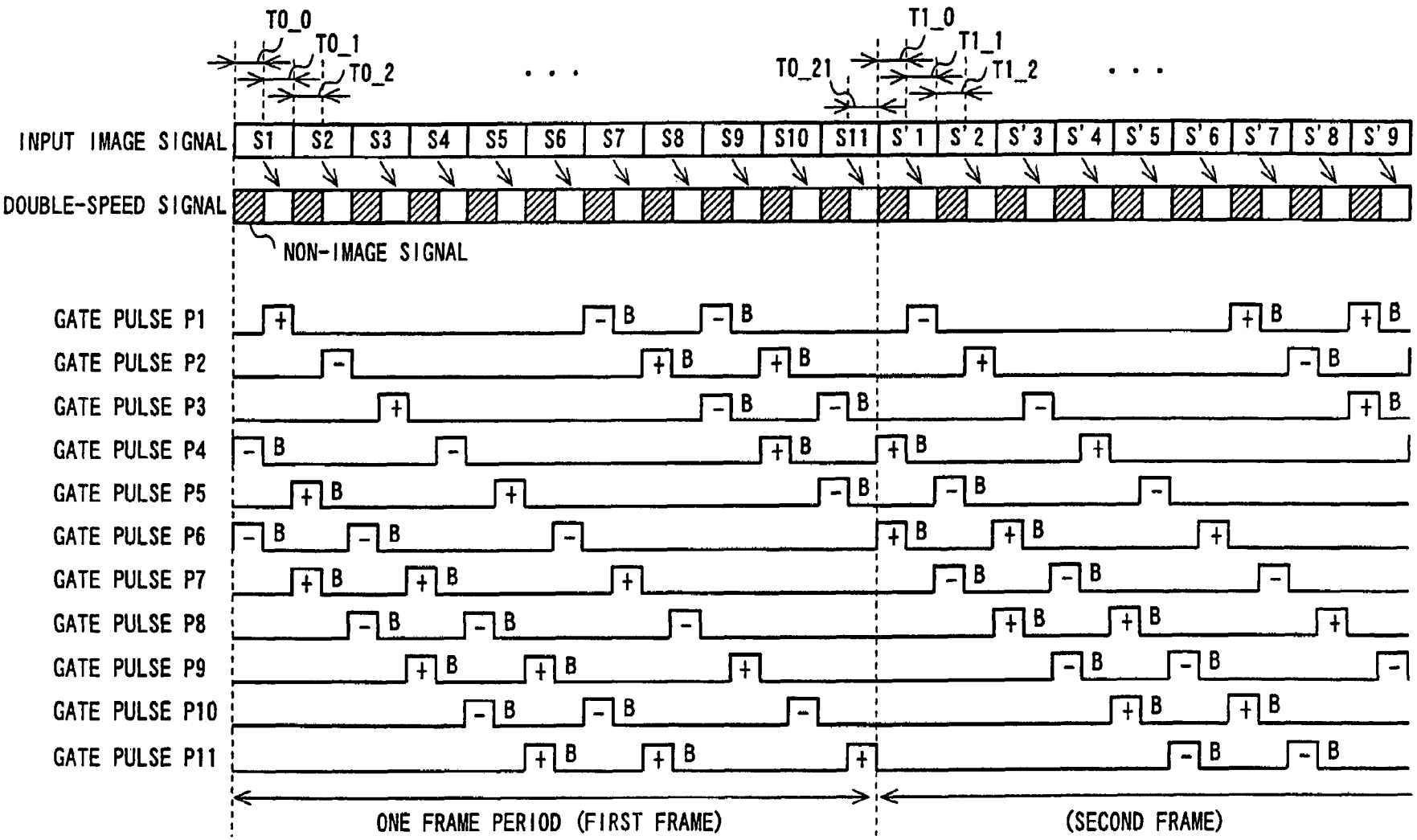
FIG. 19 is an illustration showing timing of an input image signal, a double-speed signal, and gate driver driving pulses.

FIG. 19 is an illustration showing, as an example of alternate inversion, timing of a polarity control signal and driver driving pulses when line-by-line inversion and frame-by-frame inversion are combined. The polarity control signal for switching the alternate polarity is generated by the driving pulse generating section 1802 in a manner equivalent to that in the second embodiment.

Based on the polarity control signal, the source driver 403 supplies a positive voltage when the polarity control signal is HI, and supplies a negative voltage when LOW. The input-output characteristic of the source driver 403 has been described with reference to FIG. 8. In FIG. 19, the polarity of the voltage supplied by the source driver 403 is represented as "+" or "−" in each gate-selected period.

In FIG. 19, gate pulses P1 through P11 are pulses for selecting eleven gate lines (GL1 through GL11), respectively, on the liquid crystal panel 405 during their HI periods. The gate pulses P1 through P11 are driven in accordance with timing of the double-speed signal inputted to the source driver 403 in the following manner.

During the period T0_1 illustrated in FIG. 19, the gate pulse P1 becomes HI, and a positive image signal S1 is written in picture elements on the gate line GL1. During the following period T0_2, the gate pulses P5 and P7 become HI, and positive non-image signals are written in picture elements on the gate lines GL7 and GL5. During the period T0_3, the gate pulse P2 becomes HI, and a negative image signal S2 is written in picture elements on the gate line GL2. During the following period T0_4, the gate pulses P6 and P8 become HI, and negative non-image signals are written in picture elements on the gate lines GL3 and GL6. Thereafter, signals are sequentially written as illustrated in FIG. 19.

In this way, each of the gate lines (GL1 through GL11) on the liquid crystal panel 405 is selected three times during one frame period. In the picture elements on each gate, one image signal and two non-image signals are written.

During the period T1_1 of a second frame coming next, the gate pulse P1 becomes HI, and a negative image signal S'1, which is opposite in polarity of the signal in the first frame, is written in the picture elements on the game line GL1. During the following period T1_2, the gate pulses P5 and P7 become HI, and negative non-image signals, which are opposite in polarity to those in the first frame, are written in the picture elements on the gate lines GL5 and GL7, respectively. Thereafter, similarly, signals opposite in polarity to those in the first frame are sequentially written.

As described above, according to the fourth embodiment, after writing of a non-image signal, another non-image signal equal in polarity to the non-image signal is posteriorly written, thereby making it possible to sufficiently charge the picture elements. Therefore, the problem of insufficient charge caused by a short writing time can be improved, and more desirable display image quality can be obtained.

Figure 20:
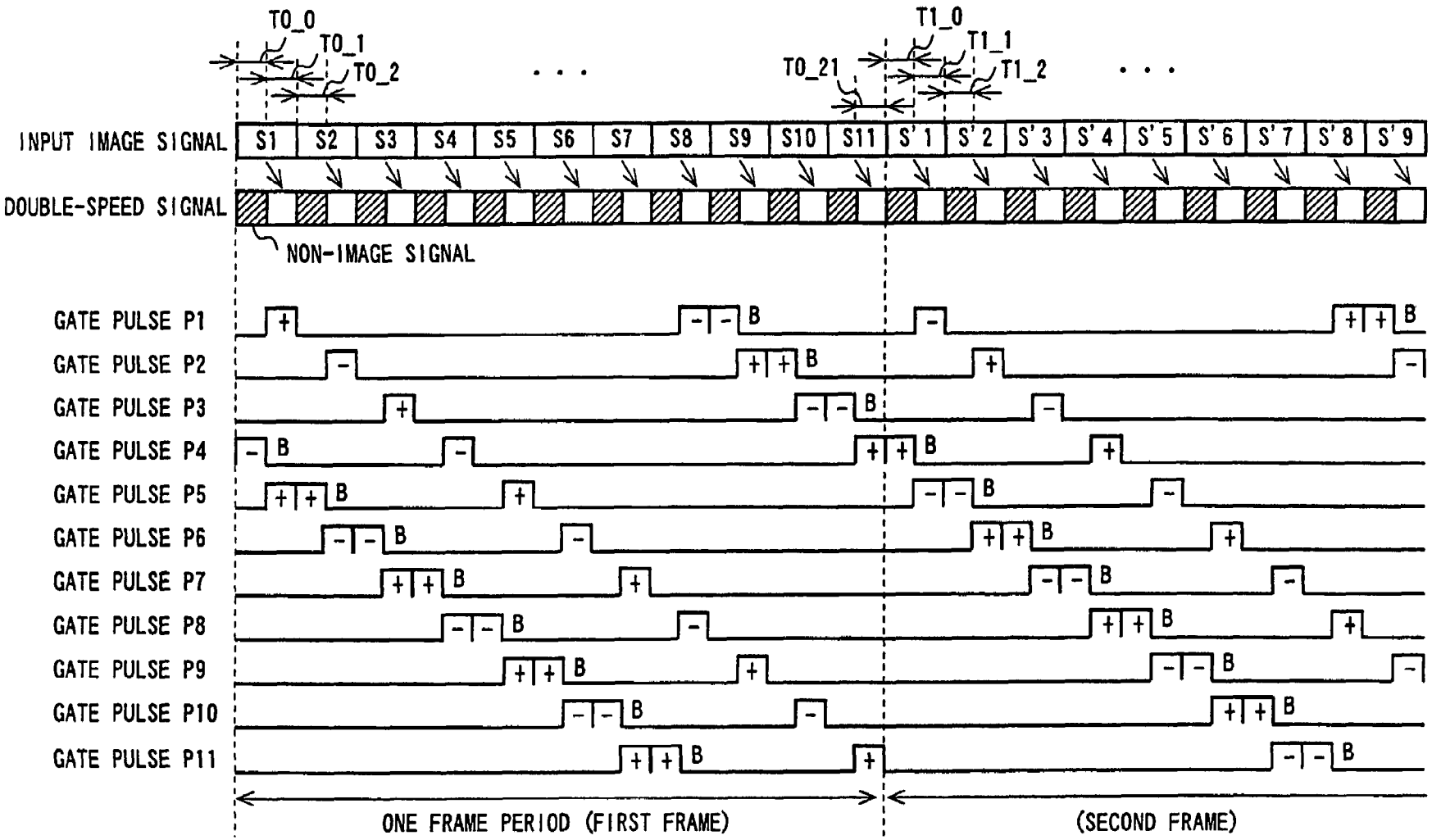
FIG. 20 is another illustration showing timing of the input image signal, the double-speed signal, and the gate driver driving pulses.

Note that, in the present embodiment, as illustrated in FIG. 19, described is a case where, after writing of a non-image signal, another non-image signal equal in polarity to the non-image signal is posteriorly written. However, as illustrated in FIG. 20, immediately prior to writing of a non-image signal, an image signal equal in polarity to the non-image signal may be used for pre-charging.

Also, in the present embodiment, as illustrated in FIG. 19, it is desirable that one frame period be an odd multiple of one horizontal period. Therefore, it is more desirable that a rate changing section using a memory or the like be provided for changing a signal rate as appropriate so that one frame period is always an odd multiple of one horizontal period.

Note that, in the present embodiment, the basic driving scheme is so-called line inversion driving, in which the polarity of the signal is inverted line by line, but the present invention is not restricted thereto. For example, similar effects can be obtained even with so-called column inversion driving, in which signals written in picture elements adjacent to each other on a line are opposite.

Fifth Embodiment

Figure 21:
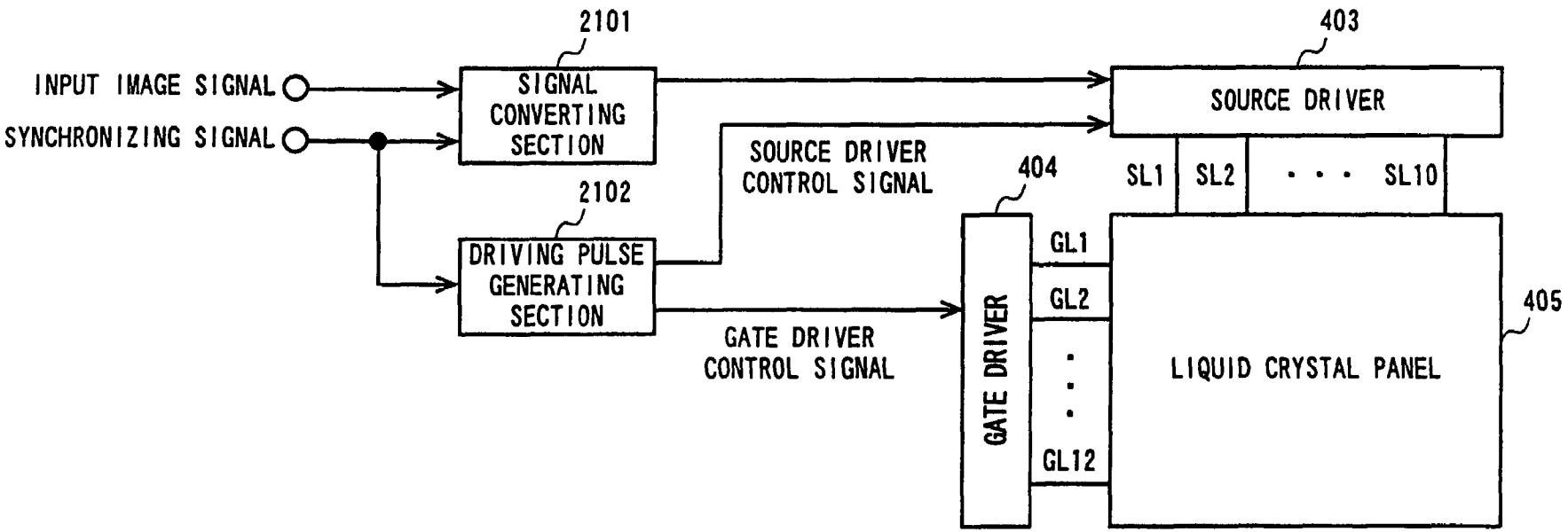
FIG. 21 is a block diagram showing the construction of a liquid crystal device according to a fifth embodiment of the present invention.

FIG. 21 is a block diagram illustrating the construction of a liquid crystal display device according to a fifth embodiment of the present invention. In FIG. 21, the liquid crystal device includes a signal converting section 2101, a driving pulse generating section 2102, a source driver 403, a gate driver 404, and a liquid crystal panel 405. Note that the fifth embodiment is different from the first embodiment illustrated in FIG. 9 only in the driving pulse generating section and the signal converting section. In FIG. 21, the components equivalent to those illustrated in FIG. 9 are provided with the same reference numerals, and are not described herein. The signal converting section 2101 converts an input image signal in a manner that will be described later. The driving pulse generating section 2102 generates pulses for driving the respective drivers 403 and 404. To facilitate understanding of the description, assume for convenience sake that the number of source lines of the liquid crystal panel 405 is ten (SL1 through SL10), the number of gate lines is twelve (GL1 through GL12), and one frame period is composed of twelve horizontal periods.

Described next is an operation of anti-back transition to be carried out by the liquid crystal display device according to the fifth embodiment. In the present embodiment, written in each picture element on the liquid crystal panel 405 are an image signal and a non-image signal irrespective of this image signal for suppressing a back transition phenomenon of the OCB liquid crystal, and these signals are written once every frame period. The signal converting section 2101 converts the driving frequency. In the present embodiment, as one example of frequency conversion, 1.25-times frequency conversion is shown where transfer is made for five lines (including one line of a non-image signal) to the source driver 403 during four horizontal periods of the input image signal. Hereinafter described is this 1.25-times frequency conversion.

Figure 22:
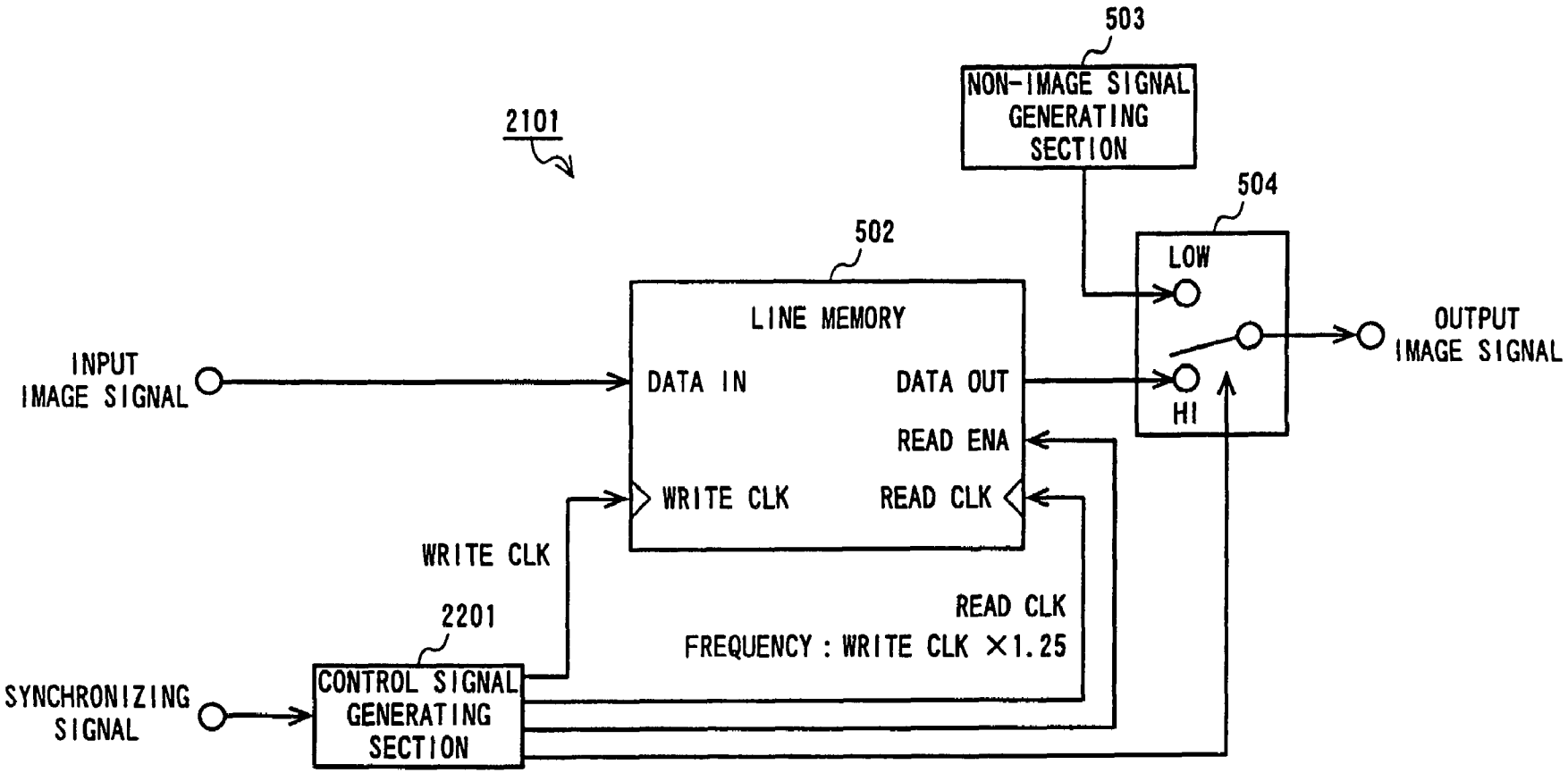
FIG. 22 is an illustration showing a specific construction of a signal converting section 2101.
Figure 23:
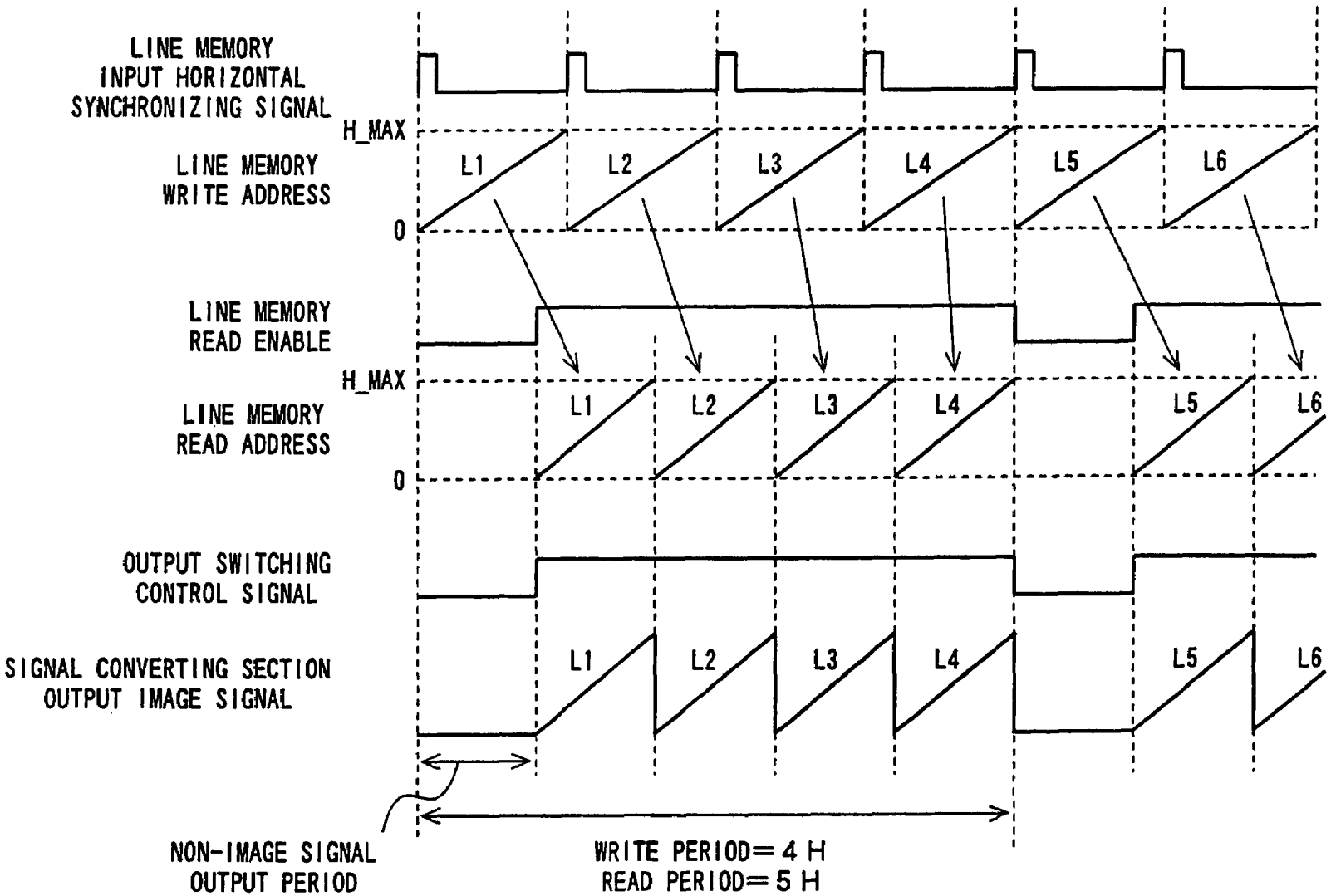
FIG. 23 is an illustration of timing of a converting operation of the signal converting section 2101.

FIG. 22 illustrates a specific construction of the signal converting section 2101. FIG. 23 illustrates timing of the converting operation. The control signal generating section 2201 generates various control signals, such as a clock, from a synchronizing signal synchronized with the input image signal. The input image signal is written in the line memory 502 in synchronization with a write clock from the control generating section 2201. The image signal written in the line memory 502 is read from the line memory 502 in synchronization with a read clock (having a frequency 1.25 times higher than that of the write clock) from the control signal generating section 2201, and this reading is carried out during a period four-fifth of that of writing. While the image signal is being read from the line memory 502, the output signal selecting section 504 selects this image signal as an output and, during the remaining period, selects a non-image signal outputted from a non-image signal generating section 503 as an output. Consequently, from the signal converting section 2101, as illustrated in FIG. 23, a non-image signal and a image signal both made 1.25 times faster in speed are outputted in time sequence at the ratio of 1:4.

Figure 8:
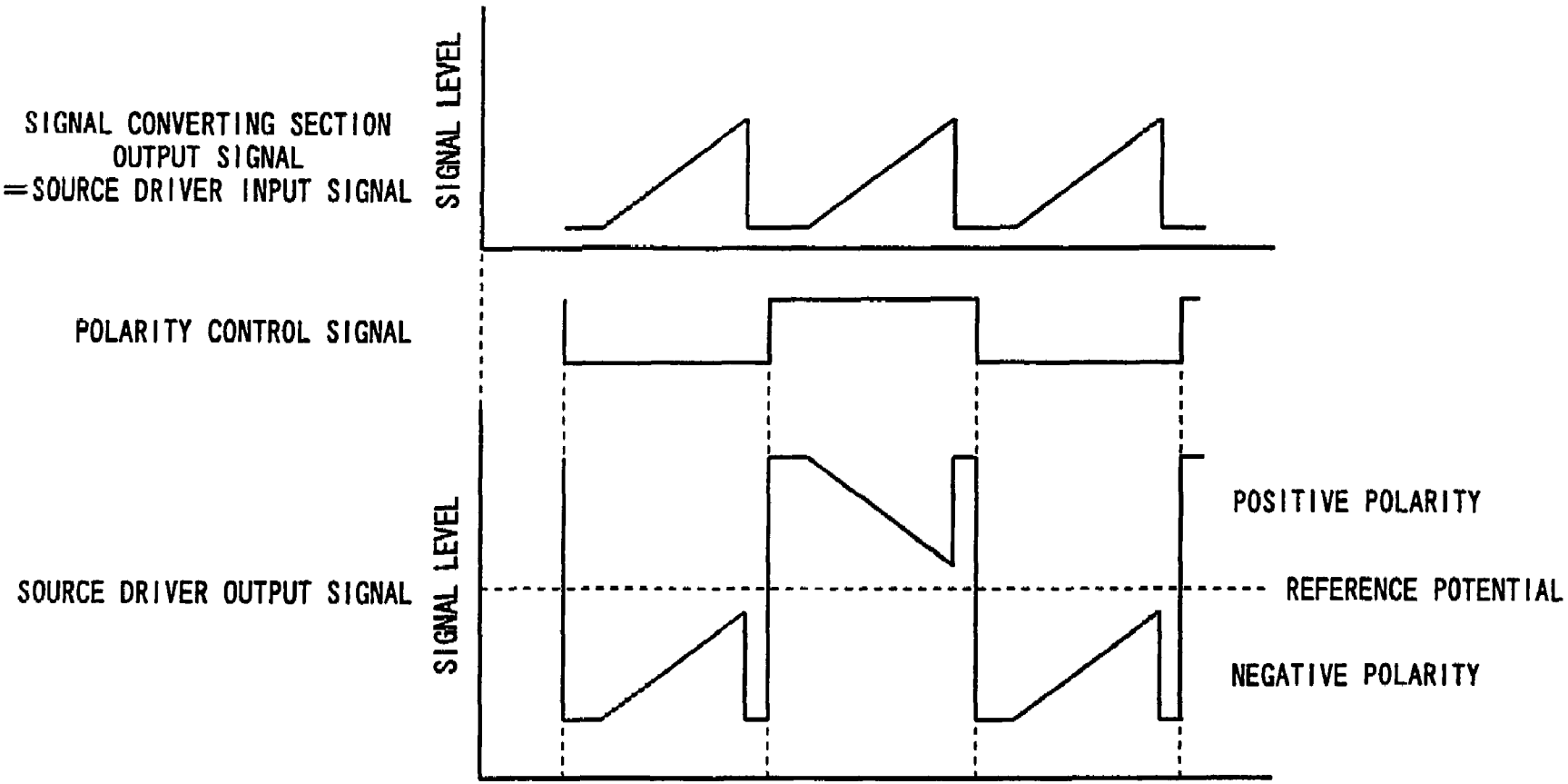
FIG. 8 is an illustration showing an input-output characteristic of a source driver 403.

The input/output characteristic of the source driver 403 has been described with reference to FIG. 8. The source driver 403 inverts the polarity of the signal outputted from the signal converting section 2101 by several lines for output.

Figure 24:
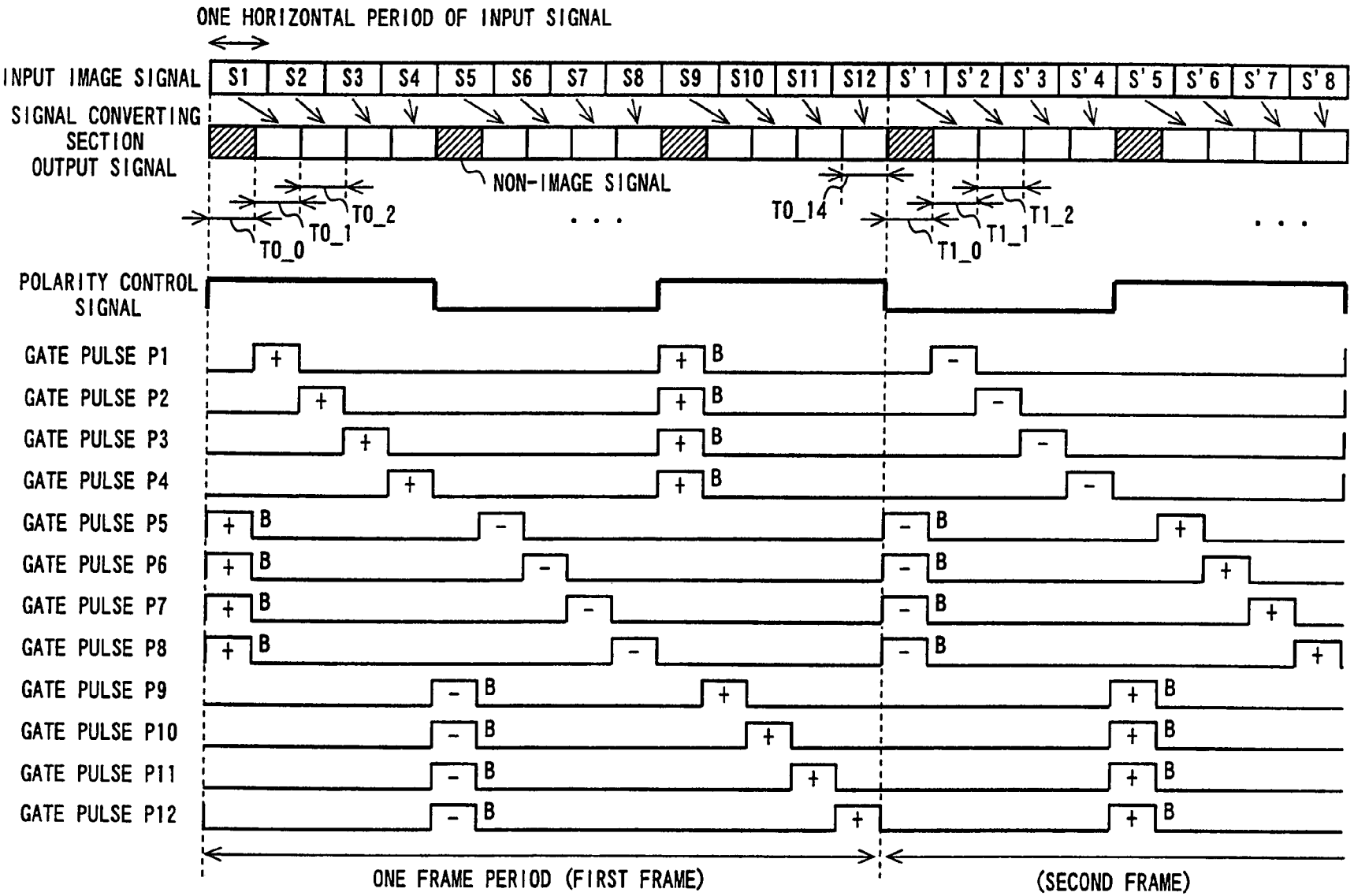
FIG. 24 is an illustration of timing an input image signal, an output signal from the signal converting section 2101, a polarity control signal, and gate driver driving pulses.

FIG. 24 is an illustration showing timing of the signal outputted from the signal converting section 2101, a polarity control signal, and gate driver driving pulses. In FIG. 24, the polarity of a voltage supplied by the source driver 403 is represented as "+" or "−" in each gate-selected period. This polarity is switched based on the polarity control signal generated in the driving pulse generating section 2102.

In FIG. 24, gate pulses P1 through P12 are pulses for selecting ten gate lines (GL1 through GL12), respectively, on the liquid crystal panel 405 during their HI periods. The gate pulses P1 through P12 are driven in the following manner in accordance with timing of the signal outputted from the signal converting section 2101 to the source driver 403.

During a period T0_0 illustrated in FIG. 24, the gate pulses P5 through P8 simultaneously become HI, and positive non-image signals are written in picture elements on the gate lines GL5 through GL8. During the following periods T0_1 through T0_4, the gate pulses P1 through P4 sequentially become HI, and positive image signals S1 through S4 are sequentially written on the gate line GL1 through GL4. During a period T0_5, the gate pulses P9 through P12 simultaneously become HI, and negative non-image signals are written on the gate lines GL9 through GL12. During the following periods T0_6 through T0_9, the gate pulses P5 through P8 sequentially become HI, and negative image signals S5 through S8 are sequentially written on the gate lines GL5 through GL8. Here, the picture elements on the gate lines GL5 through GL8 retain the non-image signal during the periods T0_0 through T0_5, the periods T0_0 through T0_6, the periods T0_0 through T0_7, the periods T0_0 through T0_8, respectively.

In this way, each of the gate lines (GL1 through GL12) on the liquid crystal panel 405 is selected twice during one frame period. In the picture elements on each of the gate lines, an image signal and a non-image signal is written once.

During a period T1_0 of a second frame coming next, the gate pulses P5 through P8 simultaneously become HI, and negative non-image signals, which are opposite in polarity of those in the first frame, are written on the gate lines GL5 through GL8. Similarly, during the following periods T1_1 through T1_4, the gate pulses Pi through P4 sequentially become HI, and negative image signals S'1 through S'4, which are opposite in polarity of those in the first frame, are sequentially written on the gate lines GL1 through GL4.

With the above-described operation, it is possible to write image signals as well as to periodically write non-image signals. By giving voltages of the non-image signals as appropriate, back transition can be prevented.

Furthermore, for all picture elements, after an image signal is written, a non-image signal opposite in polarity to the image signal is always written (that is, writing of a non-image signal becomes easy) and, still further, after the non-image signal is written, an image signal opposite in polarity to the non-image signal is always written (that is, writing of an image signal becomes disadvantageous). Therefore, the degree of writing of image signals in the respective picture elements is made even, thereby enabling image display more evenly.

Also, non-image signals are simultaneously written in a plurality of gate lines. Therefore, as illustrated in FIG. 23, a period allocated for recharging the picture elements becomes longer than that in the above-described virtual example and the first to fourth embodiments. Consequently, it is possible to solve the problem of insufficient recharging caused by writing of the non-image signal, thereby suppressing image deterioration. It is also possible to prevent the transfer rate to the source driver 403 from becoming high-speed, thereby reducing loads on circuits. Note that, as far as solving the problems of insufficient recharging and circuit loads is concerted, consideration is not necessarily given to a balance in polarity changes.

Note that, in the present embodiment, the basic driving scheme is so-called line inversion driving, in which the polarity of the signal is inverted by several lines, but the present invention is not restricted thereto. For example, similar effects can be obtained even with so-called column inversion driving, in which signals written in picture elements adjacent to each other on a line are opposite in polarity.

Also, in the present embodiment, the driving frequency is converted by 1.25 times. This is not restrictive. For example, when the number of gate lines are n (n=2, 3, 4) and (n+1)/(n)-times conversion is carried out, effects similar to those of the present embodiment can be obtained.

Also, in the present embodiment, the length of time from the time when a non-image signal is written on picture elements on a gate line to the time when an image signal is written next is the one as illustrated in FIG. 24 (for example, the length of the periods T0_11 through T1_1 for the gate line GL1). However, the present invention is not restricted thereto. The period for inserting a non-image signal should be changed into an optimum one as appropriate according to system changes, such as material for the liquid crystal is replaced. Also, it is clear that the period for inserting a non-image signal will affect the brightness, and therefore this inserting period may be arbitrarily changed by the user.

Sixth Embodiment

In the above-described fifth embodiment, the driving frequency is 1.25 times higher than that at normal driving and, consequently, a time allocated for writing an image signal in each picture element is shortened by 1/1.25. Therefore, with upsizing and high-resolution of the liquid crystal panel, writing an image signal in each picture element may not be sufficiently carried out, in some cases.

In a sixth embodiment of the present invention, to solve the above problem, so-called pre-charge driving is introduced to the driving scheme of the fifth embodiment, where, immediately prior to writing an original image signal in each picture element, an image signal equal in polarity thereto is written.

Figure 25:
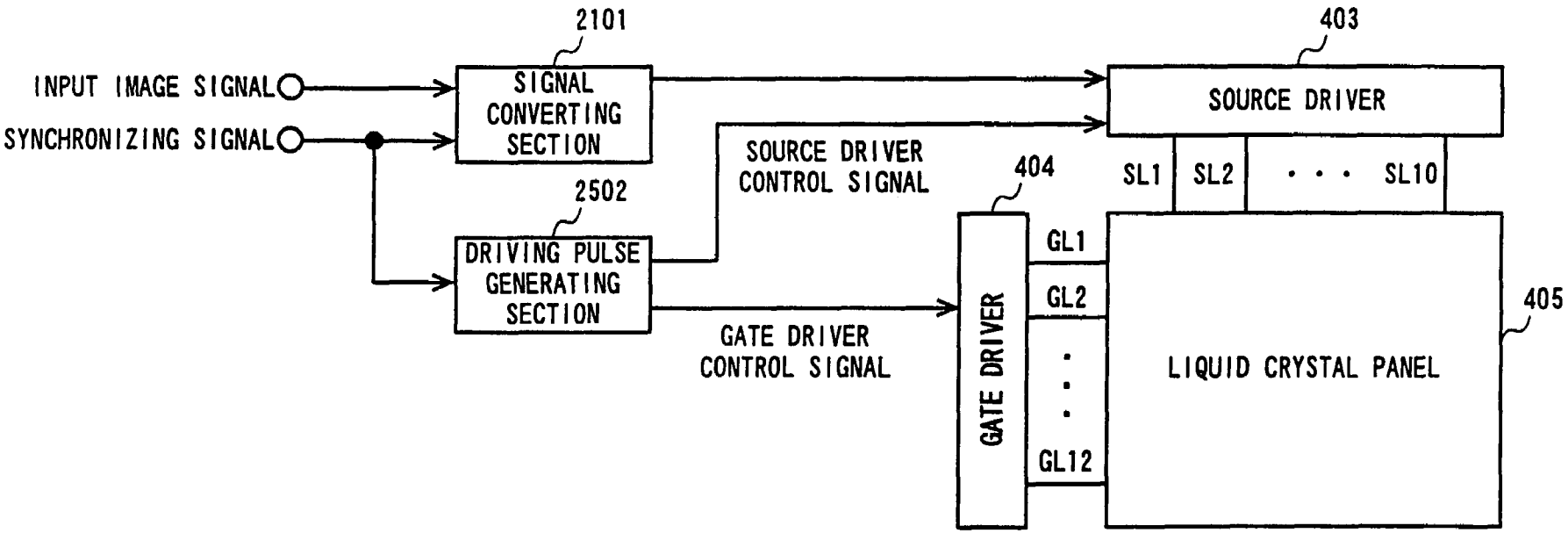
FIG. 25 is a block diagram showing the construction of a liquid crystal display device according to a sixth embodiment of the present invention.

FIG. 25 is a block diagram illustrating the construction of a liquid crystal device according to the sixth embodiment of the present invention. In FIG. 25, the liquid crystal device includes a signal converting section 2101, a driving pulse generating section 2502, a source driver 403, a gate driver 404, a liquid crystal panel 405. Note that the sixth embodiment is different from the fifth embodiment illustrated in FIG. 21 only in the driving pulse generating section. In FIG. 25, the components equivalent to those illustrated in FIG. 21 are provided with the same reference numerals, and are not described herein. The driving pulse generating section 2502 generates pulses for driving the respective drivers 403 and 404.

In the present embodiment, as in the fifth embodiment, the signal converting section 2101 converts the driving frequency. That is, transfer is made for five lines (including one line of anon-image signal) to the source driver 403 during four horizontal periods of the input image signal.

The source driver 403 inverts the polarity of the signal outputted from the signal converting section 2101 by several lines for output.

Figure 26:
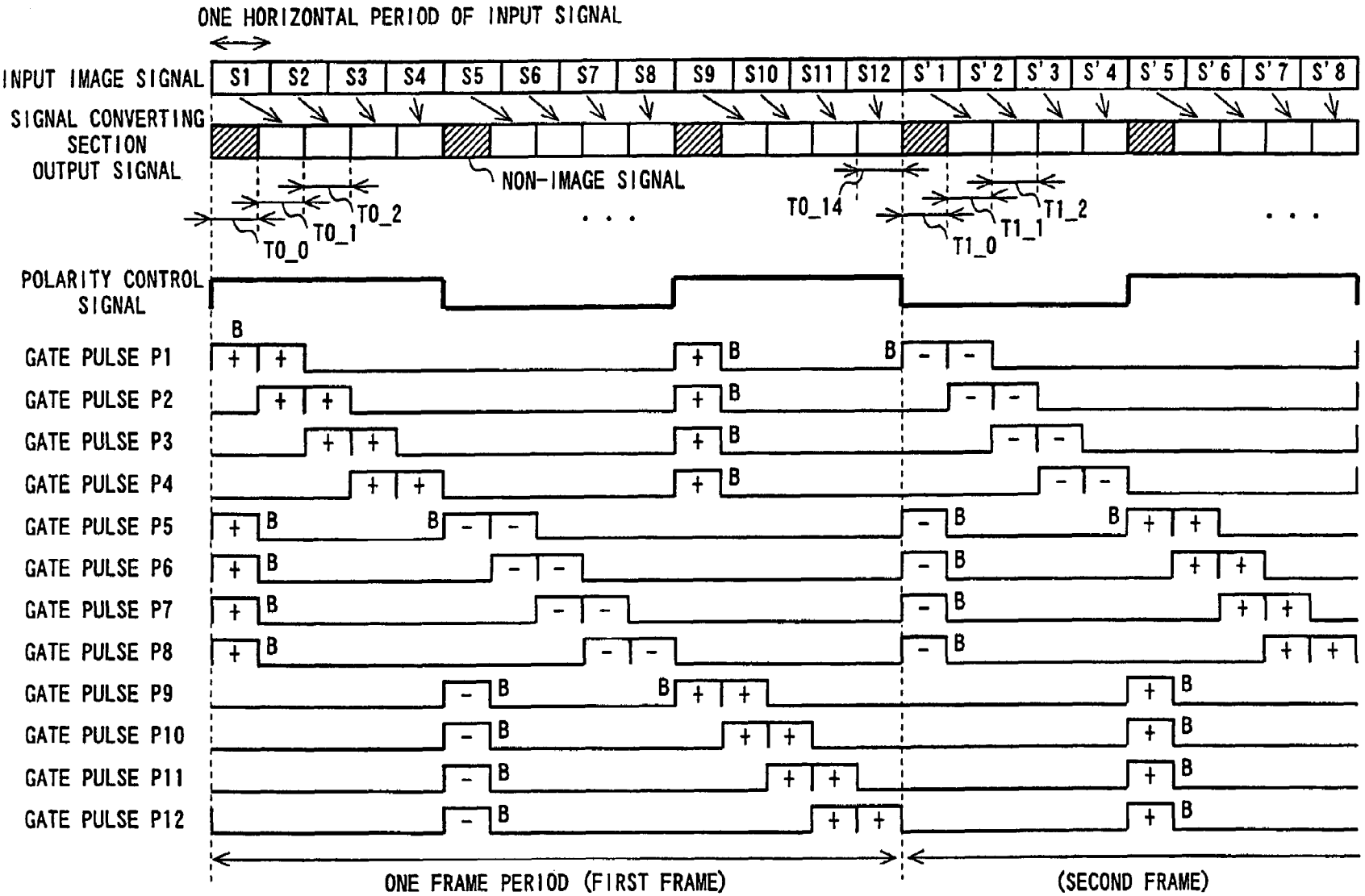
FIG. 26 is an illustration showing timing of an input image signal, an output signal from the signal converting section 2101, a polarity control signal, and gate driver driving pulses.

FIG. 26 is an illustration showing timing of the input image signal, the output signal outputted from the signal converting section 2101, a polarity control signal, and gate driver driving pulses.

During a period T0_0 illustrated in FIG. 26, gate pulses P1 and P5 through P8 simultaneously become HI, and positive non-image signals are written in picture elements on gate lines GL1 and GL5 through GL8. During the following period T0_1, the gate pulse P1 continues to be HI and, simultaneously, a gate pulse P2 becomes HI, and positive image signals S1 are written in picture elements on gate lines GL1 and GL2. At this time, the picture elements on the gate line GL1 have the positive non-image signal written therein immediately before, and therefore writing of the positive image signal S1 becomes easy. During the following period T0_2, gate pulses P2 and P3 simultaneously become HI. In the picture elements on the gate line GL2 having the positive image signal S1 already written therein, a positive image signal S2 is also written. Therefore, writing of the image signal S2 in the picture element on the gate line GL2 becomes easy. Similarly, during a period T0_3, gate pulses P3 and P4 simultaneously become HI. In the picture elements on the gate line GL3 having the positive image signal S2 already written therein, a positive image signal S3 is also written. Therefore, writing of the image signal S3 in the picture elements on the gate line GL3 becomes easy. Further, during the following period T0_4, only the gate pulse P4 becomes HI. In the picture elements on the gate line GL4 having the positive image signal S3 already written therein, a positive image signal S4 is also written. Therefore, writing of the image signal S4 in the picture elements on the gate line GL4 becomes easy.

During the following period T0_5, gate pulses P5 and P9 through P12 simultaneously become HI, and negative non-image signals are written in picture elements on gate lines GL5 and GL9 through GL12. During the following period T0_6, the gate pulse P5 continues to be HI, further a gate pulse P6 simultaneously becomes HI, and negative image signals S5 are written in picture elements on gate lines GL5 and GL6. At this time, the picture elements on the gate line GL5 have the negative non-image signal already written therein. Therefore, writing of also the negative image signal S5 becomes easy. Each picture element on the gate line GL5 retains the non-image signal during the periods T0_0 through T0_5, and retains the image signal during the remaining period in the first frame.

During the following periods T0_7 through T0_9, image signals S6 through S8 are sequentially written. Then, the polarity is inverted. During a period T0_10, the gate pulses P1 through P4 and P9 simultaneously become HI, and positive non-image signals are written in the picture elements on the gate lines GL1 through GL4 and GL9. At this time, each picture element on the gate lines GL1 through GL4 have the positive image signals S1 through S4 during the periods T0_1 through T0_4, respectively, and therefore writing of the non-image signal in these picture elements becomes easy.

Further described is a second frame. During a first period T1_0 in the second frame, the gate pulses P1 and P5 through P8 simultaneously become HI, and negative non-image signals, which are opposite in polarity to those in the first frame, are written in the picture elements on the gate lines GL1, GL5 through GL8. During the following the period T1_1, the gate pulse P1 continues to be HI and, further the gate pulse P2 becomes HI, negative image signals S'1, which are opposite in polarity to those in the first frame, are written in the picture elements on the gate lines GL1 and GL2. When the image signal S'1 is written in each picture element on the gate line GL1, these picture elements have already the negative non-image signals written immediately before, and therefore writing of the image signal S'1 becomes easy. During the following period T1_2, the gate pulses P2 and P3 simultaneously become HI. In each picture element on the gate line GL2 having the negative image signal S'1 already written, also a negative image signal S'2 is written. Therefore, writing of the image signal S'2 in each picture element on the gate line GL2 becomes easy.

As described above, in the sixth embodiment, in a driving scheme for writing an image signal twice to each picture element during one frame period, polarity control over the image signal and the non-image signal as illustrated in the fifth embodiment is maintained, and further pre-charging to each picture element is carried out. Thus, it is possible to solve the problem of insufficient writing of the image signal.

Note that, in the present embodiment, the basic driving scheme is so-called line inversion driving, in which the polarity of the signal is inverted line by line, but the present invention is not restricted thereto. For example, similar effects can be obtained even with so-called column inversion driving, in which signals written in picture elements adjacent to each other on a line are opposite.

Also, in the present embodiment, the driving frequency is converted by 1.25 times. This is not restrictive. For example, when the number of gate lines are n (n=2, 3, 4) and (n+1)/(n)-times conversion is carried out, effects similar to those of the present embodiment can be obtained.

Note that, in the present embodiment, pre-charging is applied to the driving scheme for carrying out (n+1)/(n)-times speed conversion. Dual-charge driving as shown in the fourth embodiment can be applied to the scheme for carrying out (n+1)/(n)-times speed conversion. Especially, the polarity of non-image signals simultaneously written on a plurality of gate lines are opposed to the polarity of the image signals previously written, writing of the non-image signals become disadvantageous. However, after writing the non-image signals, other non-image signals equal in polarity to the non-image signals (that is, opposite in polarity to the image signals written prior to these non-image signals) are auxiliarily written again (dual-charge), thereby reliably writing the non-image signals. As evident from the foregoing, timing of writing again non-image signals equal in polarity of the already-written non-image signals is, for example, after ten scanning periods in a case of the driving scheme for carrying out 1.25-times speed conversion (relative positional relation such as the period T0_10 with respect to the period T0_0).

Seventh Embodiment

In the driving scheme shown in the above-described fifth and sixth embodiments, to prevent loss of image quality, the number of lines during one frame period is subjected to restrictions. Specifically, in the driving scheme shown in the fifth embodiment, when the number of gate lines on which non-image signals are simultaneously written is N, the total number of lines Y during one frame period should be N×(2M+1) (M is an integer not less than 1). Shown in the fifth embodiment and the sixth embodiment are examples where N=4 and Y=12.

Figure 27:
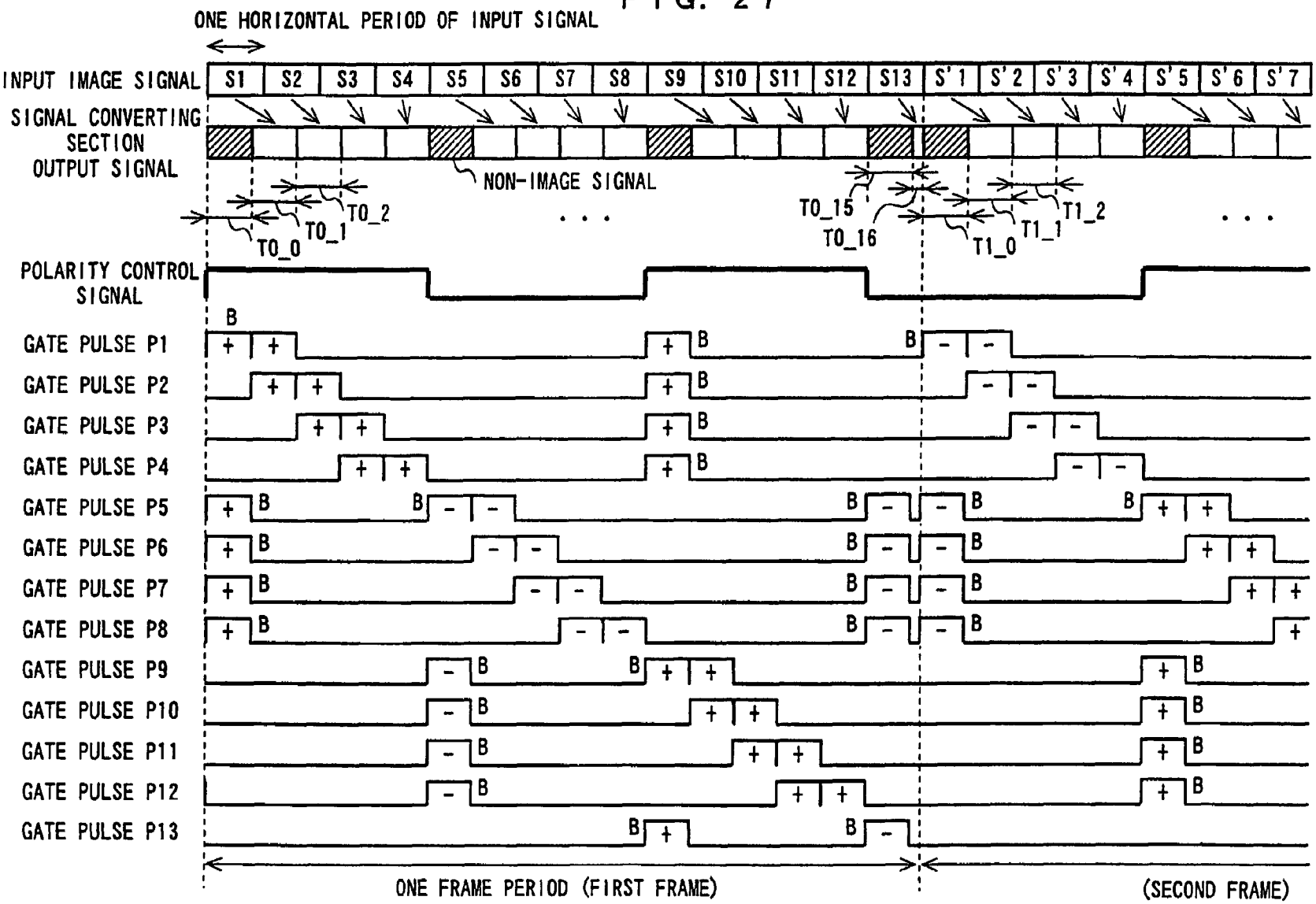
FIG. 27 is an illustration showing one example of driving timing when the total number of lines for one frame period does not satisfy a predetermined condition.

FIG. 27 is an illustration showing driving timing where N=4 and Y=13 in the driving scheme shown in the sixth embodiment, as one example of a case where the total number of lines Y during one frame period does not satisfy the above condition.

As illustrated in FIG. 27, periods during which picture elements on gate lines GL1 through GL4 retain an image signal are periods T0_1 through T0_9, periods T0_2 through T0_9, periods T0_3 through T0_9, and periods T0_4 through T0_9, respectively. On the other hand, periods during which each picture element on a gate line GL5 retains an image signal are periods T0_6 through T0_14. That is, the periods during which each picture element on the gate line GL5 retains the image signal become equal in length to the periods during which each picture element on the gate line GL1 retains the image signal. Similarly, the periods during which each picture element on the gate lines GL6 through GL8 retains the image signal become equal in length to the periods during which each picture element on the gate lines GL2 through GL4 retains the image signal.

On the other hand, periods during which each picture element on the gate lines GL9 through GL12 retains the image signal are periods T0_11 through T1_4, periods T0_12 through T1_4, periods T0_13 through T1_4, and periods T0_14 through T1_4, respectively, and each include a period T0_16. Therefore, those periods differ in length from the periods during which each picture element on the other gate lines retains the image signal. As a result, a difference in brightness occurs between a display portion corresponding to the gate lines GL1 through GL8 and a display portion corresponding to the gate lines GL9 through GL12.

Therefore, in a seventh embodiment of the present invention, a means for adjusting the number of gate lines to be scanned for one frame period is newly provided, thereby adjusting the total number of scanning lines Y for one frame period of the input image signal to N×(2M+1), when Y is not N×(2M+1).

Figure 28:
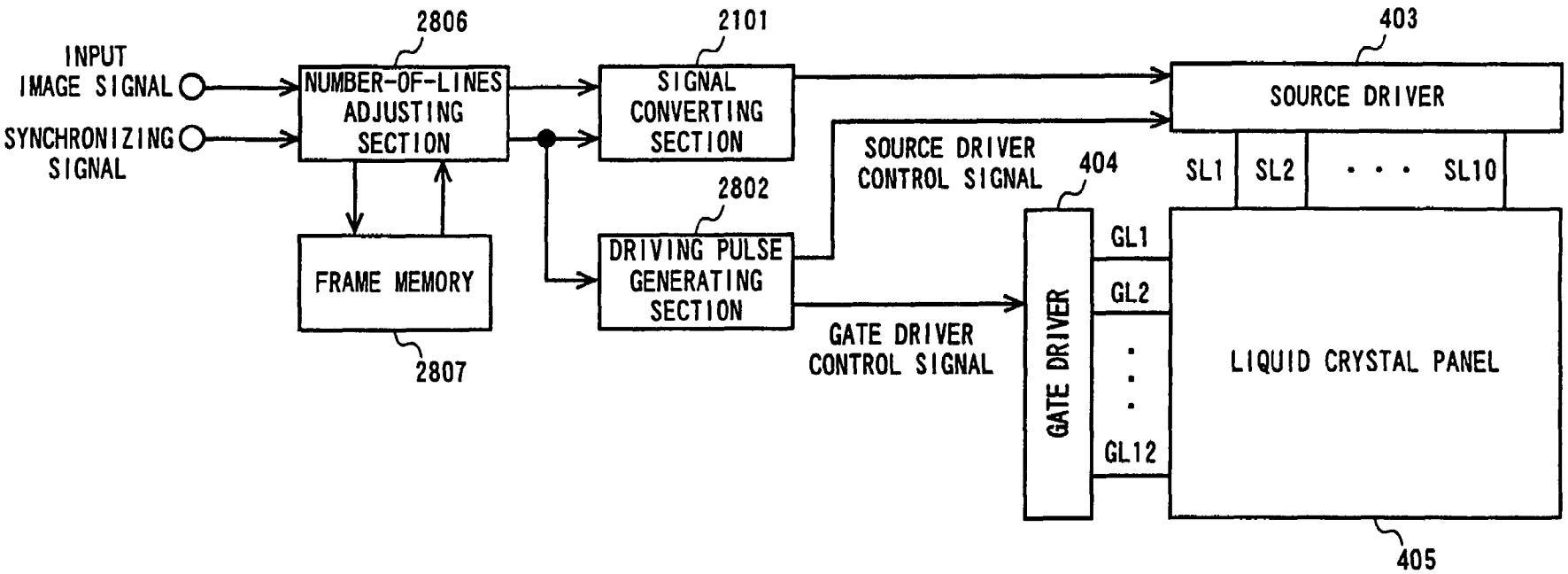
FIG. 28 is a block diagram showing the construction of a liquid crystal display device according to a seventh embodiment of the present invention.

FIG. 28 is a block diagram illustrating a liquid crystal display device according to a seventh embodiment of the present invention. In FIG. 28, the liquid crystal display device includes a signal converting section 2101, a drive pulse generating section 2802, a source driver 403, a gate driver 404, a liquid crystal panel 405, a number-of-lines adjusting section 2806, and a frame memory 2807. Note that the seventh embodiment is different from the sixth embodiment illustrated in FIG. 25 only in that the number-of-lines adjusting section 2806 and the frame memory 2807 are newly provided. In FIG. 28, the components equivalent to those illustrated in FIG. 25 are provided with the same reference numerals, and are not described herein.

Described below is a driving scheme of the liquid crystal display device according to the seventh embodiment. In synchronization with reference timing of a predetermined image signal, writing and reading of the image signal to and from the frame memory 2807 is carried out. At this time, the frequency of a clock used for reading the image signal from the frame memory 2807 is made lower than the frequency of a clock used for writing the image signal in the frame memory 2807. Here, with the number of image signals during one horizontal period maintained, the horizontal period becomes longer, and also with one frame period maintained, the number of lines during one frame period can be reduced. Thus, when the number of lines Y during one frame period of the input image signal is not N×(2M+1), this number can be adjusted to N×(2M+1). Consequently, dispersion of the periods for retaining the image signal can be suppressed, thereby enabling high-quality display.

Note that, in the present embodiment, the number-of-lines converting section 2806 carries out conversion so that the number of lines is reduced from Y to Y' (≦Y). This is because, in general, an image signal includes a blanking period not related to an image to be displayed and, even if the total number of lines during one frame period is reduced, any part of video to be displayed will not be dropped. Furthermore, it is more advantageous to reduce the number of lines than to increase the number of lines because the operation frequency is reduced. However, when the total number of lines Y is not more than the number of lines of the image signals to be displayed, such adjustment as to satisfy Y'>Y maybe carried out. This adjustment is made possible by making the frequency of the clock used for reading the image signal from the frame memory 2807 higher than the frequency of the clock used for writing the image signal in the frame memory 2807.

Note that, in the present embodiment, a driving with precharging has been described as an example. However, precharge driving is not necessarily carried out together.

Eighth Embodiment

Figure 29:
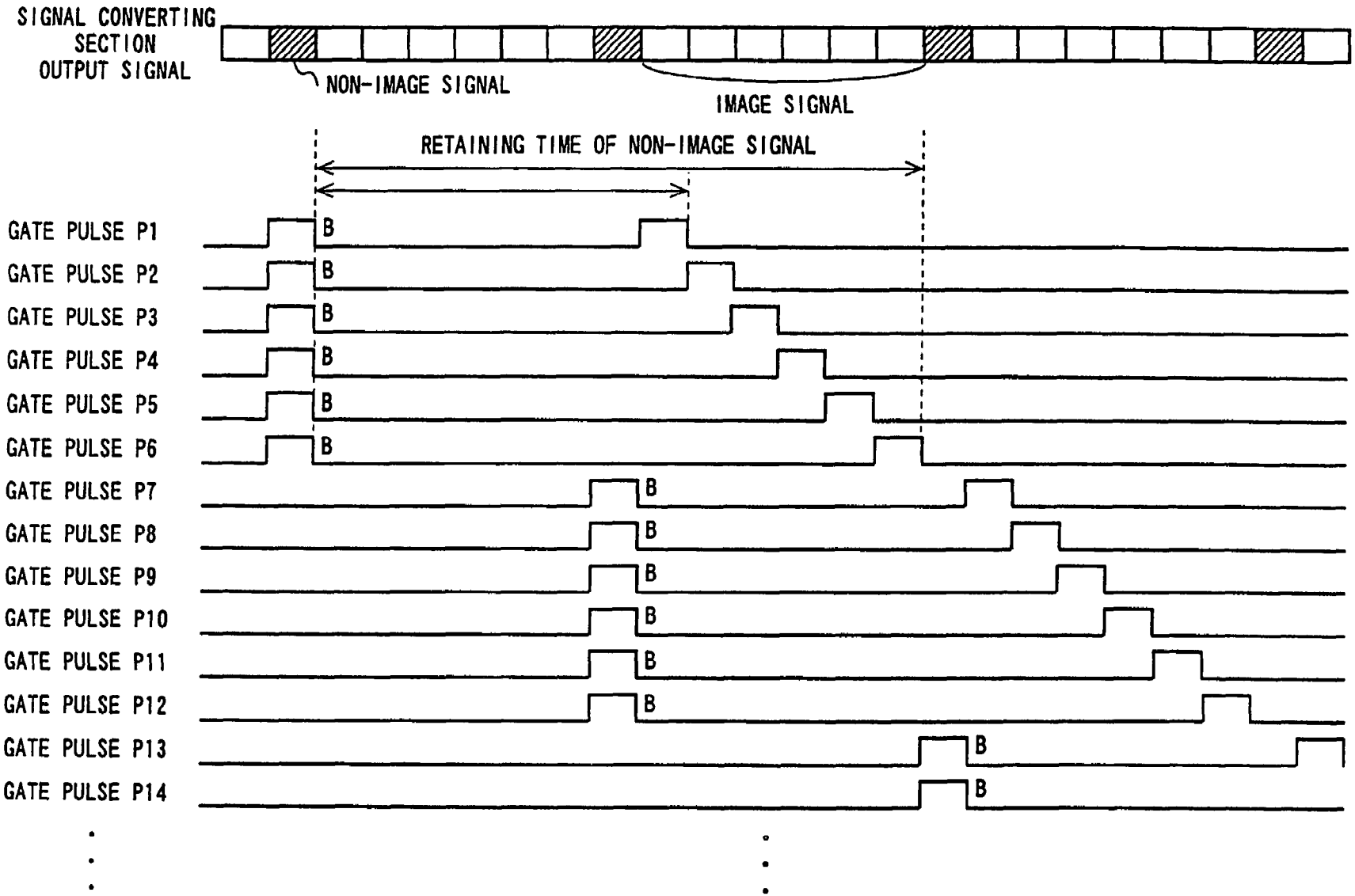
FIG. 29 is an illustration showing that the length of a retention time of a non-image signal differs by line.
Figure 30:
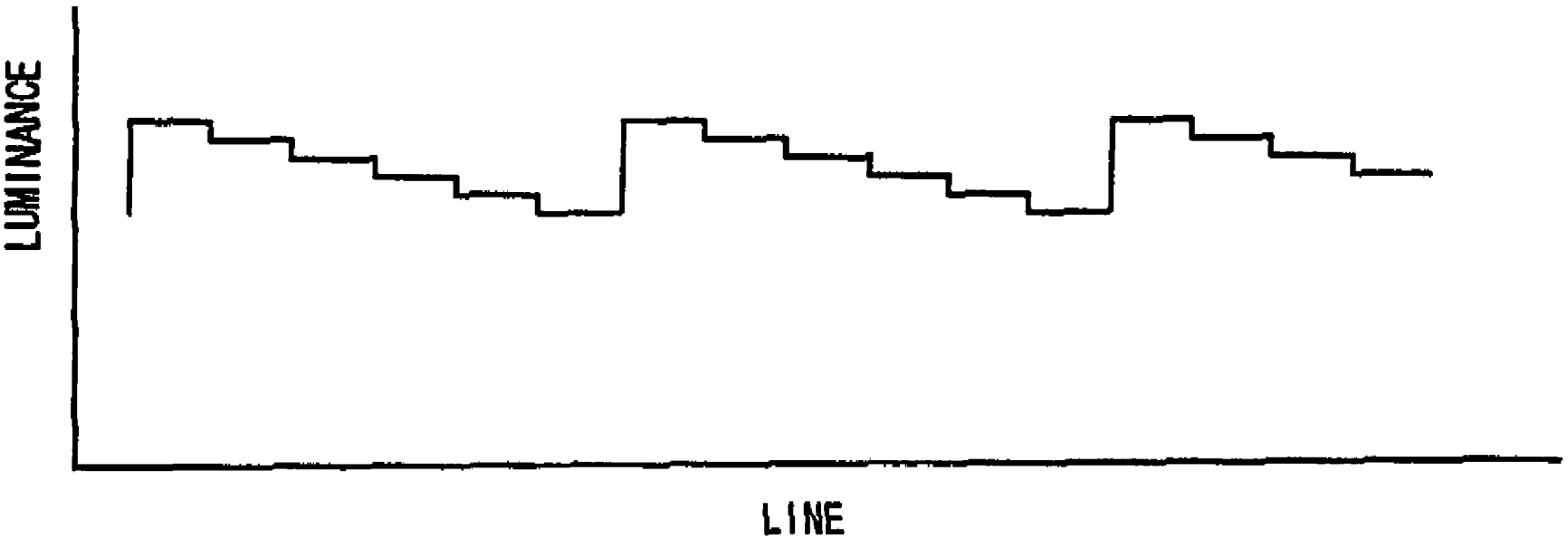
FIG. 30 is an illustration showing the state of luminance variations.

In the above-described fifth embodiment, as illustrated in FIG. 24, the length of the periods for retaining the non-image signal during one frame period is varied by line. As illustrated in FIG. 29, the larger the number of lines on which the non-image signals are simultaneously written, the larger the variation. Consequently, luminance variations can be disadvantageously perceived on a display screen. In an example of FIG. 29, luminance variations by a unit of six lines as illustrated in FIG. 30 can be disadvantageously perceived. In an eighth embodiment, these luminance variations are resolved by correcting the luminance of the input image signal.

Figure 31:
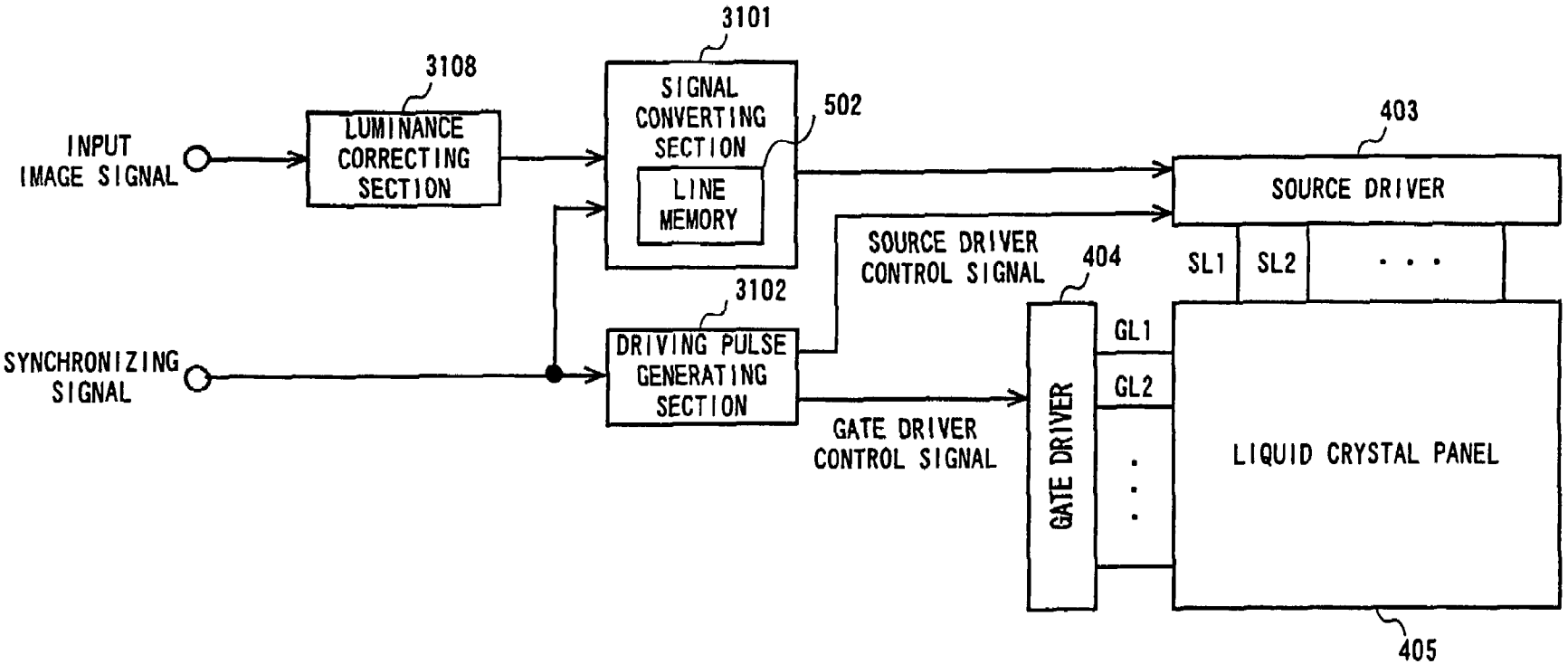
FIG. 31 is a block diagram illustrating a liquid crystal display device according to an eighth embodiment of the present invention.

FIG. 31 is a block diagram illustrating the construction of a liquid crystal display device according to the eighth embodiment. In FIG. 31, the liquid crystal display device includes a luminance correcting section 3108, a signal converting section 3101, a driving pulse generating section 3102, a source driver 403, a gate driver 404, and a liquid crystal panel 405. The signal converting section 3101 includes a line memory 502. In FIG. 31, the components equivalent to those illustrated in FIG. 21 or FIG. 22 are provided with the same reference numerals, and are not described herein.

The signal converting section 3101 and the driving pulse generating section 3102 respectively carry out predetermined signal processing so as to achieve a driving scheme illustrated in FIG. 29. This signal processing is evident from the above description of the embodiments, and therefore not described herein. The luminance correcting section 3108 corrects the luminance of the input image signal at a predetermined degree previously obtained through an experiment, etc., so that luminance variations as illustrated in FIG. 30 are eliminated. As to a scheme for correction, various schemes can be used, such as a scheme using a table, or a scheme for using a multiplier.

As such, by correcting the luminance of the input image signal line by line, it is possible to prevent the occurrence of luminance variations due to variations in time for inserting a non-image signal among the lines.

Ninth Embodiment

Figure 32:
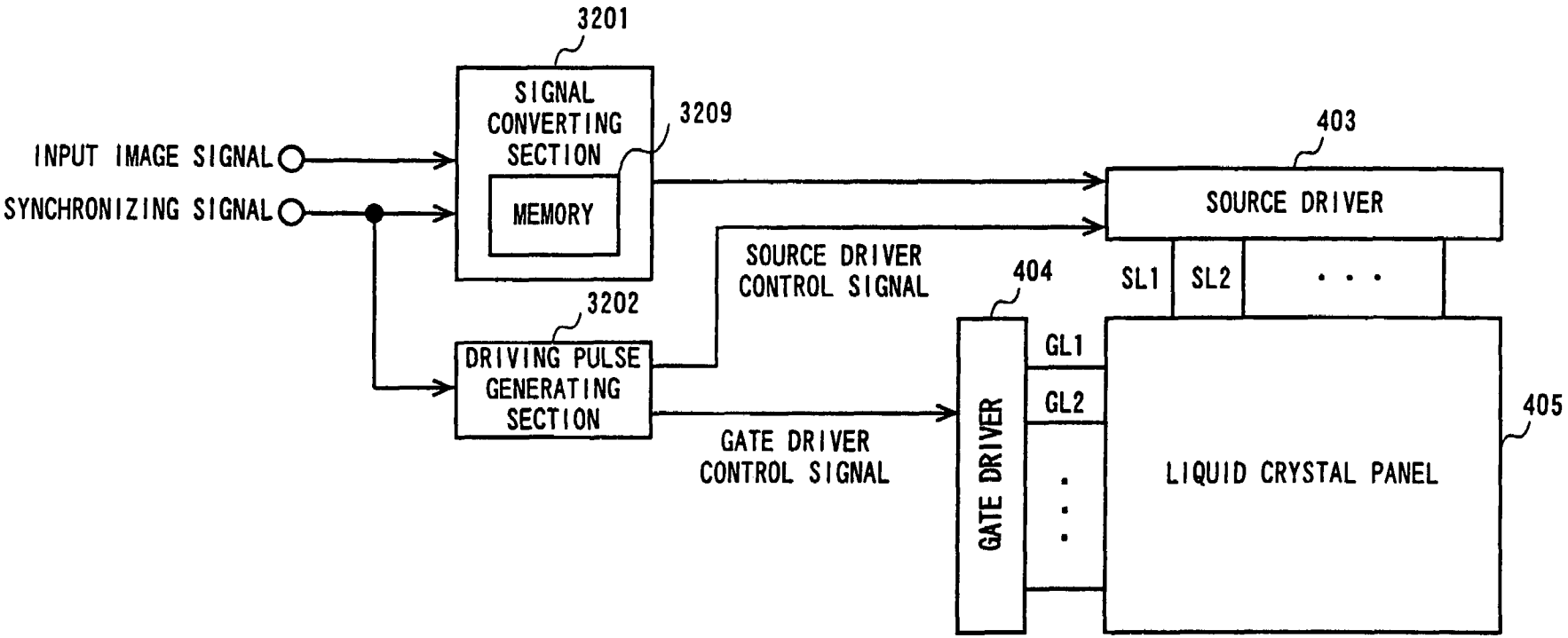
FIG. 32 is a block diagram illustrating a liquid crystal display device according to a ninth embodiment of the present invention.

FIG. 32 is a block diagram illustrating the construction of a liquid crystal display device according to a ninth embodiment of the present invention. In FIG. 32, the liquid crystal display device includes a signal converting section 3201, a driving pulse generating section 3202, a source driver 403, a gate driver 404, and a liquid crystal panel 405. The signal converting section 3201 includes a memory 3209. In FIG. 32, the components equivalent to those illustrated in FIG. 21 are provided with the same reference numerals, and are not described herein.

The signal converting section 3201 converts the input image signal so that the driving frequency is multiplied by 7/6 and, at the same time, rearranges the writing order by line. For these conversion and rearrangement, the memory 3209 is used.

In the above-described eighth embodiment, luminance variations are solved by correcting the image signal. In the present invention, on the other hand, luminance variations are solved by rearranging the scanning order by frame. Hereinafter, with reference to FIG. 33A and FIG. 33B, driving is described.

Figure 33A:
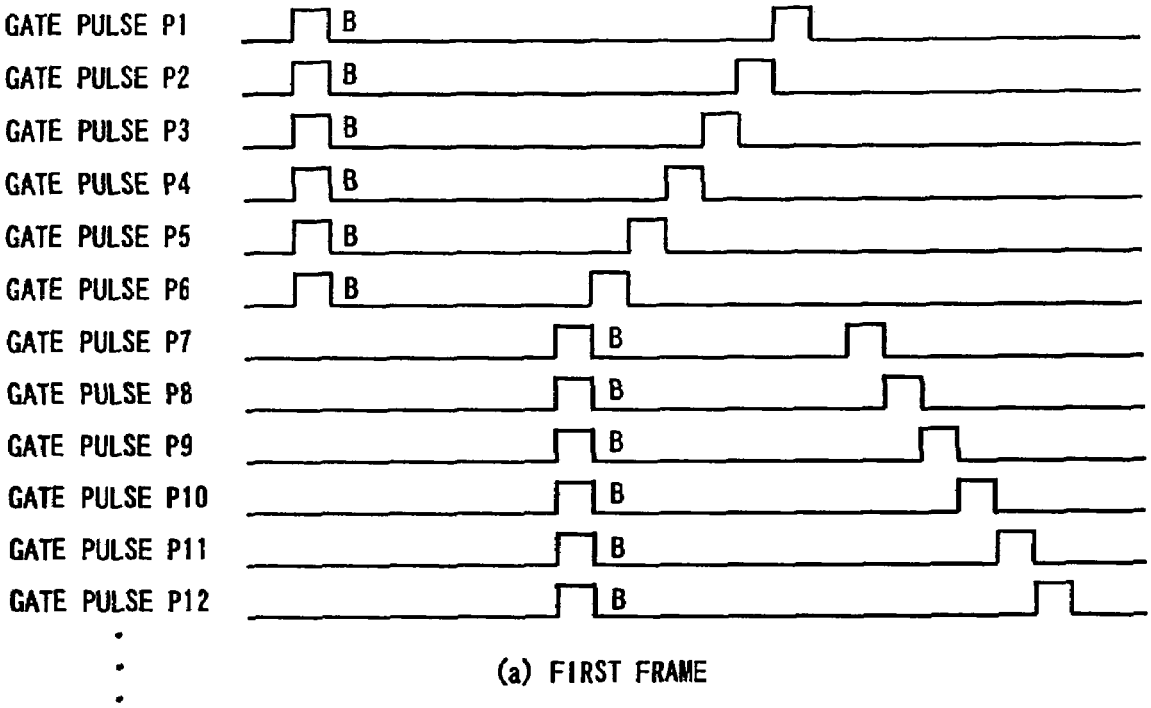
FIGS. 33A and 33B are illustrations showing timing of gate driver driving pulses in a first frame and a second frame, respectively.
Figure 33B:
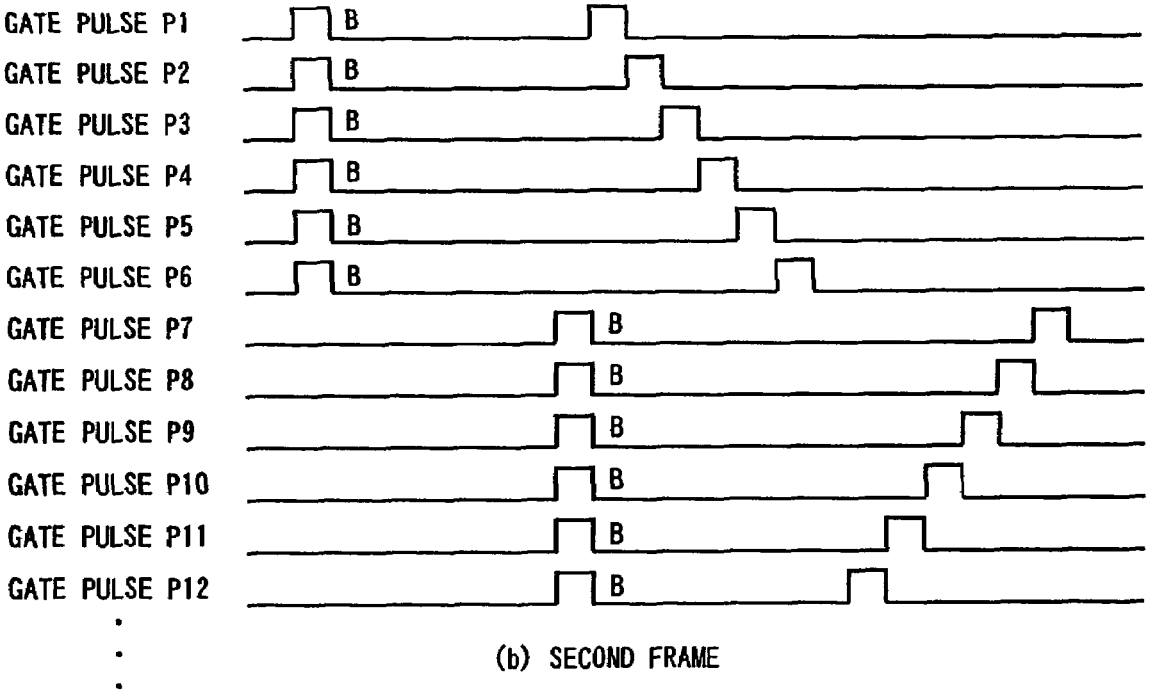

FIG. 33A is an illustration showing timing of each of gate driver driving pulses in a first frame. FIG. 33B is, on the other hand, an illustration showing timing of each of gate driver driving pulses in a second frame. In the first frame, as illustrated in FIG. 33A, scanning is carried out in a direction from a gate line GL6 to a gate line GL1, and then in a direction from a gate line GL7 to a gate line GL12. In the following second frame, as illustrated in FIG. 33B, scanning is carried out in a direction from the gate line GL1 to the gate line GL6, and then in a direction from the gate line GL12 to the gate line GL7. Thereafter, scanning illustrated in FIG. 33A and scanning illustrated in FIG. 33B are alternately carried out by one frame.

As a result of such driving, all lines become equal in the average length of periods for every two frames, the periods during which the non-image signal is inserted. Furthermore, as exemplarily illustrated in FIG. 29, discontinuity in the periods of retaining the non-image signal between the gate lines GL6 and GL7 can be resolved. Therefore, no luminance variations can be perceived.

Note that, for carrying out such scanning, the signal converting section 3201 rearranges the image signals and converts the driving frequency. The construction for carrying out such signal processing has been known to the public, and therefore is not described herein.

As described above, according to the ninth embodiment, the average periods during which the non-image signal is inserted can be equalized in each gate by changing the scanning direction for each frame. Therefore, it is possible to prevent luminance variations from being perceived.

Tenth Embodiment

Figure 2:
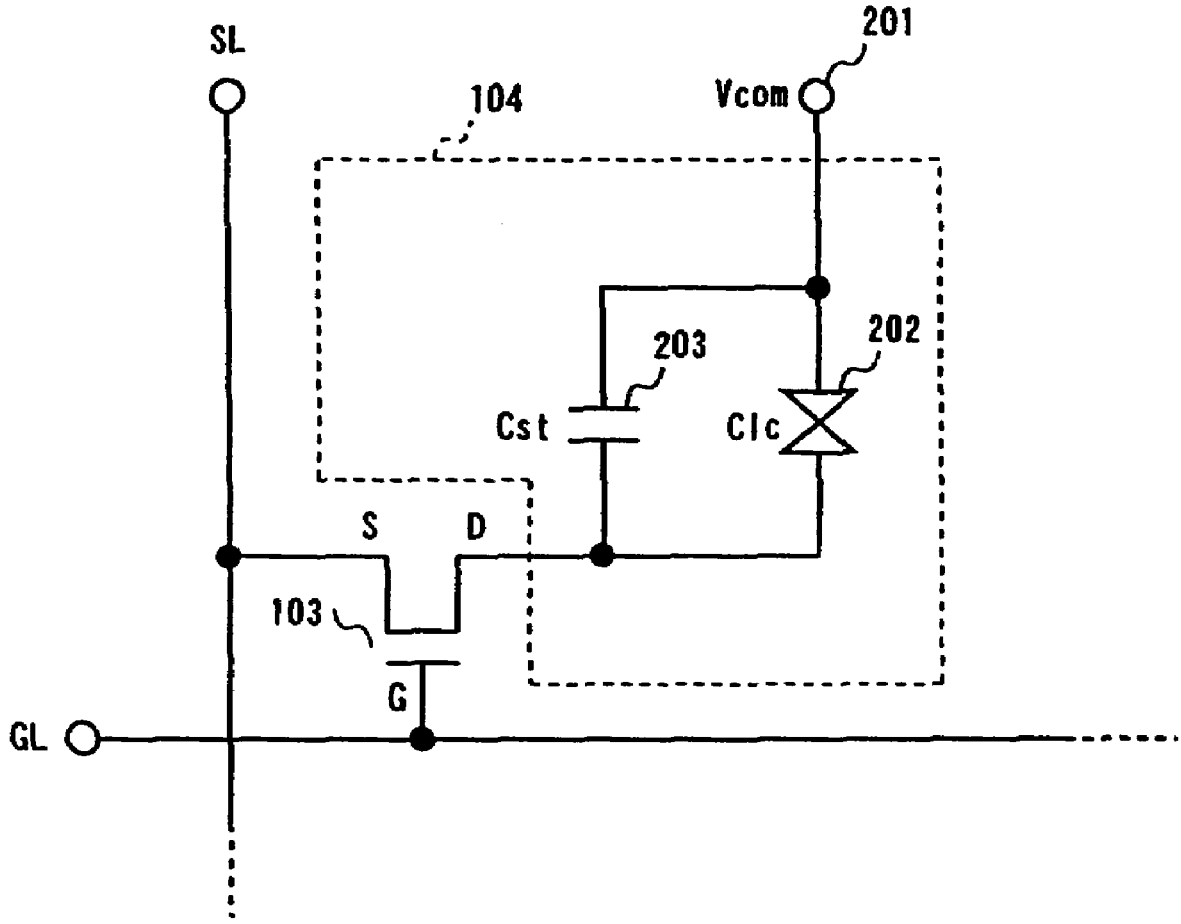
FIG. 2 is an illustration showing a picture element section of the conventional liquid crystal display device.
Figure 34:
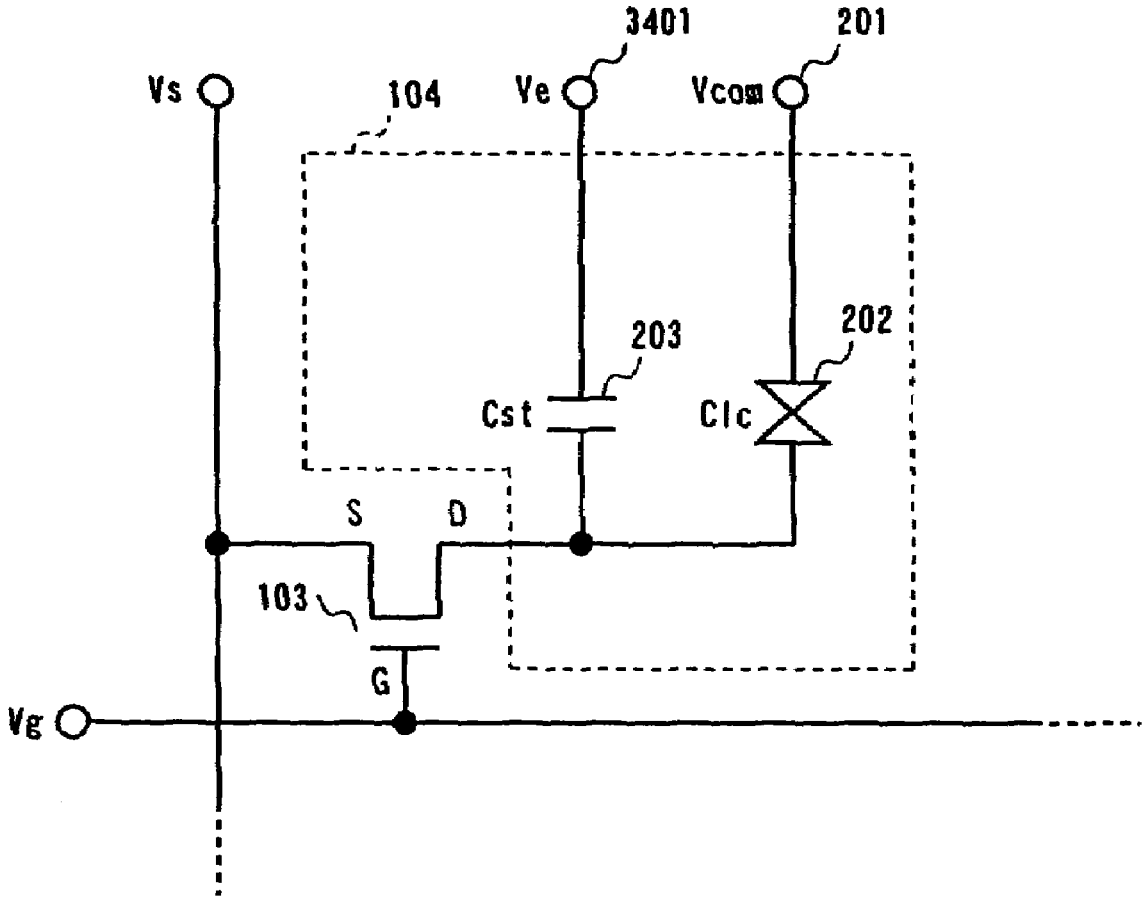
FIG. 34 is an illustration for demonstrating an other-end electrode 3401.

In the above-described first to ninth embodiments, a predetermined voltage for preventing back transition is applied as a non-image signal to a liquid crystal through a source line. In the following embodiments, on the other hand, a predetermined voltage is applied to the liquid crystal by controlling the potential at the electrode 3401 of a picture element section illustrated in FIG. 34. As illustrated in FIG. 34, the picture element section of the liquid crystal panel has, in general, a liquid crystal 202 held between a picture element electrode and a common electrode 201, and a storage capacitor 203 formed between the picture element electrode and the electrode 3401. Note that, in FIG. 34, the components equivalent in structure to those in FIG. 2 are provided with the same reference numerals, and are not described herein. In general, the electrode 3401 is connected to the common electrode 201 as illustrated in FIG. 2. In the following embodiments, however, the electrode 3401 is an independent electrode from the common electrode 201. In the following description, for convenience sake, the electrode 3401 is referred to as "the other-end electrode". That is, of the electrodes of the storage capacitor 203 at both ends, the one located on a side that is not connected to a drain line is called "the other-end electrode".

Figure 1:
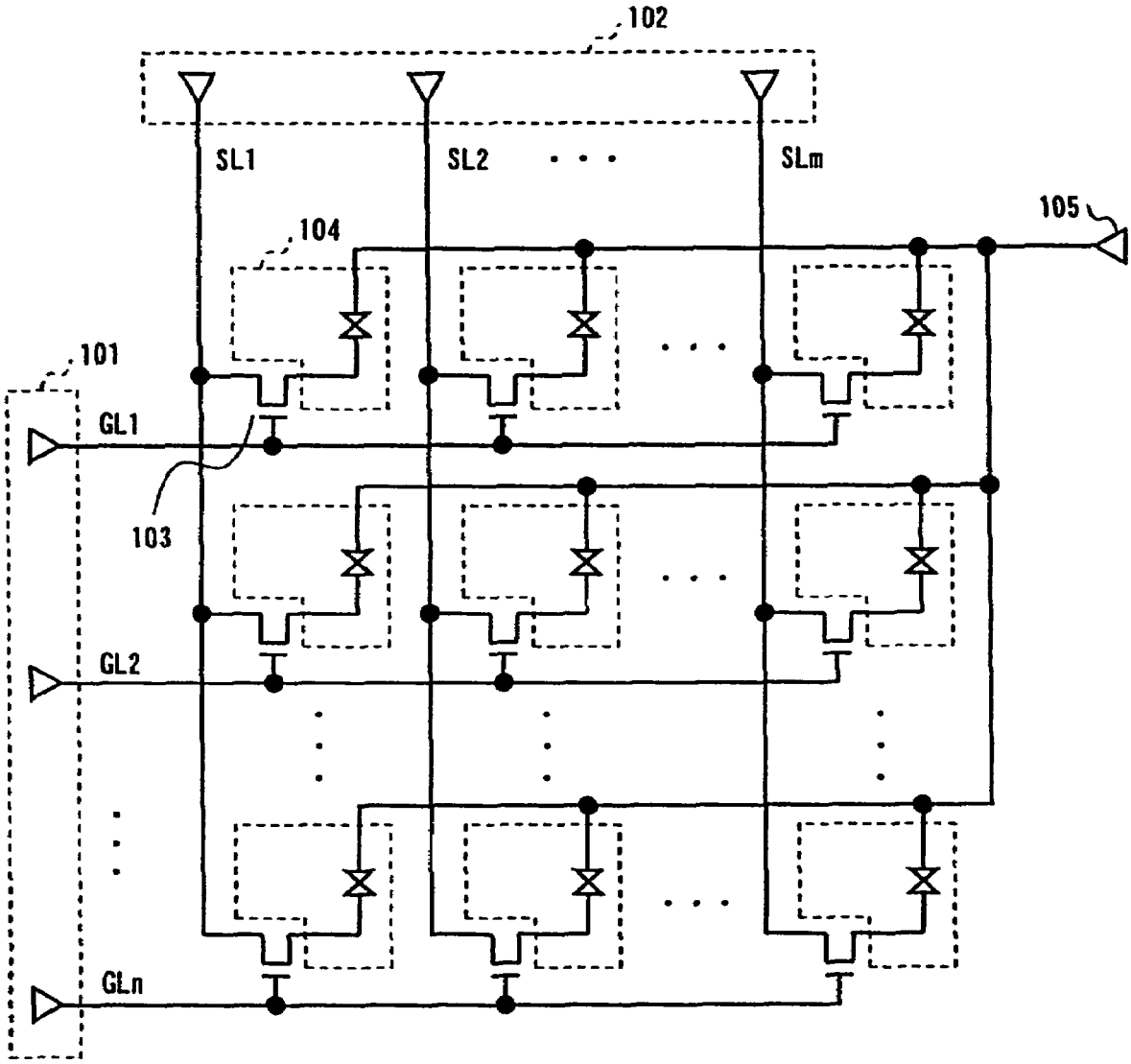
FIG. 1 is an illustration showing the construction of a conventional liquid crystal display device.
Figure 35:
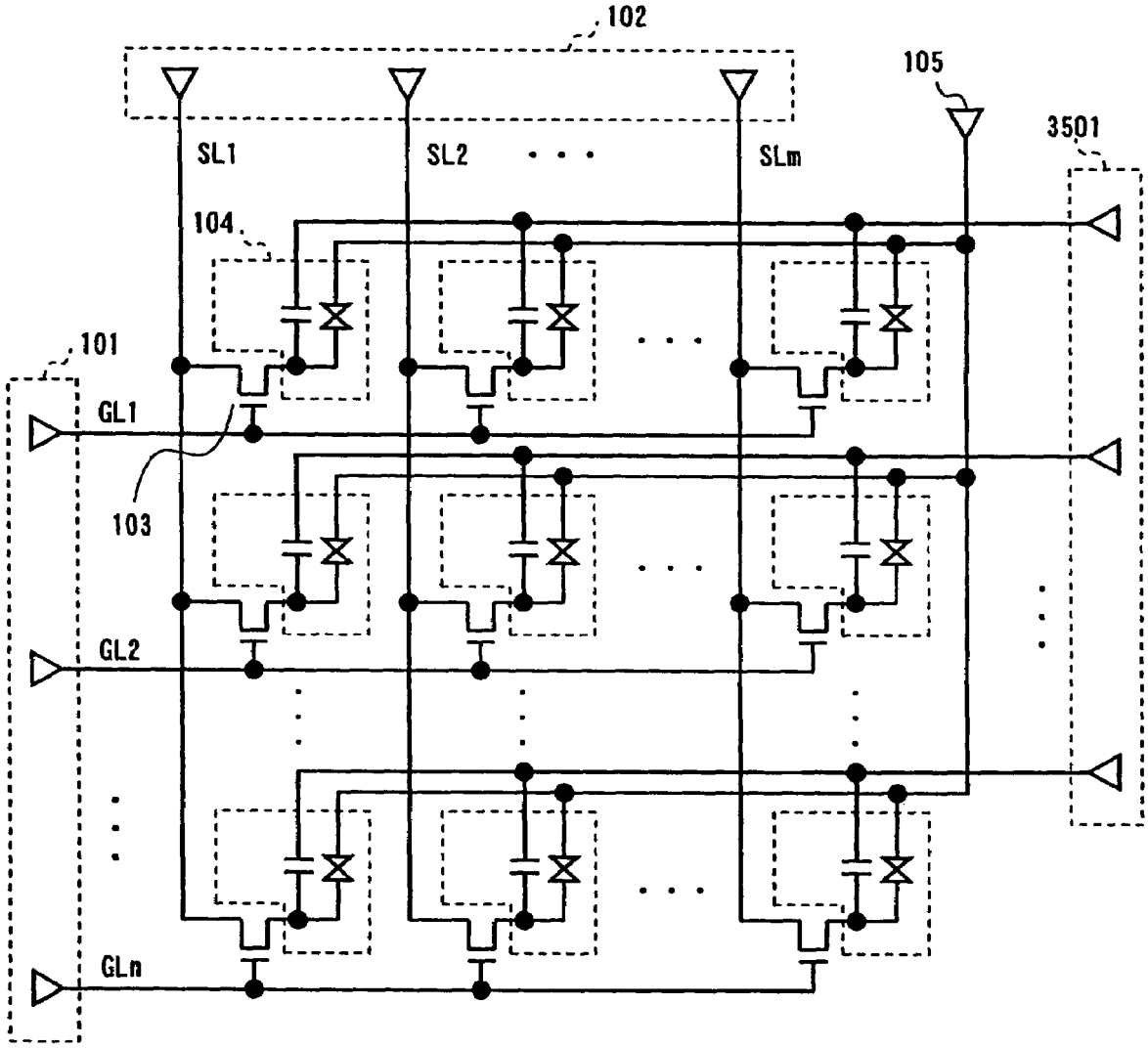
FIG. 35 is an illustration for demonstrating an other-end driver 3501.
Figure 36:
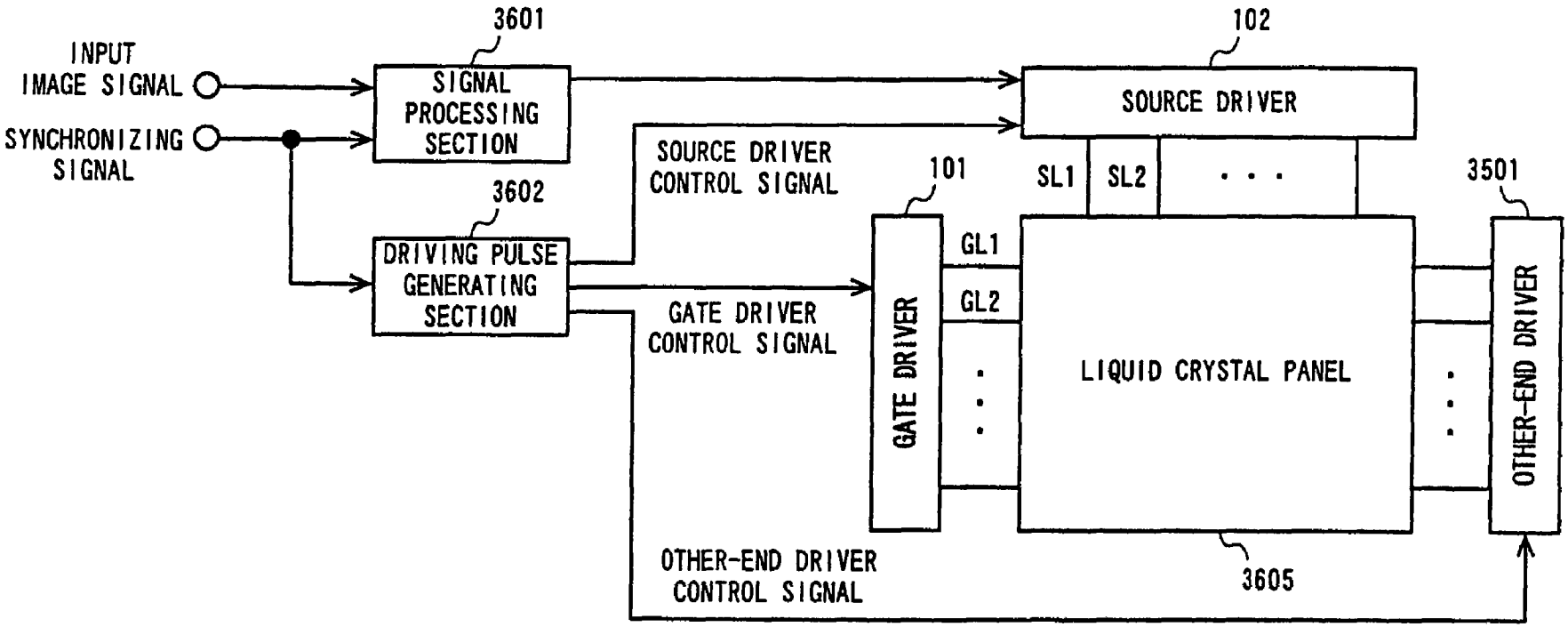
FIG. 36 is a block diagram illustrating the construction of a liquid crystal device according to a tenth embodiment of the present invention.

Hereinafter described is a liquid crystal display device according to a tenth embodiment of the present invention. In the tenth embodiment, to manipulate the electrode of the above-described other-end electrode 3401, an other-end driver 3501 is provided as illustrated in FIG. 35. FIG. 36 is a block diagram illustrating the construction of the liquid crystal display device according to the tenth embodiment. In FIG. 36, the liquid crystal display device includes a signal processing section 3601, a driving pulse generating section 3602, a gate driver 101, a source driver 102, a liquid crystal panel 3605, and the other-end driver 3501. Note that, in FIG. 35 and FIG. 36, the components equivalent in structure to those in FIG. 1 or FIG. 2 are provided with the same reference numerals, and are not described herein.

Figure 37:
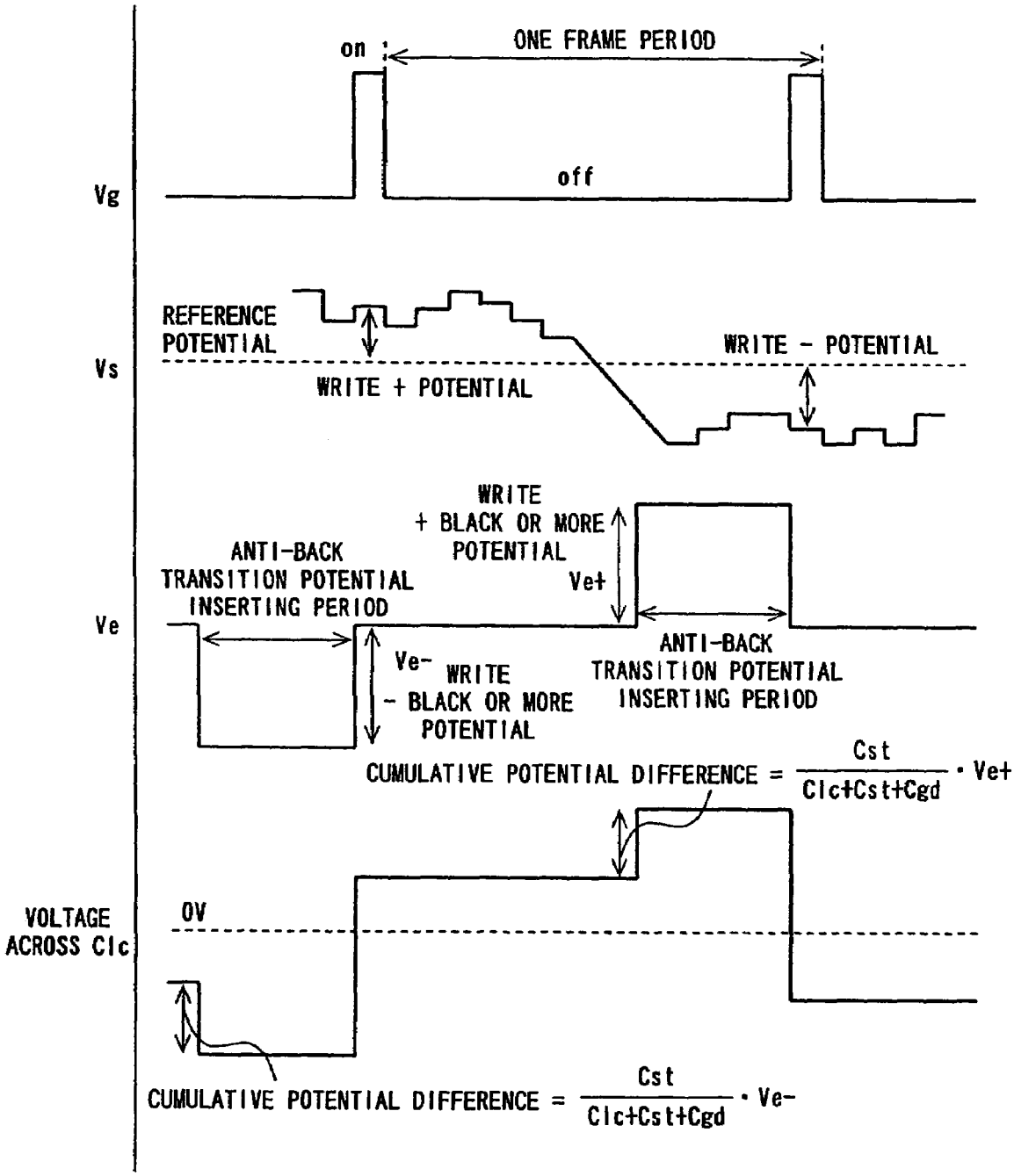
FIG. 37 is an illustration showing a relation between a potential supplied to a picture element and a voltage applied to a liquid crystal 202.

The signal processing section 3601 carries out normal signal processing associated with image processing, and is the same as a conventional one. The driving pulse generating section 3602 generates a control signal to be supplied to each driver, and is the same as a conventional one, except for generating a control signal for the other-end driver. That is, processing in the gate driver 101 and the source driver 102 is similar to the conventional one. The liquid crystal display device of the tenth embodiment is different from the conventional one in that a potential for preventing back transition is applied to the liquid crystal panel 3605 through the other-end driver 3501. Hereinafter described is the operation of the present embodiment with reference to FIG. 37.

A potential Vg of each of gate lines (GL1, GL2, . . . ) sequentially becomes ON for each frame in synchronization with a data potential Vs supplied to a source line (SL1, SL2, . . . ). In an example illustrated in FIG. 37, the polarity of the voltage supplied to the source line is switched by each source line and each frame. In the normal liquid crystal panel as illustrated in FIG. 2, a difference between the potential given to the picture element electrode through the source line in the above described manner and the potential of the common electrode 201 is a voltage to be applied to the liquid crystal 202 in the picture element 104. The voltage applied to the liquid crystal 202 determines a transmittance of this picture element 104.

In the present embodiment, on the other hand, the potential of the other-end electrode 3401 influences the voltage applied to the liquid crystal 202 through the storage capacitor 203. Therefore, as exemplarily illustrated in FIG. 37, by changing a potential Ve of the other-end electrode 3401, the potential difference between both ends of the liquid crystal 202 can be manipulated.

When a potential is given to the other-end electrode 3401, the amount of change in voltage applied to the liquid crystal 202 (cumulative potential) Vp is represented as the following equation (1), where the storage capacitor is Cst, a liquid crystal capacitance is Clc, a parasitic capacitance between the gate and the drain not shown is Cgd, and a voltage change in Ve is Ve+ or Ve−.

$$Vp=Cst/(Clc+Cst+Cgd)\times(Ve+\text{ or }Ve-) \quad (1)$$

As shown in the above equation, by manipulating Ve+ and Ve− as appropriate, a voltage required for preventing back transition can be applied to the liquid crystal 202 as appropriate. That is, irrespectively of the potential given to the liquid crystal through the source line, effective voltages can be arbitrarily (the above-described Vp) accumulated. Therefore, without shortening the time for writing the image signal, the predetermined voltage for preventing back transition can be regularly (for example, 20% of one frame period for each frame) applied to the liquid crystal 202.

As described above, according to the tenth embodiment, the predetermined voltage can be applied to the liquid crystal 202 without influencing writing of the image signal. This does not pose such problems as image deterioration due to insufficient recharge of the image signal or load increase on circuits due to high speed of the driving frequency.

Eleventh Embodiment

Figure 3:
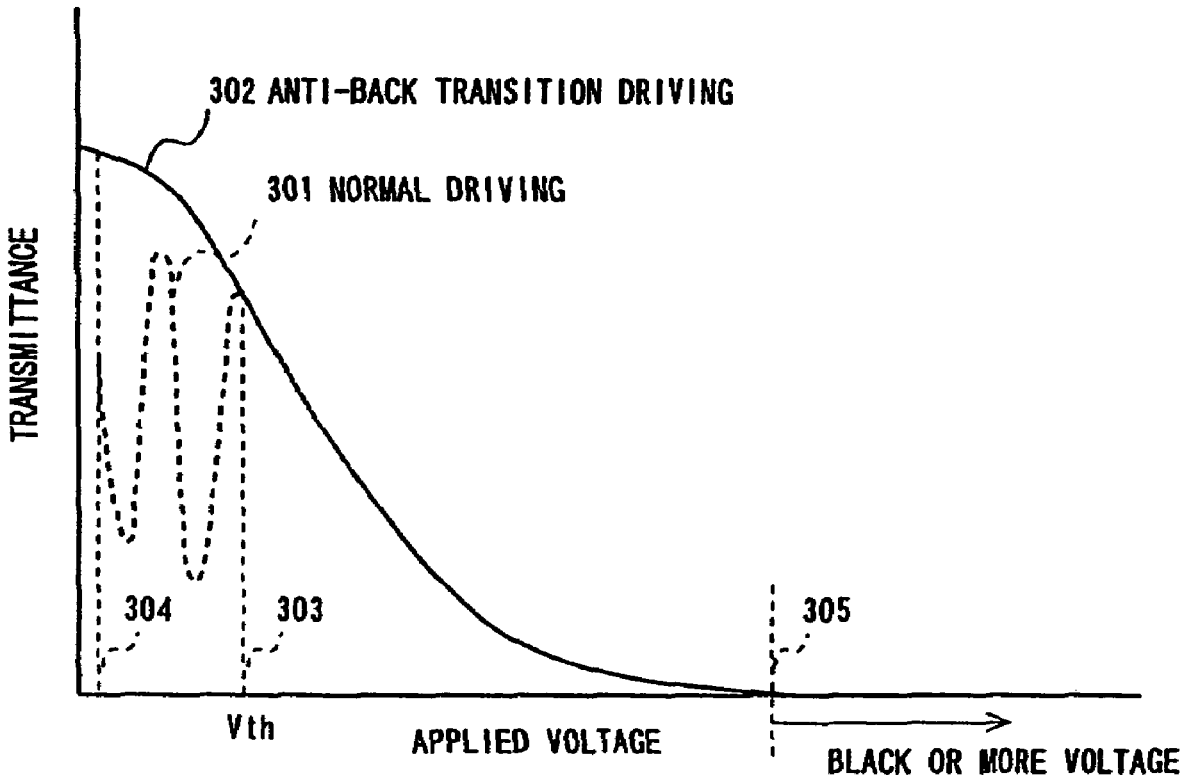
FIG. 3 is an illustration showing a potential-transmittance curve of general OCB.

In the above-described tenth embodiment, alternate inversion of the voltage to be applied to the liquid crystal 202 is achieved by inverting the polarity of the source-line potential. For carrying out such driving, however, the source line has to be supplied with a potential at least double in width of the potential (black potential) 305 when the transmittance is at the lowest as illustrated in FIG. 3. In the present embodiment, on the other hand, alternate inversion driving and anti-back transition preventing driving are simultaneously achieved while the source line is supplied with a potential one-fold in width of the potential 305 (hereinafter referred to as one-fold potential) illustrated in FIG. 3.

Figure 38:
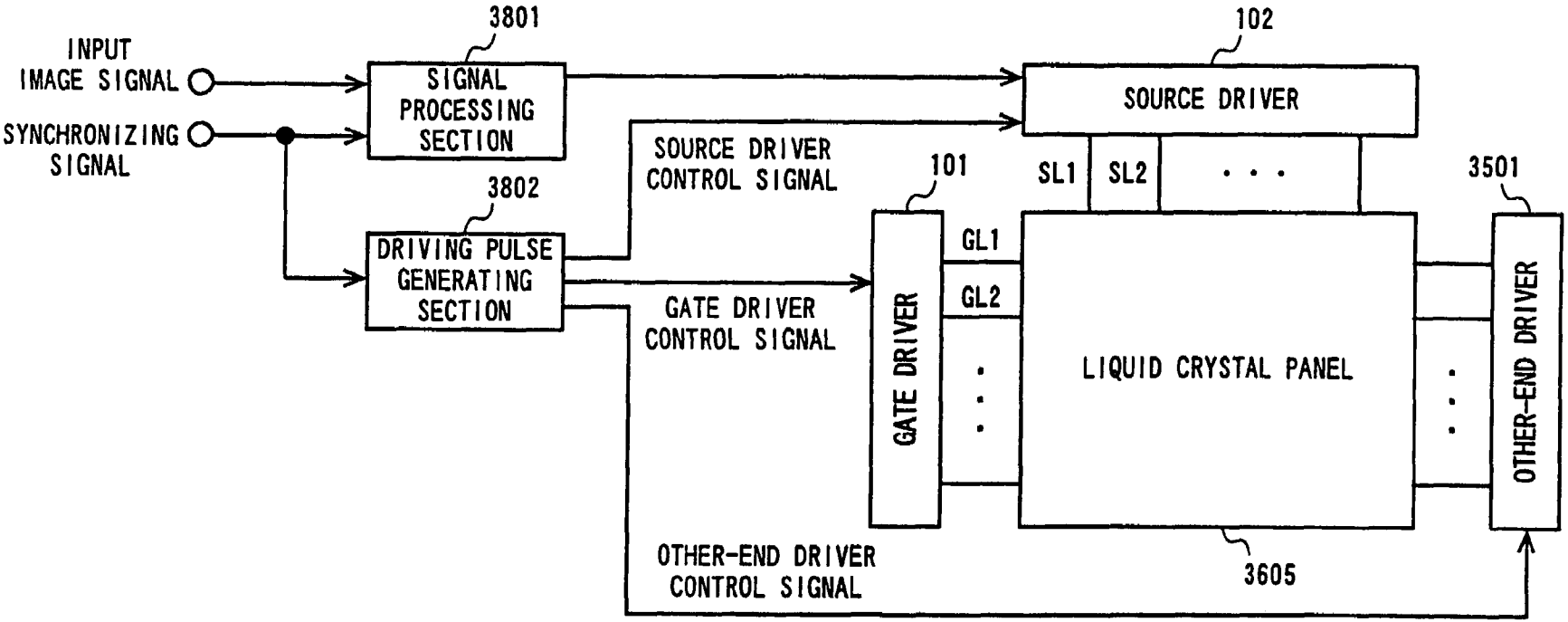
FIG. 38 is a block diagram illustrating the construction of a liquid crystal device according to an eleventh embodiment of the present invention.

FIG. 38 is a block diagram illustrating a liquid crystal display device according to an eleventh aspect of the present invention. In FIG. 38, the liquid crystal display device includes a signal processing section 3801, a driving pulse generating section 3802, agate driver 101, a source driver 102, the other-end driver 3501, and a liquid crystal panel 3605. Note that, in FIG. 38, the components equivalent in structure to those in FIG. 36 are provided with the same reference numerals, and are not described herein.

Described first is a mechanism for achieving alternate inversion driving while supplying a one-fold potential to the source line.

Figure 39:
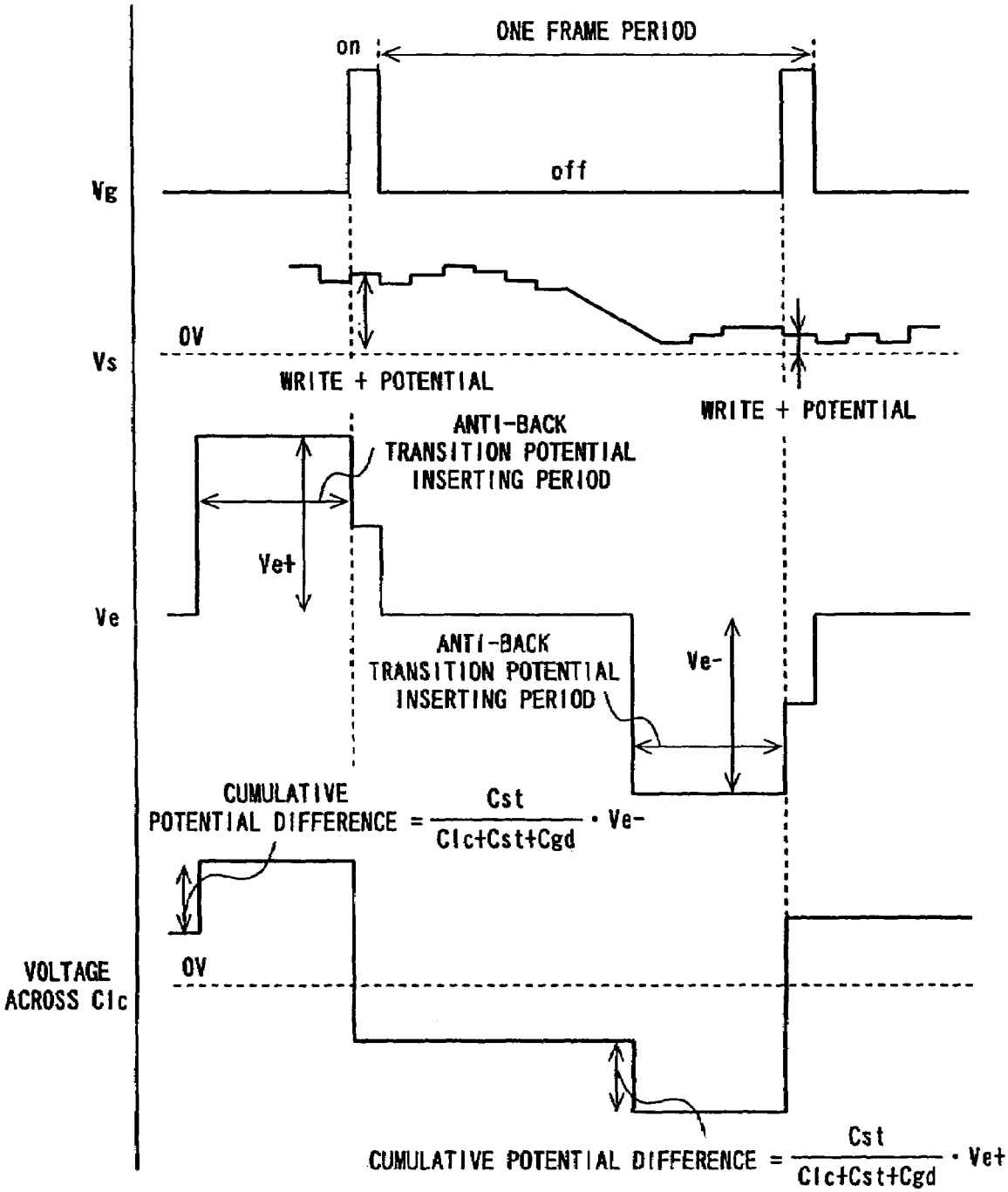
FIG. 39 is an illustration showing a relation between a potential supplied to the picture element and a voltage applied to the liquid crystal 202.

As illustrated in FIG. 39, while a gate is ON, a potential Ve of the other-end electrode 3401 is temporarily increased (Vge+) or lowered (Vge−), and then is returned to the original potential after the gate is OFF, thereby manipulating the voltage to be applied to the liquid crystal through a storage capacitor. An amount of change in voltage to be applied to the liquid crystal Vcc is represented by the following equation (2) where a change in voltage of Ve is Vge+ or Vge−.

$$Vcc=Cst/(Clc+Cst+Cgd)\times(Vge+\text{ or }Vge-) \quad (2)$$

Note that, of the image signals supplied through the source lines, part to be written as negative in the end is subjected to processing, such as bit inversion, by the signal processing section 3801, for example, so that the luminance when the signal is written as negative coincides with the original luminance.

With such driving as described above, alternate inversion driving can be carried out while a one-fold potential is supplied to the source line.

On the other hand, as illustrated in FIG. 39, after a source-line potential is written in the liquid crystal 202, the potential in the other-end electrode 3401 is further changed after 80% of the period of one frame has passed, for example, and then the potential of the other-end electrode 3401 is further changed (Ve+ or Ve−) and kept in that state. With this, the voltage required for preventing back transition can be applied to the liquid crystal 202 through the storage capacitor 203.

The amount of change Vp in potential applied to the liquid crystal can be represented as the above equation (1), where the amount of change in Ve is Ve+ or Ve−.

As described above, according to the eleventh embodiment, in addition to the effects of the tenth embodiment, it is possible to carry out alternate inversion driving while driving the source line by a one-fold potential. Therefore, it is possible to reduce cost of a circuit for driving the source line or cost of a driver IC.

Twelfth Embodiment

In the above tenth and eleventh embodiments, the other-end electrode 3401 is driven by the other-end driver 3401. However, such driving has some disadvantages, such as requiring a new driver, or providing a new wiring to the liquid crystal panel 3605, resulting in reduction in aperture ratio. In the present embodiment, the other-end electrode 3401 is connected to a gate line of an adjacent picture element (hereinafter referred to as preceding-step gate) for supplying a potential to the other-end electrode 3401 for preventing back transition, thereby preventing the above disadvantages.

Figure 40:
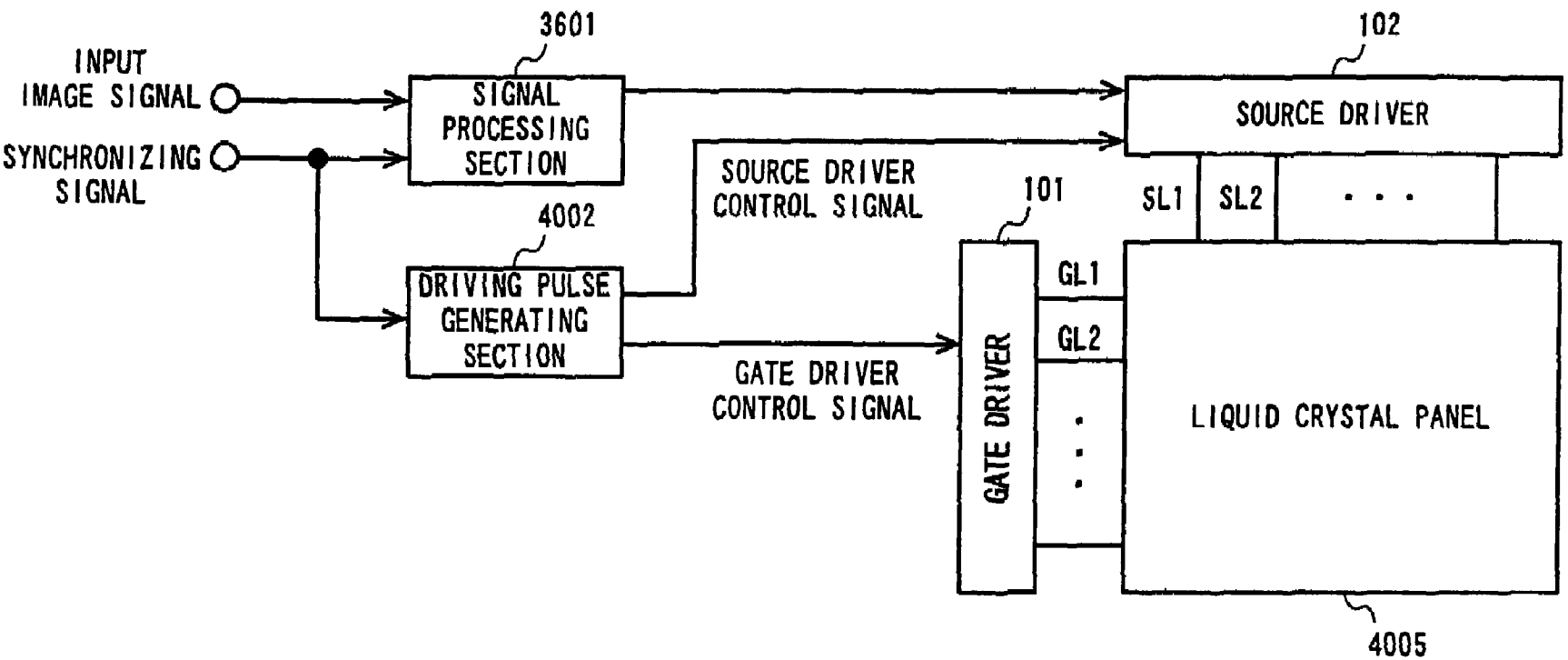
FIG. 40 is a block diagram showing the construction of a liquid crystal device according to a twelfth embodiment of the present invention.

FIG. 40 is a block diagram illustrating the construction of a liquid crystal display device according to a twelfth embodiment of the present invention. In FIG. 40, the liquid crystal display device includes a signal processing section 3601, a driving pulse generating section 4002, a gate driver 101, a source driver 102, and a liquid crystal panel 4005. Note that, in FIG. 40, the components equivalent to those in FIG. 36 are provided with the same reference numerals, and are not described herein.

Figure 41:
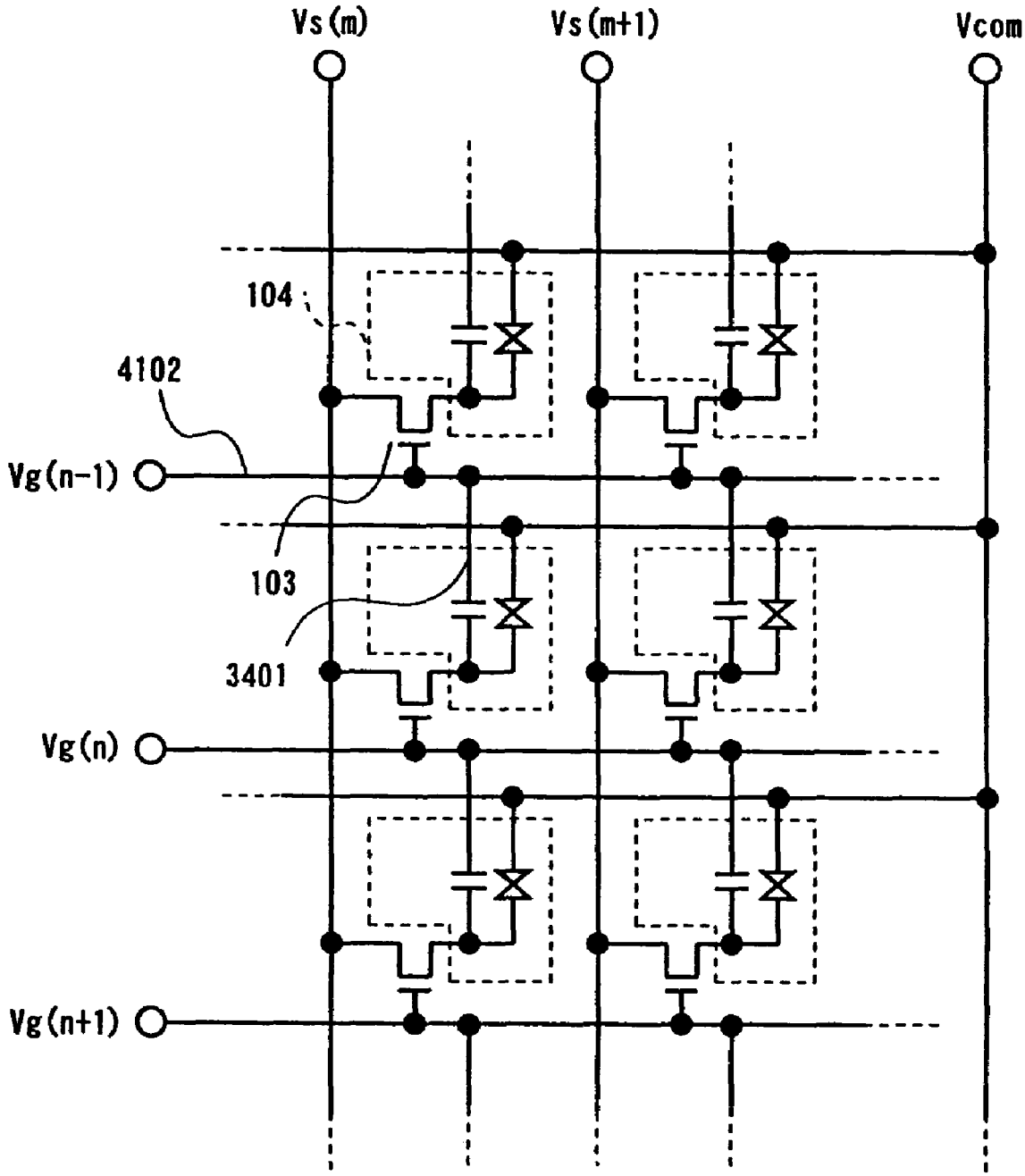
FIG. 41 is an illustration showing the detailed construction of a liquid crystal panel 4005.

FIG. 41 illustrates the detailed construction of the liquid crystal panel 4005. In FIG. 41, the other-end electrode 3401 is connected to a preceding-step gate 4102, which is an adjacent gate line.

Figure 42:
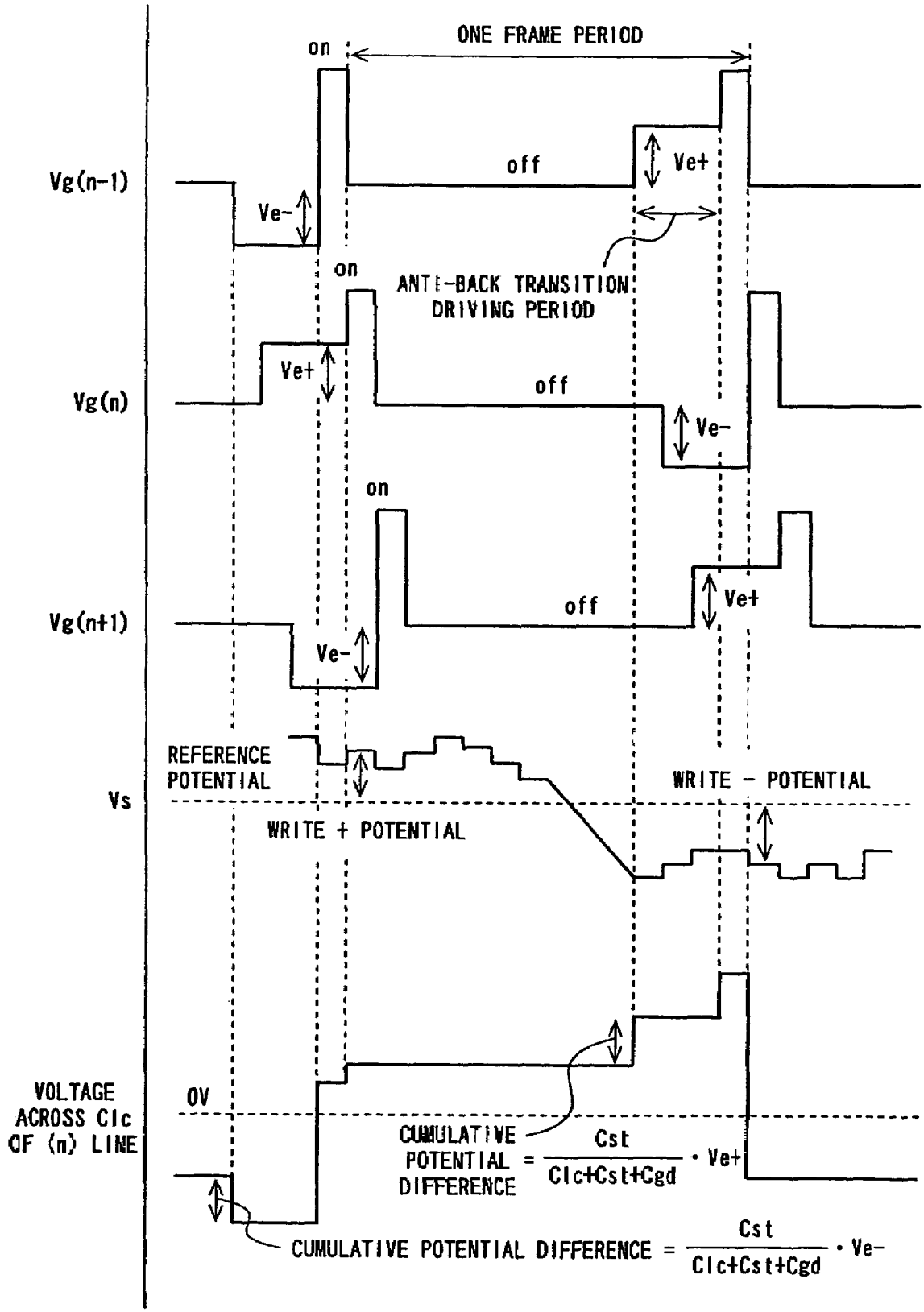
FIG. 42 is an illustration showing a relation between a potential supplied to the picture element and a voltage applied to the liquid crystal 202.

In the present embodiment, as illustrated in FIG. 42, after a source line potential is written in the liquid crystal 202 and then after 80%, for example, of the period of one frame passes, the potential of the preceding-step gate Vg(n−1) is changed (Ve+ or Ve−) and kept in that state. With this, the voltage required for preventing back transition can be applied to the liquid crystal 202 through the storage capacitor 203.

As described above, according to the twelfth embodiment, the other-end electrode 3401 is connected to the preceding-step gate, and the potential given to this preceding-step gate is manipulated for preventing a back transition phenomenon. Also, the liquid crystal panel 3605 does not have to be provided with a new wiring, and therefore the problem of reduction in aperture ratio does not occur. Also, no new driver is required.

The various embodiments of the present invention have been described above. Note that, as the driving scheme of these embodiments, it is generally known that periodically applying a high voltage (voltage at black level) to the liquid crystal is effective to improve display quality of moving pictures. Therefore, even if the liquid-crystal cells are not OCB cells, it is effective to apply the driving scheme of the present invention as a driving scheme suitable for moving pictures.

INDUSTRIAL APPLICABILITY

As described above, the liquid crystal display device according to the present invention achieves improvements in evenness in image display or solves insufficiency in recharge at the time of periodically writing a non-image signal in addition to an image signal, thereby enabling image display with higher image quality.

The invention claimed is:

1. A method for driving a liquid crystal panel, by supplying an image signal which is a picture-element signal corresponding to an image an a non-image signal which is independent from the image signal and is a picture-element signal for black display, the liquid crystal panel having source lines supplied with a picture-element signal, gate lines supplied with a scanning signal, and picture-element cells, of which transmittance is determined by an absolute value of an applied voltage, arranged on intersections of the source lines and the gate lines, the method comprising:

a non-image write step of simultaneously writing the non-image signal in picture elements on n (n is equal to or greater than 2) neighboring gate lines and an image write step of sequentially writing the image signal on each gate line, wherein the non-image write step is carried out for a plurality of number of times in one frame period;

at the image write step carried out immediately after the non-image write step is carried out, the image signal is written on a line which is different from the line on which the image signal is written for the non-image write step;

in the non-image step signal supplied from the source lines, a polarity with reference to a reference potential is inversed at each non-image write step; and the image signal and the non-image signal on each gate line are synchronous in each frame period and polarities of the image signal and the non-image signal with reference to a reference potential are inversed.

2. The method for driving the liquid crystal panel according to claim 1, wherein the image signal on each gate line and the non-image signal intermittently supplied in one frame period after the image signal is supplied are equal in polarity with reference to a reference potential.

3. The method for driving the liquid crystal panel according to claim 1, wherein the image signal on each gate line of the non-image signal intermittently supplied in one frame period after the image signal is supplied are opposite in polarity with reference to a reference potential.

4. A device for driving a liquid crystal panel, by supplying an image signal which is a picture-element signal corresponding to an image and a non-image signal which is independent from the image signal and is a picture-element signal for black display, the liquid crystal panel having source lines supplied with a picture-element signal, gate lines supplied with a scanning signal, and picture-element cells, of which transmittance is determined by an absolute value of an applied voltage, arranged on intersections of the source lines and the gate lines, wherein the driving means is operable to execute a non-image write step of simultaneously writing the non-image signal in picture elements on at least n (n is equal to or greater than 2) neighboring gate lines and an image write step of sequentially writing the image signal on each gate line;

the non-image write step is carried out for a plurality of number of times in one frame period;

at the image write step carried out immediately after the non-image write step is carried out, the image signal is written on a line which is different from the line on which the image signal is written at the non-image write step;

in the non-image signal supplied from the source lines, a polarity with reference to a reference potential is inversed at each non-image write step; and the image signal and the non-image signal on each gate line are synchronous in each frame and polarities of the image signal and the non-image signal with reference to a reference potential are inversed.

5. The device for driving the liquid crystal panel according to claim 4, wherein the image signal on each gate line and the non-image signal intermittently supplied in one frame period after the image signal is supplied are equal in polarity with reference to a reference potential.

6. The device for driving the liquid crystal panel according to claim 4, wherein the image signal on each gate line and the non-image signal intermittently supplied in one frame period after the image signal is supplied are opposite in polarity with reference to a reference potential.

* * * * *